US005510878A

United States Patent [19]

Noda et al.

[11] Patent Number: 5,510,878

[45] Date of Patent: Apr. 23, 1996

[54] PROCESS CARTRIDGE AND IMAGE FORMING SYSTEM

[75] Inventors: Shinya Noda, Yokohama; Kazumi Sekine, Kawasaki; Tadayuki Tsuda, Kawasaki; Isao Ikemoto, Kawasaki; Kazushi Watanabe, Yokohama; Yoshikazu Sasago, Tokyo; Kazunori Kobayashi, Kawasaki; Shinichi Sasaki, Fujisawa, all of Japan

[73] Assignee: Canon Kabushiki Kaisha, Tokyo, Japan

[21] Appl. No.: 416,469

[22] Filed: Apr. 4, 1995

Related U.S. Application Data

[60] Continuation of Ser. No. 204,518, Mar. 2, 1994, abandoned, which is a division of Ser. No. 951,753, Sep. 28, 1992, Pat. No. 5,404,198, which is a continuation-in-part of Ser. No. 626,553, Dec. 12, 1990, Pat. No. 5,223,893.

[30] Foreign Application Priority Data

| | | | |
|---|---|---|---|
| Dec. 15, 1989 | [JP] | Japan | 1-324090 |
| Jun. 30, 1992 | [JP] | Japan | 4-194655 |

[51] Int. Cl.[6] ..... G03G 5/00

[52] U.S. Cl. ..... 355/211

[58] Field of Search ..... 118/656, 657, 118/658; 355/200, 210, 211, 245, 326, 327

[56] References Cited

U.S. PATENT DOCUMENTS

| | | | |
|---|---|---|---|
| 3,985,436 | 10/1976 | Tanaka et al. | 355/200 |
| 4,500,195 | 2/1985 | Hosono | 355/208 |
| 4,540,268 | 9/1985 | Toyono et al. | 355/210 |
| 4,591,258 | 5/1986 | Nishino et al. | 355/200 |
| 4,609,276 | 9/1986 | Mitzutani | 355/210 |
| 4,627,701 | 12/1986 | Onoda et al. | 355/221 |
| 4,639,119 | 1/1987 | Isaka | 355/200 |
| 4,708,455 | 11/1987 | Kubota et al. | 355/211 |
| 4,809,033 | 2/1989 | Ikemoto et al. | 355/271 |
| 4,839,690 | 6/1989 | Onoda et al. | 355/211 |
| 4,851,960 | 6/1989 | Nakamura et al. | 361/225 |
| 4,862,209 | 8/1989 | Sakamoto et al. | 355/211 |
| 4,888,620 | 12/1989 | Fujino et al. | 355/211 |
| 4,893,151 | 1/1990 | Yamazaki et al. | 355/245 |
| 4,951,093 | 8/1990 | Ishii et al. | 355/245 |
| 4,965,633 | 10/1990 | Surti | 355/200 |
| 4,972,227 | 11/1990 | Onoda et al. | 355/210 |
| 4,975,744 | 12/1990 | Ebata et al. | 355/211 |
| 4,996,566 | 2/1991 | Morita et al. | 355/246 |
| 5,028,966 | 7/1991 | Kozuka et al. | 355/260 |
| 5,095,335 | 3/1992 | Watanabe et al. | 355/210 |
| 5,101,871 | 4/1992 | Susomu | 355/260 |
| 5,126,800 | 6/1992 | Shishido et al. | 355/211 |
| 5,151,734 | 9/1992 | Tsuda et al. | 355/200 |

FOREIGN PATENT DOCUMENTS

| | | |
|---|---|---|
| 0353975 | 2/1990 | European Pat. Off. . |
| 0419122 | 3/1991 | European Pat. Off. . |
| 3842482 | 6/1989 | Germany . |
| 62-156686 | 7/1987 | Japan . |
| 62-192769 | 8/1987 | Japan . |
| 62-192770 | 8/1987 | Japan . |
| 63-149669 | 6/1988 | Japan . |
| 3257449 | 11/1991 | Japan . |

*Primary Examiner*—Morris H. Nimmo
*Assistant Examiner*—Christopher Horgan
*Attorney, Agent, or Firm*—Fitzpatrick, Cella, Harper & Scinto

[57] ABSTRACT

The present invention is characterized by an image bearing member, a toner carrying member for directing toner to the image bearing member and a magnet disposed within the toner carrying member, and in that the image bearing member and the magnet are positioned by a common positioning member. With above construction, it is possible to provide a process cartridge and an image forming system, which can remarkably the accuracy of attachment positions of an image bearing member and a magnet, thus remarkably enhancing the image quality.

46 Claims, 47 Drawing Sheets

PROCESS CARTRIDGE AND IMAGE FORMING SYSTEM

This application is a continuation of prior application Ser. No. 08/204,518, filed on Mar. 2, 1994, now abandoned, which is a divisional of prior application Ser. No. 07/951,753 filed on Sep. 28, 1992, now U.S. Pat. No. 5,404,198, issued Apr. 4, 1995, which is a continuation-in-part of prior application Ser. No. 07/626,553 filed on Dec. 12, 1990, now U.S. Pat. No. 5,223,893, issued Jun. 29, 1993.

BACKGROUND OF THE INVENTION

1. Field of the Invention

The present invention relates to a process cartridge and an image forming system on which such the process cartridge can be mounted. Such an image forming system may be embodied, for example, as an electrophotographic copying machine, a laser beam printer, a facsimile, a word processor or the like.

2. Description of the Related Art

In image forming systems such as copying machines, a latent image is formed by selectively exposing an image bearing member uniformly charged, the latent image is then visualized with toner, and then the toner image is transferred onto a recording sheet, thereby forming an image on the recording sheets. In such image forming systems, whenever the toner is used up, new toner must be replenished. The toner replenishing operation not only is troublesome, but also often causes the contamination of the surroundings. Further, since the maintenance of various elements or members can be performed only by an expert in the art, most of the users feel inconvenient.

In order to eliminate such drawbacks and inconvenience, an image forming system wherein parts such as a developing device in which toner was used up or an image bearing member of which a service life was expired can easily be exchanged, thereby facilitating the maintenance, by assembling the image bearing member, a charger, the developing device and a cleaning device integrally as a process cartridge which can be removably mounted within the image forming system has been proposed and put into practical use, for example, as disclosed U.S. Pat. Nos. 3,985,436, 4,500,195, 4,540,268 and 4,627,701.

A conventional process cartridge is formed by a first unit holding a photosensitive drum, and a second unit holding a developing sleeve. In the first unit, the photosensitive drum is provided at both of its ends with flange gears and is supported by a frame of the first unit via drum shafts passing through holes formed in the flange gears. On the other hand, in the second unit, within the developing sleeve, there is disposed a magnet for holding magnetic developer on a surface of the developing sleeve. The developing sleeve is supported and fixedly held by a bearing mounted on a frame of the second unit via a flange secured to one end of the developing sleeve.

Further, the magnet is provided at both of its ends with D-cut portions. One end of the magnet at a driving side of the developing sleeve passes through the interior of the flange and is fixedly held by the frame of the second unit via a bearing and the other end of the magnet is also fixedly held by the frame of the second unit via a bearing.

Incidentally, the first and second units are held in a confronting relation to each other by springs and the like so that a predetermined distance is maintained between the photosensitive drum and the developing sleeve.

However, with the above-mentioned arrangement, a distance between the photosensitive drum and the magnet is varied or changed during the image forming operation due to the eccentricity or deflection of the developing sleeve, the poor concentricity between the developing sleeve and its flange, the poor concentricity between the developing sleeve and the magnet supported by the second unit, and/or the manufacturing and assembling errors of parts, with the result that it is feared that an amount of toner (developer) transferred from the surface of the developing sleeve to the surface of the photosensitive drum is also varied, thus causing unevenness in the image density.

SUMMARY OF THE INVENTION

An object of the present invention is to provide a process cartridge and an image forming system, which can eliminate unevenness in density, thereby improving the image quality.

Another object of the present invention is to provide a process cartridge and an image forming system, which can maintain the assembling accuracy between a surface of an image bearing member and a magnet.

A further object of the present invention is to provide a process cartridge and an image forming system, which can remarkably improve the accuracy of attachment positions of an image bearing member and a magnet.

Another object of the present invention is to provide a process cartridge and an image forming system, wherein an image bearing member and a magnet can be positioned by a common positioning member.

DESCRIPTION OF THE PREFERRED EMBODIMENTS

Figure 1:
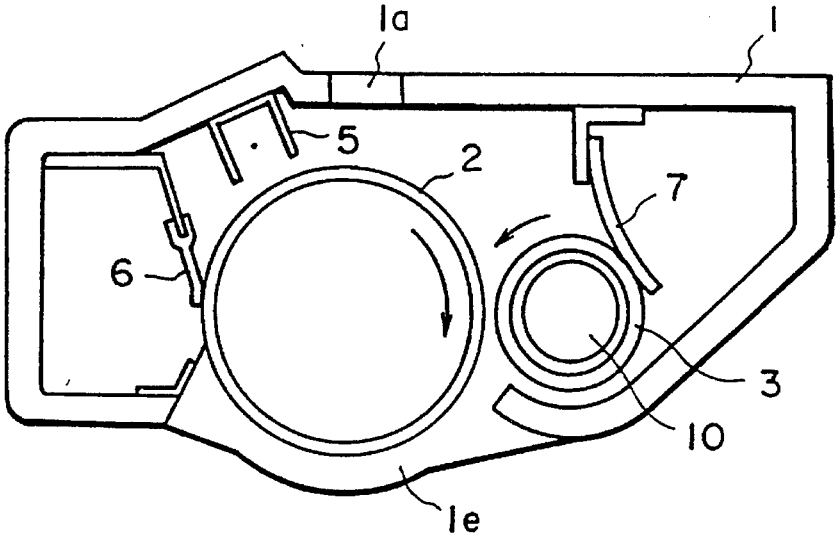
FIG. 1 is a longitudinal sectional view of a process cartridge according to a first embodiment of the present invention.
Figure 2:
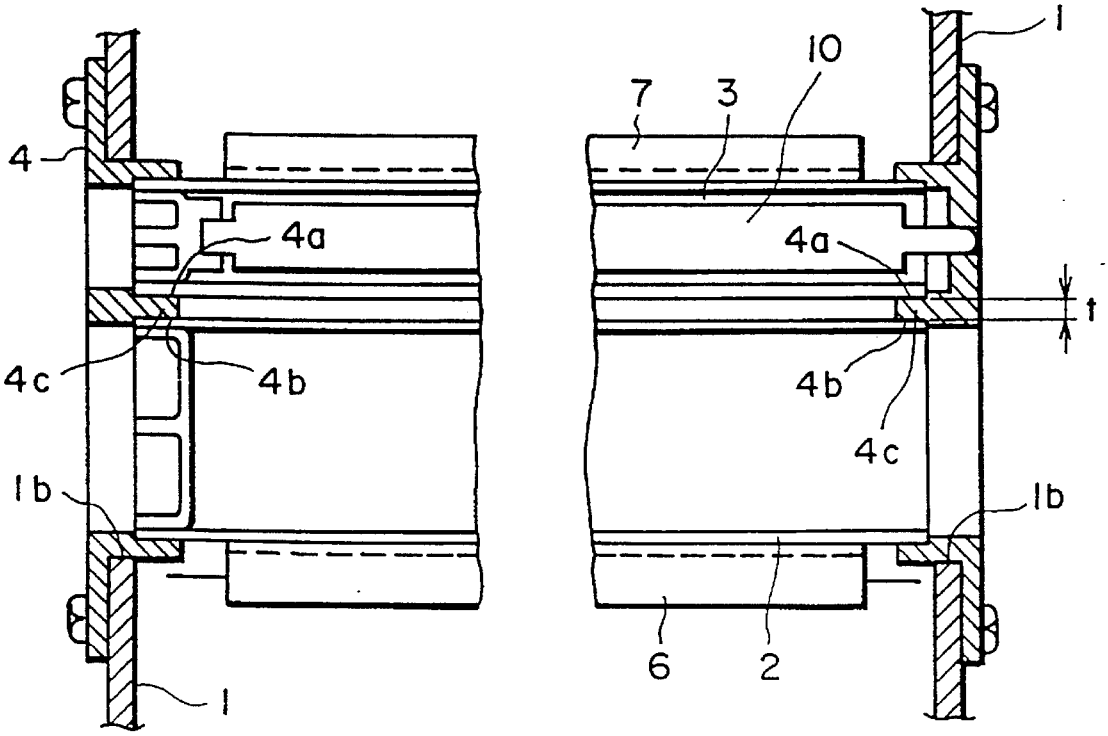
FIG. 2 is a sectional view of a major part of-the process cartridge.
Figure 3:
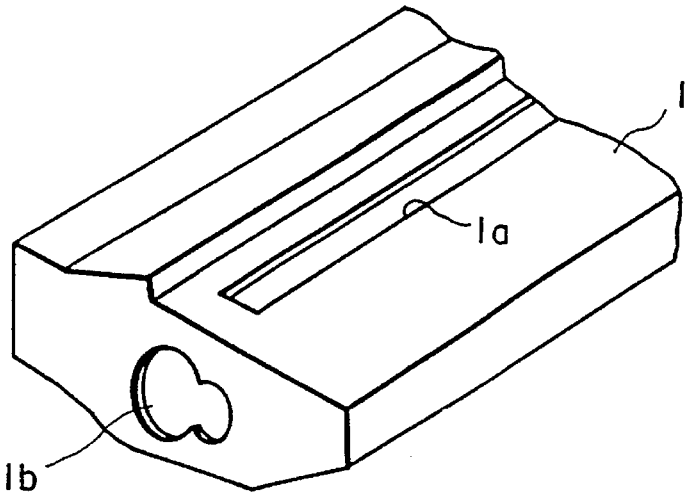
FIG. 3 is a partial perspective view of an outer appearance of the process cartridge.

Referring to FIGS. 1–3, the process cartridge according to a first embodiment of the present invention will be described. The casing 1 of the process cartridge is produced by integral molding with resin material. It is provided with an elongated opening 1*a* extending in a direction of the width thereof in the top surface to permit image exposure. In side walls, there are formed openings 1*b* (FIG. 3) for receiving bearings 4 (FIG. 2) for rotatably supporting an image bearing member in the form of a photosensitive drum 2 and a developer carrying member in the form of a developing sleeve 3. As shown in FIG. 1, in a bottom wall of the casing 1, an opening 1*e* is formed to permit transfer means to face through to the photosensitive drum 2, when the process cartridge is mounted in the image forming apparatus.

The photosensitive drum 2 and the developing sleeve 3 are both supported on the peripheral surfaces of the bearings 4, which are located at adjacent opposite ends of a cylinder constituting a base of the photosensitive drum 2 and a cylinder constituting a base of the developing sleeve. The photosensitive drum 2 and the developing sleeve 3 are supported by the bearings 4, in the manner disclosed in U.S. Ser. No. 580,563 , now U.S. Pat. No. 5,151,734, issued Sep. 29, 1992 which has been assigned to the assignee of this application. The photosensitive drum 2 has a photoconductive semiconductor surface layer made of organic semiconductor. The photosensitive drum 2 is rotated in the direction indicated by an arrow in FIG. 1. Around the photosensitive drum 2, there are disposed a charger 5, a developing sleeve 3, cleaning blade 6 press-contacted to the outer surface of the photosensitive drum 2. Thus, the photosensitive drum 2 is urged always toward the developing sleeve 3 by the elastic cleaning blade (rubber or the like).

To the outer periphery of the developing sleeve 3, a developing blade 7 is press-contacted. The developing blade 7 is made of elastic material such as rubber, phosphor bronze, stainless steel or the like. The developing sleeve 3 is constantly toward pressed the photosensitive drum by the developing blade 7. The developing blade 7 cooperates with the magnet 10 in the developing sleeve 3 to regulate the layer thickness of the developer when the developer is applied on the surface of the developing sleeve, so as to make the thickness uniform. Thus, the photosensitive drum 2 and the developing sleeve 3 are urged, or pressed toward each other by the cleaning blade 6 and the developing blade 7, respectively. The cleaning blade 6 and the developing blade 7 are supported on the casing 1.

Here, the urging toward each other of the photosensitive drum 2 and the developing sleeve 3 means as follows.

Figure 7:
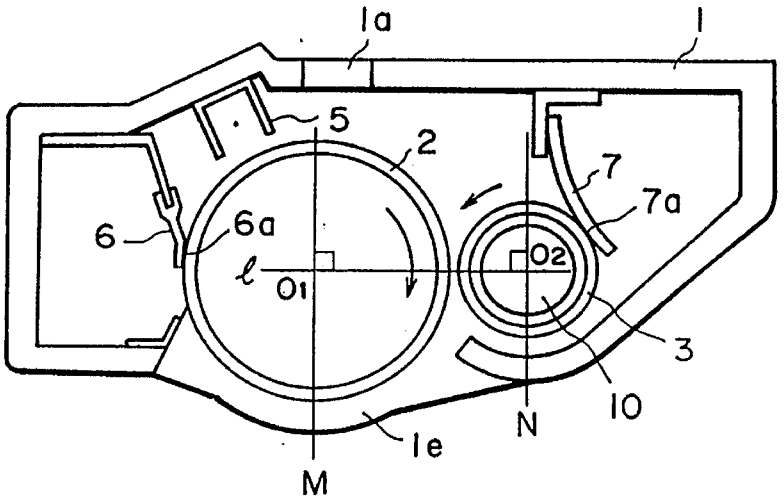
FIG. 7 is a sectional view illustrating the position where the cleaning blade and the developing blade are contacted to an image bearing member.

As shown in FIG. 7, a plane $\mathbf{1}_1$ including a rotational center axis 01 of the photosensitive drum 2 and the rotational center axis 02 of the developing sleeve 3 is considered, and also planes M and N perpendicular to the plain $\mathbf{1}_1$ passing through the axes 01 and 02 are considered. The "urging toward each other" occurs when the contact portion 6*a* between the photosensitive drum 2 and the cleaning blade 6 is on the outer periphery of the photosensitive drum 2 at a side opposite from the developing sleeve relative to the plane M, and the contact portion 7*a* between the developing sleeve 3 and the developing blade 7 is on the outer periphery of the developing sleeve at a side opposite from said photosensitive drum relative to the plane N, and in addition, the cleaning blade 6 and the developing blade 7 are press-contacted to the photosensitive drum 2 and the developing sleeve 3, respectively with predetermined respective pressures. In this embodiment, a line pressure of the contact between the cleaning blade 6 and the photosensitive drum 2 is 20–40 g/cm, and that between the developing blade 7 and the developing sleeve is 20–70 g/cm.

As shown in FIG. 2, the bearing member 4 has an opening 4*a* for receiving the developing sleeve 3 and an opening 4*b* for receiving the photosensitive drum 2. The portion 4*c* between the openings has a thickness t. Since the photosensitive drum 2 and the developing sleeve 3 are urged toward each other by the cleaning blade 6 and the developing blade 7, the gap between the outer peripheral surface of the photosensitive drum 2 and that of the developing sleeve 3 is precisely maintained always to be equal to the thickness t (100–500 microns, for example) unaffected by the play between the bearing 4 and the photosensitive drum 2 and between the bearing 4 and the developing sleeve 3 and unaffected by the whirling of the outer peripheral surface.

Absent the pressure between the photosensitive drum 2 and the developing sleeve 3 created by the cleaning blade 6 and the developing blade 7, the play between the photosensitive drum 2 and the developing sleeve 3 relative to the bearing 4 is approximately 0.07 mm at maximum, and therefore, the possible error in the gap between the photosensitive drum 2 and the developing sleeve 3 is 0.14 mm at maximum. In addition to the error, the error attributable from the whirling motion of the outer peripheries of the photosensitive drum 2 and the developing sleeve 3 are added to the error, so that the image quality is influenced.

According to this embodiment, even if the casing 1 is integrally molded, and even if the urging means such as a spring particularly for urging the developing sleeve 3 toward the photosensitive drum 2 is omitted, the gap between the photosensitive drum 2 and the developing sleeve can maintained precisely to be to Therefore, the structure of the process cartridge can be simplified, and the size and the cost thereof can be reduced.

Additionally, the necessity for the spacer roller required in the prior art can be eliminated and therefore, the degradation of the image quality attributable to the contamination of the spacer rollers due to the scattering of the developer can be eliminated, so that the high quality of the image can be stably provided.

Figure 8:
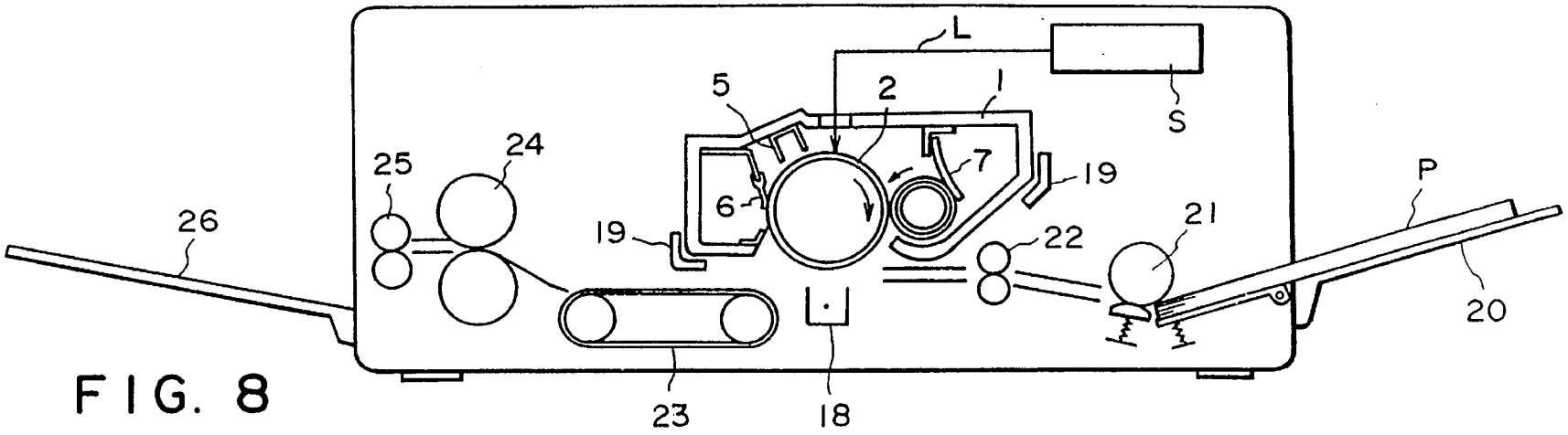
FIG. 8 is a sectional view of an image forming apparatus to which the process cartridge is mounted.
Figure 9:
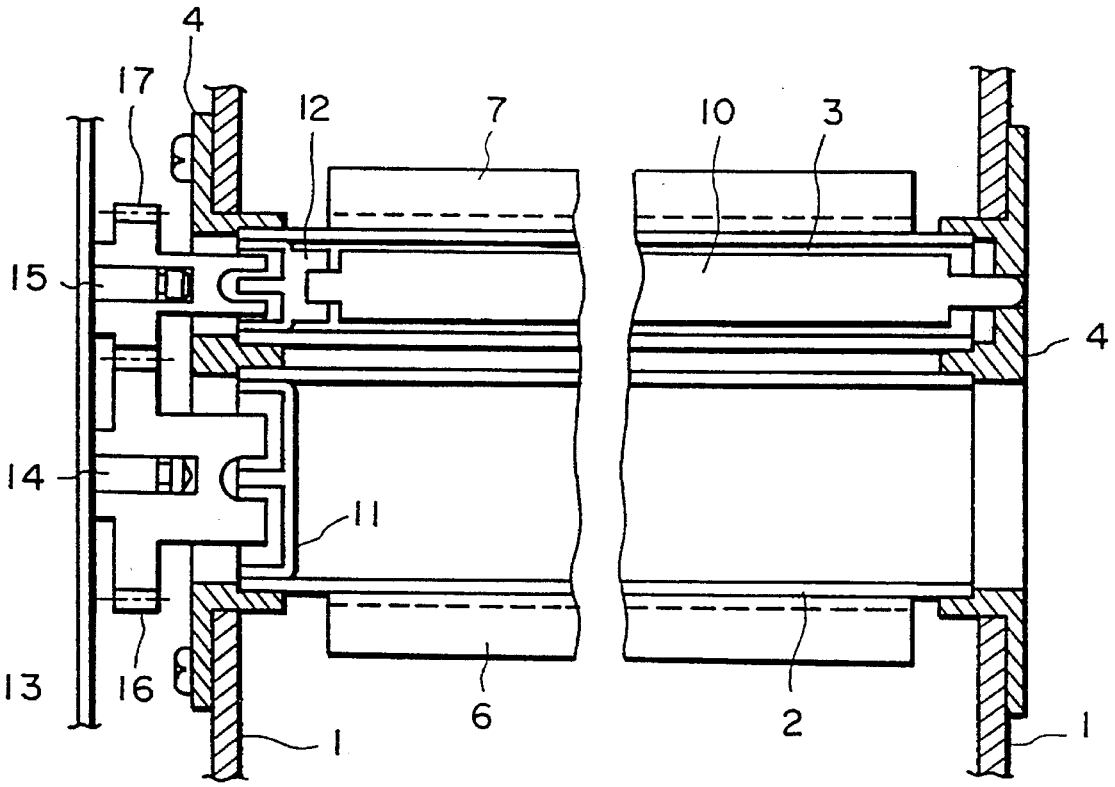
FIG. 9 is a sectional view of a drive transmitting section between the photosensitive drum and the developing sleeve when the process cartridge is mounted thereto.

FIG. 8 shows an image forming apparatus in the form of a laser beam printer incorporating the process cartridge shown in FIGS. 1–3. FIG. 9 shows a drive transmission system between the photosensitive drum and the developing sleeve in the process cartridge.

As shown in FIG. 9, shafts 14 and 15 projected from the main assembly 13 of the laser beam printer have driving gears 16 and 17 rotatably mounted thereto and meshed with each other. When the process cartridge is mounted to the main assembly 13, the driving gears 16 and 17 are engaged with a flange 11 of the photosensitive drum 2 and engaged with a flange 12 of the developing sleeve 3, as shown in the Figure. Therefore, the photosensitive drum 2 and the developing sleeve 3 receive the driving force through the driving gears 16 and 17 from an unshown driving motor so as to rotate in the respective directions indicated by arrows in FIG. 8.

The image forming operation in the laser beam printer having the process cartridge, mounted thereto will now be described. Referring to FIGS. 8 and 9, the photosensitive drum 2 is uniformly charged by a charger and is exposed to image light L modulated in accordance with an image signal by a laser beam scanner S, so that an electrostatic latent image is formed in accordance with the image signal. The latent image is developed by the developer on the developing sleeve 3.

For example, a sheet of paper P contained in a sheet feed tray 20 is picked up by a pickup roller 21 and is once stopped by a pair of registration rollers 22. The registration rollers 22 feed the sheet P in timed relation with a developed image on the photosensitive drum 2. Onto the sheet P, the developed image is transferred from the photosensitive drum by a transfer charger 18. The sheet P after receiving the image is conveyed along a conveying guide 23 to an image fixing device 24, where it is subjected to the image fixing operation so that the toner image is fixed on the sheet P. The sheet P is discharged by discharging rollers 25 onto the discharge tray 26.

The developer remaining on the photosensitive drum 2 surface after the image transfer, is removed by a cleaning member 6, so that the photosensitive drum 2 is prepared for the next image formation.

In FIG. 8, designated by a reference numeral 19 is a guiding member for guiding the mounting and dismounting of the process cartridge. In this embodiment, the process cartridge is mounted or dismounted in the direction of the axis of the photosensitive drum 2 relative to the laser beam printer.

In this embodiment, the transfer charger is in the form of a corona discharger, but it may be a transfer roller supplied with a bias voltage.

Figure 4:
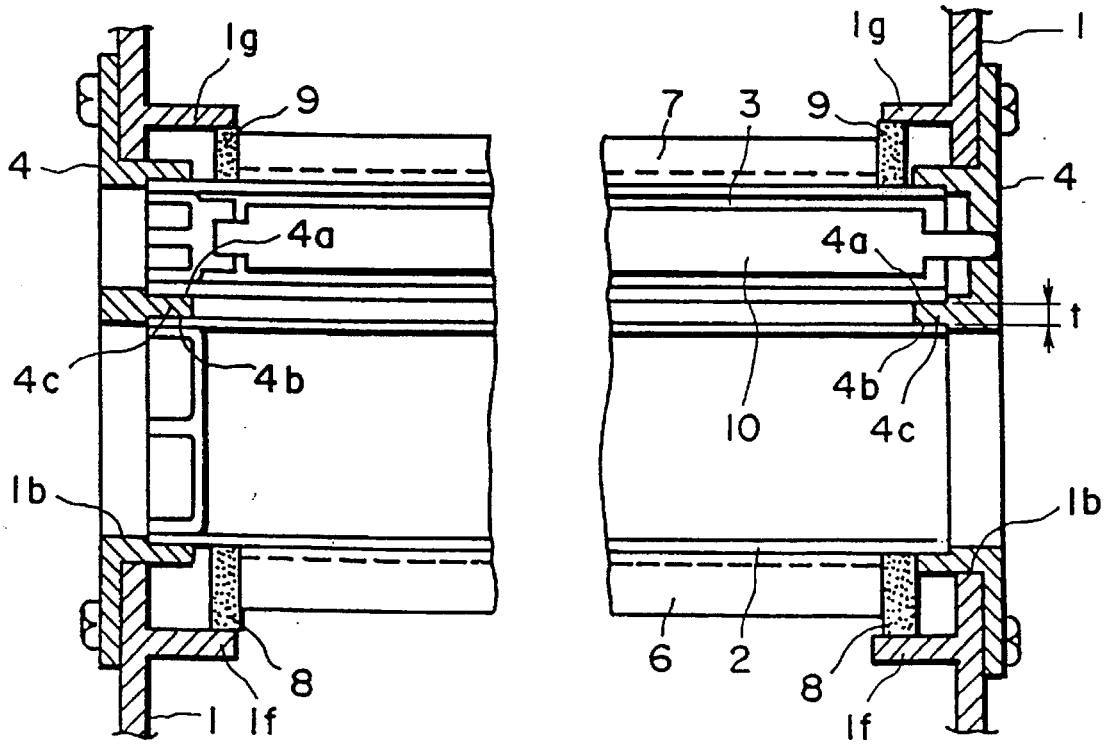
FIG. 4 is a cross-sectional view of a major part of a process cartridge according to a second embodiment of the present invention.

Referring to FIG. 4, the second embodiment of the present invention will be described. In FIG. 4, the same reference numerals as in FIGS. 1–3 are assigned to the elements having the corresponding functions.

In the embodiment of FIG. 4, drum end sealing members 8 and sleeve end sealing members 9 are employed to seal the photosensitive drum 2 and the developing sleeve 3 at the longitudinally opposite ends. At least the surfaces contacted to the photosensitive drum 2 and the sleeve surface 3 are made of felt or smooth surface sheet material, and the base portion thereof is made of elastic material such as foamed rubber. The sealing members are effective to prevent the developer from scattering through the end portions.

The drum end seal 8 is sandwiched between an outer surface of the photosensitive drum 2 and a part 1*f* of the casing, and the sleeve end seal 9, is sandwiched between the surface of the developing sleeve 3 and a part 1*g* of the casing.

The drum end seal 8 urges the photosensitive drum 2 to the developing sleeve 3, and the sleeve end seal 9 urges the developing sleeve 3 to the photosensitive drum 2. Therefore, the gap between the photosensitive drum 2 and the developing sleeve 3 is maintained to be equal to the thickness t of the portion 4*c* of the bearing 4. The same advantageous effects as in the first embodiment can be provided. Particularly, in this embodiment the urging forces by the sealing members are applied in addition to the urging force by the cleaning blade 6 and the developing blade 7. Therefore, this embodiment is even more preferred in this respect.

In this embodiment, the contact positions between the end seals and the photosensitive drum and between the end seals and developing sleeve are the same as in the first embodiment, and the seals are disposed in a non-image formation area.

Figure 5:
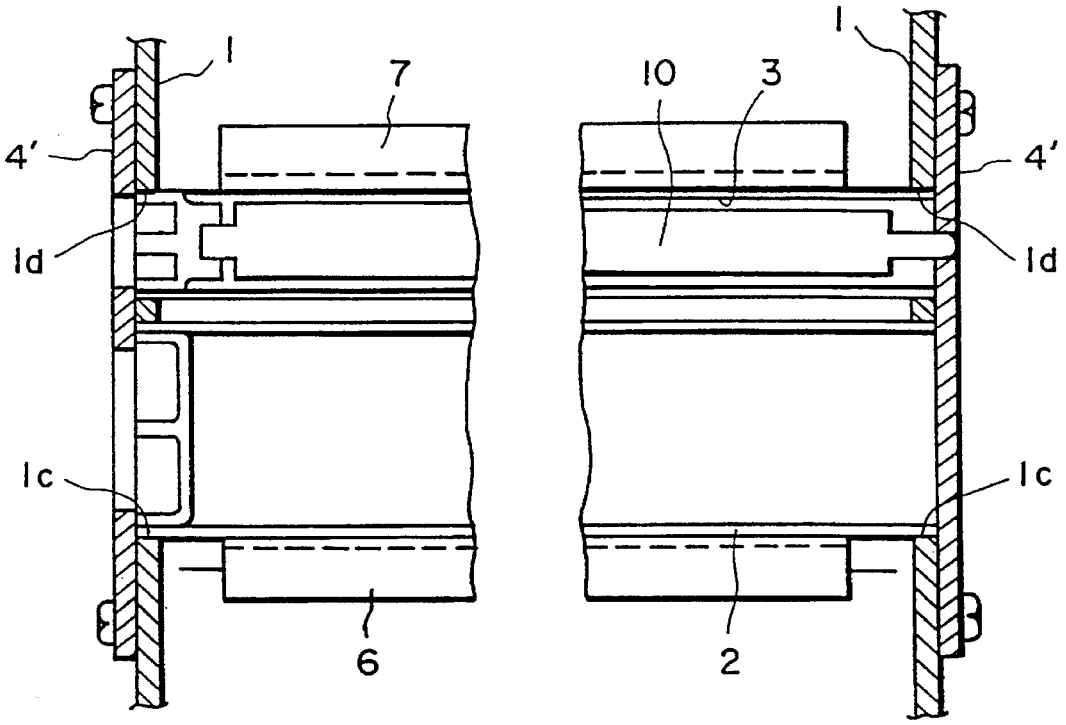
FIG. 5 is a cross-sectional view of a major part of the process cartridge according to a third embodiment of the present invention.
Figure 6:
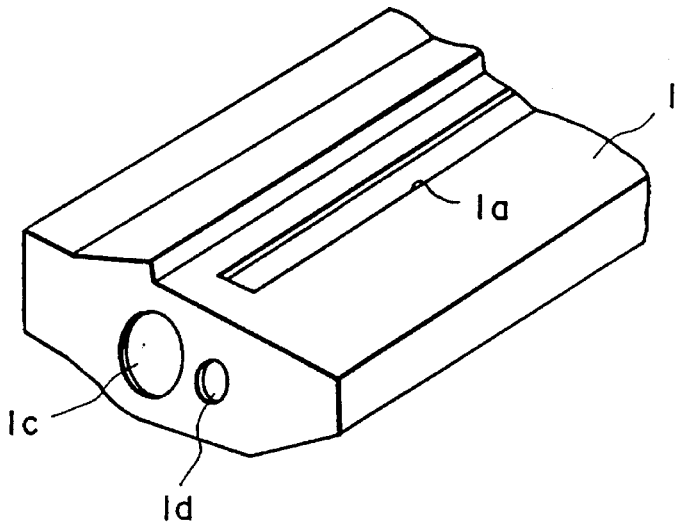
FIG. 6 is a partial perspective view of an outer appearance of a casing of the process cartridge of FIG. 5.

Referring to FIGS. 5 and 6, a third embodiment will be described. In the first and second embodiments, the bearing 4 supports the photosensitive drum 2 and the developing sleeve 3, and is mounted in the casing or frame 1. In the present embodiment, however, openings 1*c* and 1*d* are formed in the casing 1, and the photosensitive drum 2 and the developing sleeve are rotatably supported directly in the openings 1*c* and 1*d* without the use of separate bearings 4. End surfaces of the photosensitive drum 2 and the developing sleeve are abutted by stoppers 4' to limit the movement of the photosensitive drum 2 and the developing sleeve 3 in the longitudinal direction. In this embodiment, the casing 1 function as a supporting means for the photosensitive drum 2 and the developing sleeve 3.

The same advantageous effects as in the first and second embodiments are provided.

In the first, second and third embodiments, what determines the gap between the photosensitive drum 2 and the developing sleeve 3 is a part of the casing or frame 1, or the portion 4*c* of the bearing 4. This is not limiting. In place thereof, a spacer sheet made of high density polyethylene, nylon, polyacetal or the like usable as the image bearing member 4 may be sandwiched therebetween.

As regards the positional relation between the photosensitive drum and the developing roller, the gap therebetween is inevitable. For example, in the developing system wherein the developing roller is in contact with the photosensitive drum, the present invention is still usable to assure the correct contact pressure therebetween.

The means for acting on the image bearing member (photosensitive drum)is not limited to those described in the foregoing. Alternatively, it may be a charging roller or a charging blade contacted to the photosensitive drum to effect the charging process as disclosed in U.S. Pat. No. 4,851,960, for example.

The means actable on the developer carrying member (developing sleeve) is not limited to the member for regulating the developer layer thickness. It may be a supplying roller for simply supplying the developer to the developing sleeve.

In the foregoing embodiments, the cleaning member and the developer layer thickness regulating member are in the form of a blade. This is not limiting, and may be in the form of a roller.

The method of supporting the photosensitive drum or the developing sleeve is not limited to the outer peripheral supporting type.

As described in the foregoing, according to the present invention, the image bearing member and the developer carrying member are urged toward each other by means such as the elastic cleaning member or the like actable on the image bearing member and means actable on the developer carrying member such as the elastic developer layer thickness regulating member. Therefore, the correct positioning between the image bearing member and the developer carrying member can be accomplished without the necessity of particular urging means for this purpose. In addition, the process cartridge casing or frame which is required.to have high precision can be integrally molded, so that the structure of the process cartridge is simplified, and the size and the cost can be reduced.

It is possible to avoid use of the spacer roller, and in that case, the degradation of the image quality attributable to the contamination of the spacer roller can be avoided. Therefore, good images can be stably provided.

Figure 11:
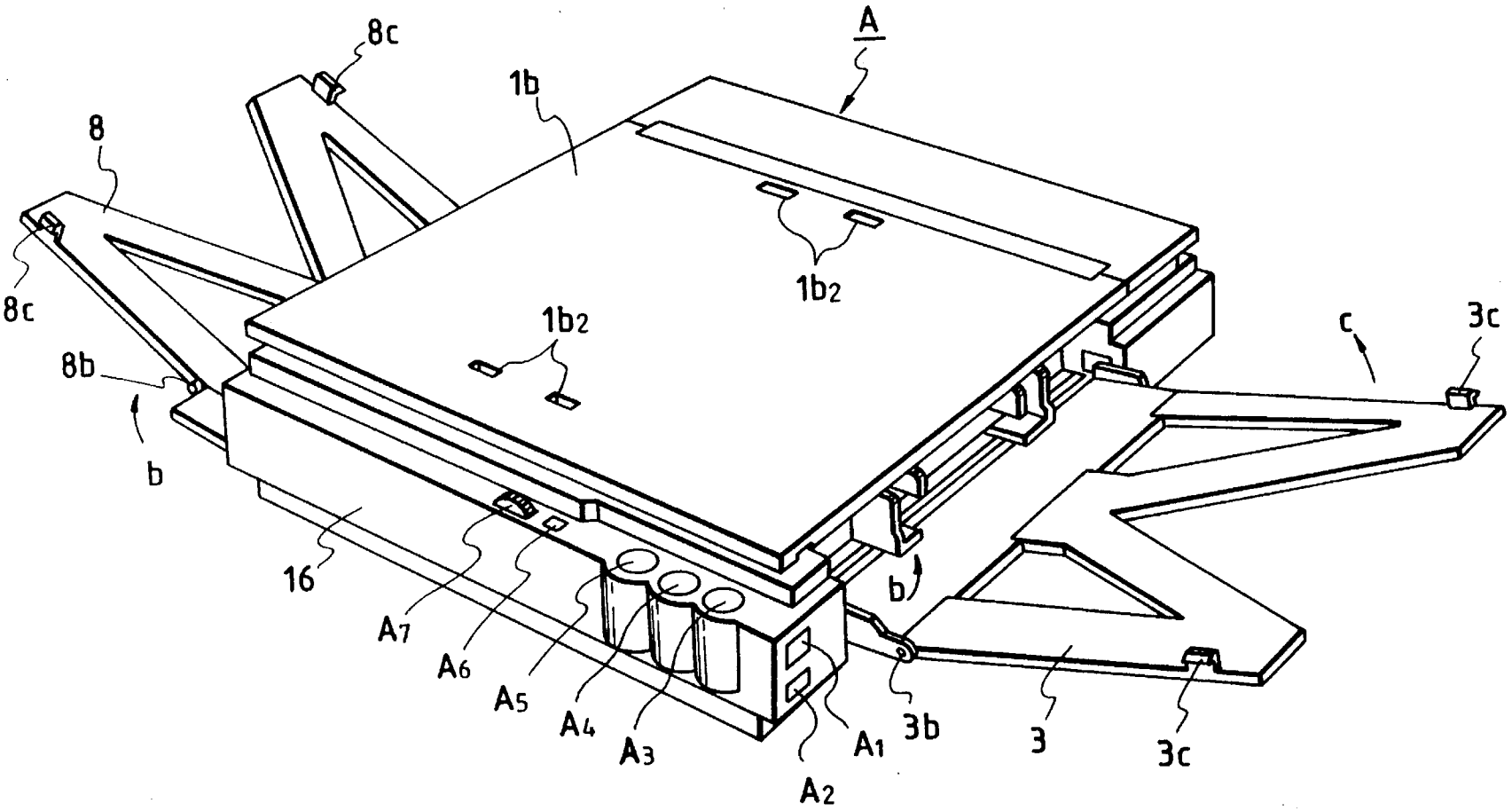
FIG. 11 is a perspective view of the copying machine in a condition that a tray is opened.
Figure 12:
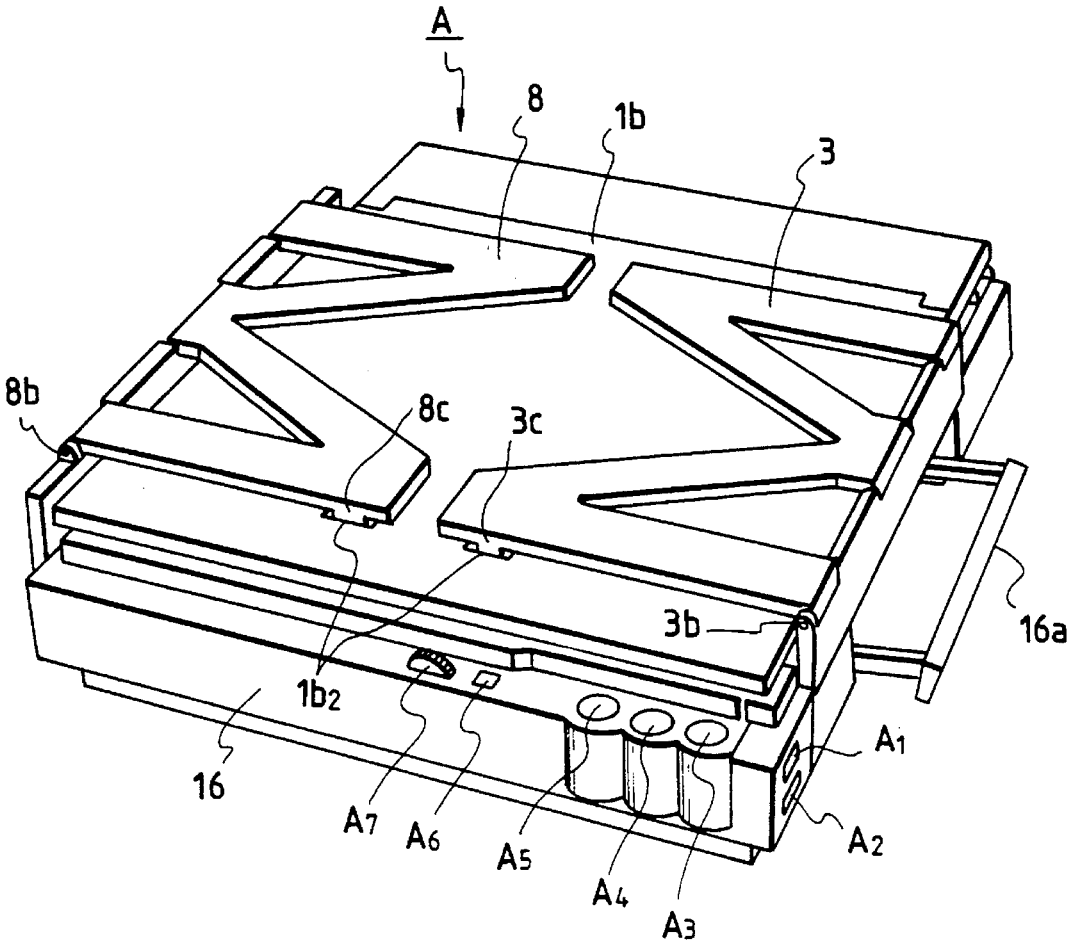
FIG. 12 is a perspective view of the copying machine in a condition that a tray is closed.
Figure 13:
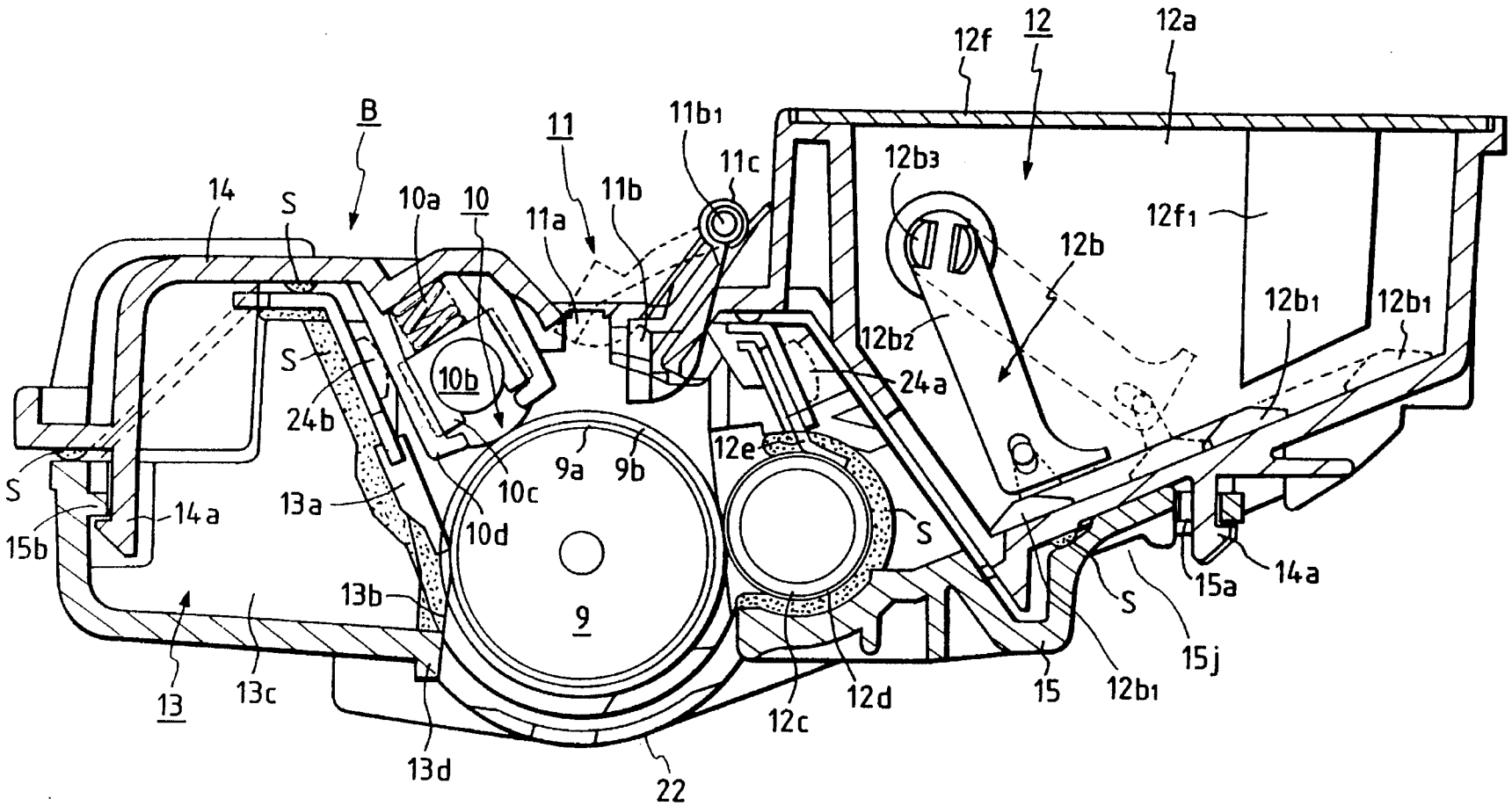
FIG. 13 is an elevational sectional view of the process cartridge.
Figure 14:
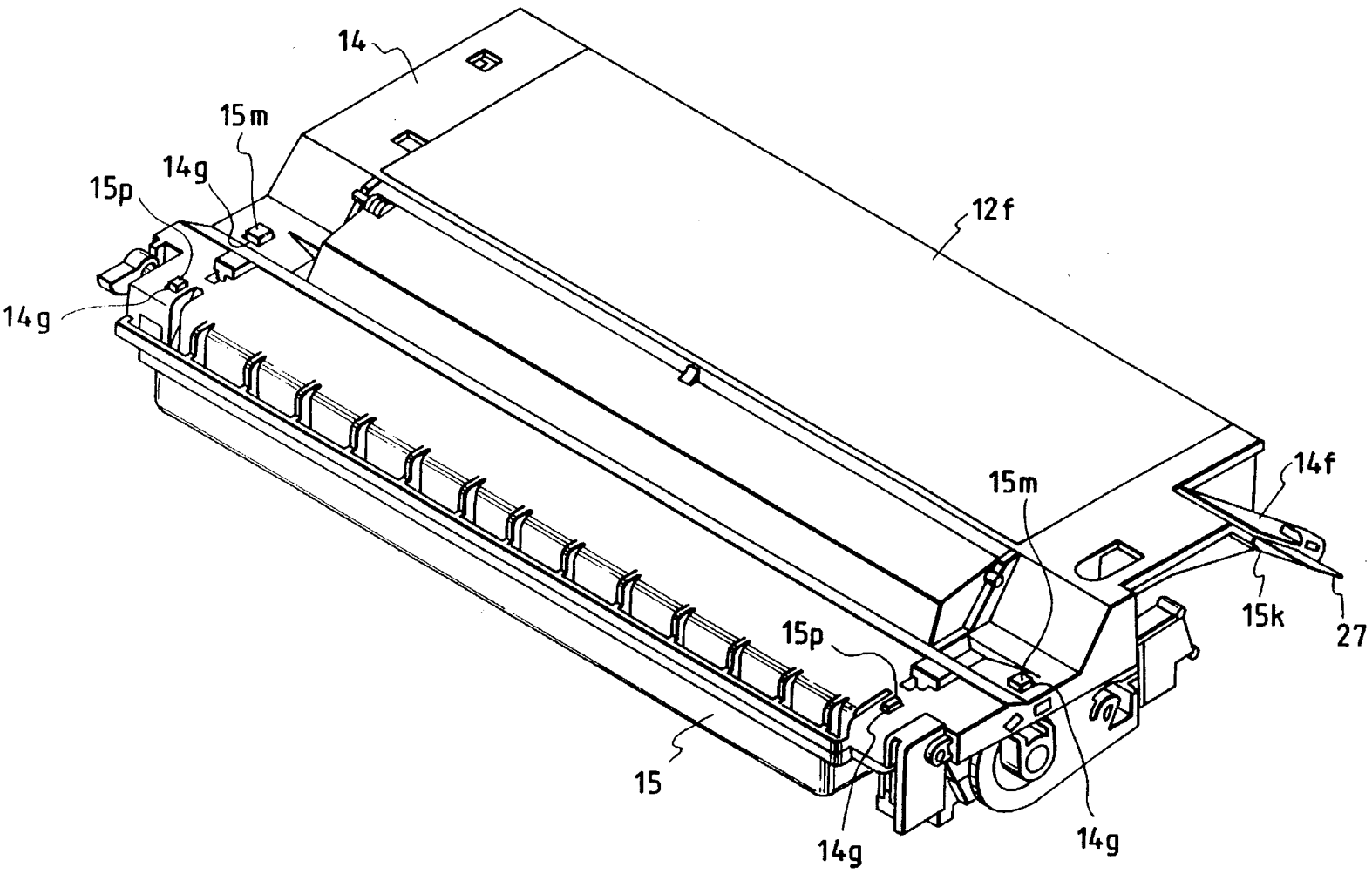
FIG. 14 is a perspective view of the process cartridge.
Figure 15:
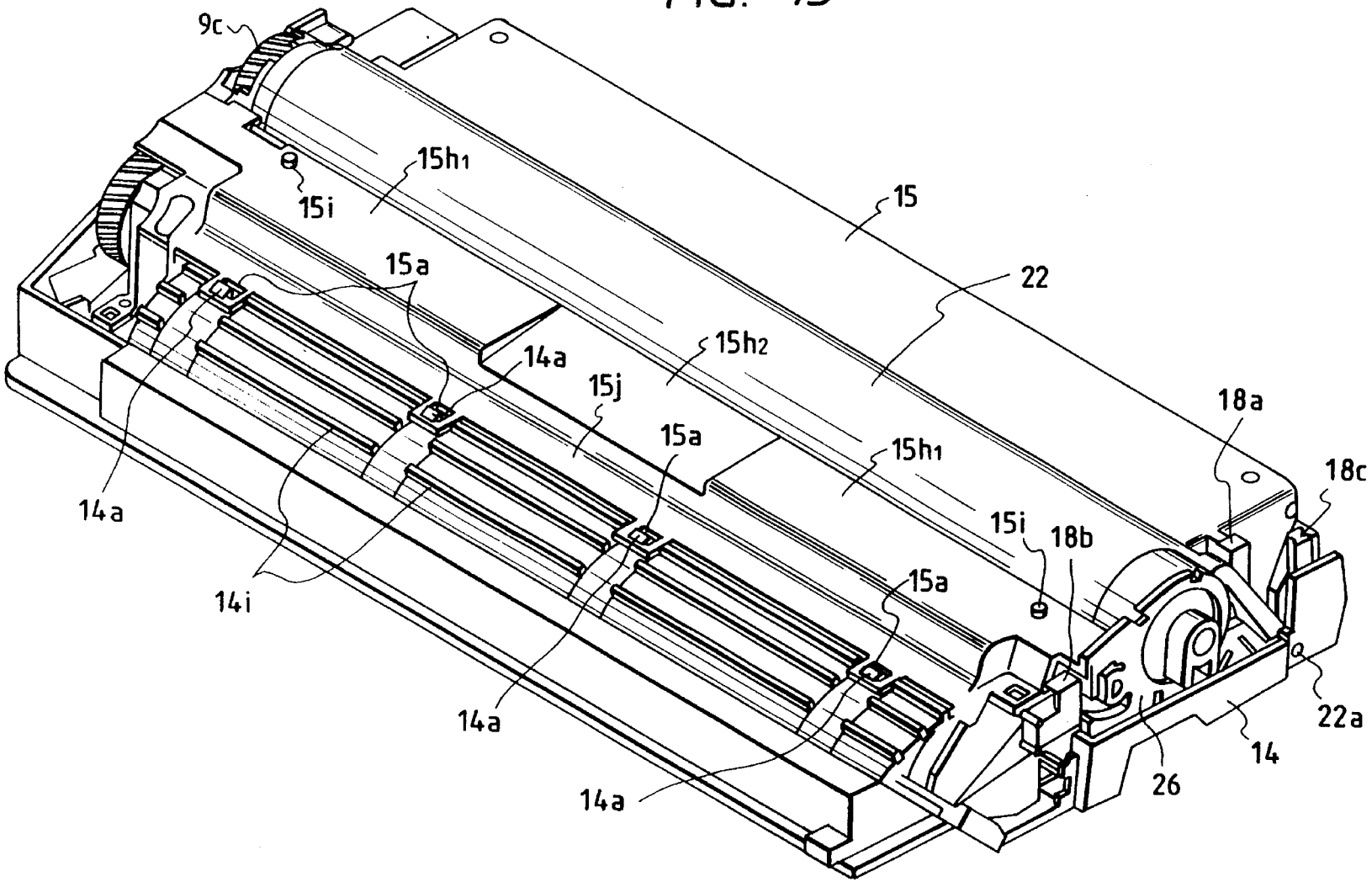
FIG. 15 is a perspective view of the process cartridge in an inverted condition.

The Whole Construction of a Process Cartridge and an image Forming System Mounting the Process Cartridge thereon:

First of all, the whole construction of the image forming system, or image forming apparatus will briefly be described. Incidentally, FIG. 10 is an elevational sectional view of a copying machine as an example of the image forming system or apparatus, within which the process cartridge is mounted, FIG. 11 is a perspective view of the copying machine with a tray opened, FIG. 12 is a perspective view of the copying machine with the tray closed, FIG. 13 is an elevational sectional view of the process cartridge, FIG. 14 is a perspective view of the process cartridge, and FIG. 15 is a perspective view of the process cartridge in an inverted condition.

Figure 10:
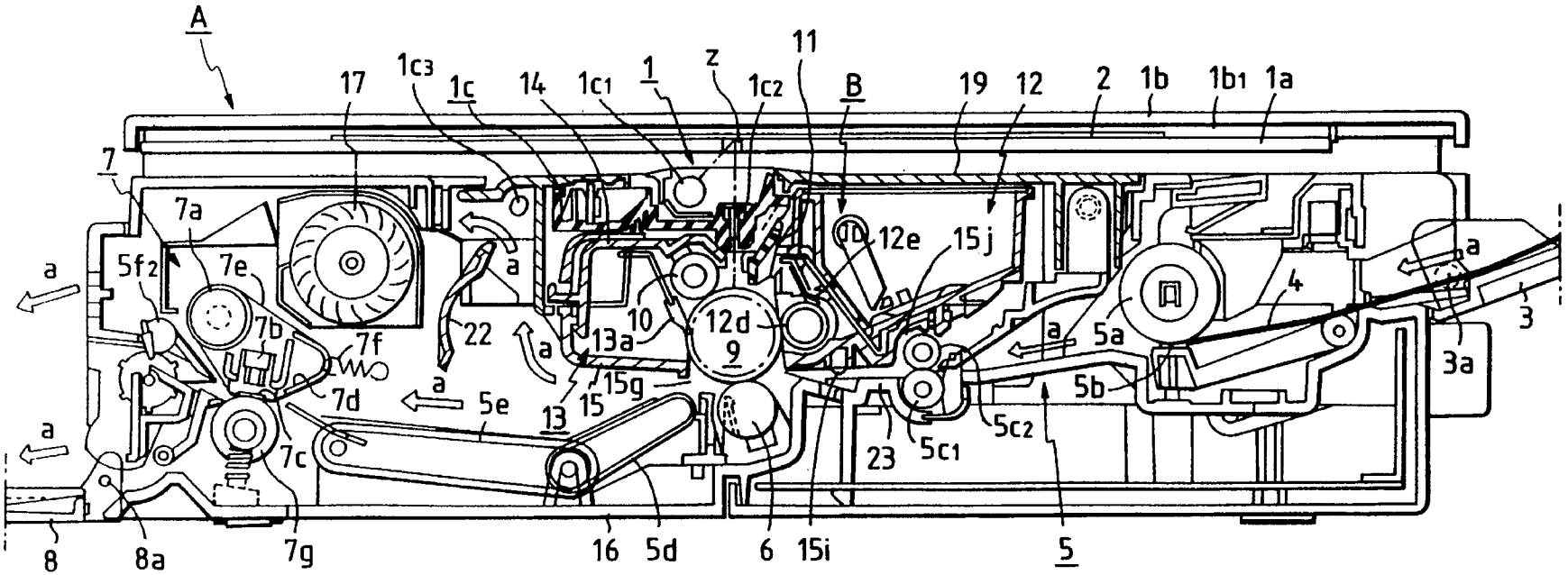
FIG. 10 is an elevational sectional view of a copying machine within which a process cartridge according to a preferred embodiment of the present invention is mounted.

As shown in FIG. 10, the image forming system A operates to optically read image information on an original or document 2 by an original reading means 1. A recording medium contained in a sheet supply tray 3 or manually inserted from the sheet supply tray 3 is fed, by a feeding means 5, to an image forming station of the process cartridge B, where a developer (referred to as "toner" hereinafter) image formed in response to the image information is transferred onto the recording medium 4 by a transfer means 6. Thereafter, the recording medium 4 is sent to a fixing means 7 where the transferred toner image is permanently fixed to the recording medium 4. Then, the recording medium is ejected onto an ejection tray 8.

The process cartridge B defining the image forming station operates to uniformly charge a surface of a rotating photosensitive drum (image bearing member) 9 by a charger means 10, then to form a latent image on the photosensitive drum 9 by illuminating a light image read by the reading means 1 on the photosensitive drum by means of an exposure means 11, and then to visualize the latent image as a toner image by a developing means 12. After the toner image is transferred onto the recording medium 4 by the transfer means 6, the residual toner remaining on the photosensitive drum 9 is removed by a cleaning means 13.

Incidentally, the process cartridge B is formed as a cartridge unit by housing the photosensitive drum 9 and the like within frames which include a first or upper frame 14 and a second or lower frame 15. Further, in the illustrated embodiment, the frames 14, 15 are made of high impact styrol resin (HIPS), and a thickness of the upper frame 14 is about 2 mm and a thickness of the lower frame 15 is about 2.5 mm. However, material and thickness of the frames are not limited to the above, but may be selected appropriately.

Next, various parts of the image forming system A and the process cartridge B mountable within the image forming system will be fully described.

Image Forming System.

First of all, various parts of the image forming system A will be explained.

(Original Reading Means )

The original reading means 1 serves to optically read the information written on the original, and, as shown in FIG. 10, includes an original glass support 1a which is disposed at an upper portion of a body 16 of the image forming system and on which the original 2 is to be rested. An original hold-down plate **1*b* having a sponge layer 1*b*1 on its inner surface is attached to the original glass support 1*a* for opening and closing movement. The original glass support 1*a* and the original hold-down plate 1*b* are mounted on the system body 16 for reciprocal sliding movement in the left and right directions in FIG. 10. On the other hand, a lens unit 1*c* is disposed below the original glass support 1*a* at the upper portion of the system body 16 and includes a light source 1*c*1 and a short focus focusing lens array 1*c*2** therein.

With this arrangement, when the original 2 is rested on the original glass support **1*a* with an image surface thereof faced downside and the light source 1*c*1 is activated and the original glass support 1*a* is slid in the left and right direction in FIG. 10, the photosensitive drum 9 of the process cartridge B is exposed by reflection light from the original 2 via the lens array 1*c*2**.

(Recording Medium Feeding Means)

The feeding means 5 serves to feed the recording medium 4 contained on the sheet supply tray 3 to the image forming station and to feed the recording medium to the fixing means 7. More particularly, after a plurality of recording media 4 are stacked on the sheet supply tray 3 or a single recording medium 4 is manually inserted on the sheet supply tray 3, and leading end(s) of the recording media or medium are abutted against a nip between a sheet supply roller **5*a* and a friction pad 5*b* urged against the roller, and when a copy start button A3 is depressed, the sheet supply roller 5*a* is rotated to separate and feed the recording medium 4 to a pair of registration rollers 5*c*1, 5*c*2 which, in turn, feed the recording medium is registration with the image forming operation. After the image forming operation, the recording medium 4 is fed to the fixing means 7 by a convey belt 5*d* and a guide member 5*e*, and then is ejected onto the ejection tray 8 by a pair of ejector rollers 5*f*1, 5*f*2**.

(Transfer Means )

The transfer means 6 serves to transfer the toner image formed on the photosensitive drum 9 onto the recording medium 4 and, in the illustrated embodiment, as shown in FIG. 10, it comprises a transfer roller 6. More particularly, by urging the recording medium 4 against the photosensitive drum 9 in the process cartridge B mounted within the image forming system by means of the transfer roller 6 provided in the image forming system and by applying to the transfer roller 6 a voltage having the polarity opposite to that of the toner image formed on the photosensitive drum 9, the toner image on the photosensitive drum 9 is transferred onto the recording medium 4.

(Fixing Means )

The fixing means 7 serves to fix the toner image transferred to the recording medium 4 by applying the voltage to the transfer roller 6. As shown in FIG. 10, the fixing means 7 comprises a heat-resistive fixing film 7e wound around and extending between a driving roller 7a, a heating body 7c held by a holder 7b and a tension plate 7d. Incidentally, the tension plate 7d is biased by a tension spring 7f to apply a tension force to the film 7e. A pressure roller 7g is urged against the heating body 7c with the interposition of the film 7e so that the fixing film 7e is pressurized against the heating body 7c with a predetermined force required by the fixing operation.

The heating body 7c is made of heat-resistive material such as alumina and has a heat generating surface comprised of a wire-shaped or plate-shaped member having a width of about 160 μm and a length (dimension perpendicular to a plane of FIG. 10) of about 216 mm and made of $Ta_2N$, for example. The heat generating surface is arranged on an under surface of the holder 7b, which is made of insulation material or composite material including insulation. A protection layer made of $Ta_2O$, for example, and covers the heat generating surface. The lower surface of the heating body 7c is flat, and front and rear ends of the heating body are rounded to permit the sliding movement of the fixing film 7e. The fixing film 7e is made of heat-treated polyester and has a thickness of about 9 μm. The film can be rotated in a clockwise direction by the rotation of the driving roller 7a, when the recording medium 4 to which the toner image was transferred passes through between the fixing film 7e and the pressure roller 7g, the toner image is fixed to the-recording medium 4 by heat and pressure.

Incidentally, in order to escape or discharge the heat generated by the fixing means 7 out of the image forming system, a cooling fan 17 is provided within the body 16 of the image forming system. The fan 17 is rotated, for example when the copy start button A3 (FIG. 11) is depressed, so as to generate air flows a (FIG. 10) flowing into the image forming system from the recording medium supply inlet and flowing out from the recording medium ejecting outlet. The various parts including the process cartridge B are cooled by the air flows so that the heat does not remain in the image forming system.

(Recording Medium Supply and Ejection Trays)

As shown in FIGS. 10 to 12, the sheet supply tray 3 and the ejection tray 8 are mounted on shafts 3a, 8a, respectively within the system body 16 for pivotal movements in directions b in FIG. 11, and for pivotal movements around shafts 3b, 8b in directions c in FIG. 11. Locking projections 3c, 8c are formed on free ends of the trays 3, 8 at both sides thereof, respectively. These projections can be fitted into locking recesses 1b2 formed in an upper surface of the original hold-down plate 1b. Thus, as shown in FIG. 12, when the trays 3, 8 are folded inwardly to fit the locking projections 3c, 8c into the corresponding recesses 1b2, the original glass support 1a and the original hold-down plate 1b are prevented from sliding in the left and right directions. As a result, an operator can easily lift the image forming system A via grippers 16a and transport it.

(Setting Buttons for Density and the like)

Incidentally, setting buttons for setting the density and the like are provided on the image forming system A. Briefly explaining, in FIG. 11, a power switch A1 is provided to turn the image forming system ON and OFF. A density adjusting dial A2 is used to adjust the fundamental density (of the copied image) of the image forming system. The copy start button A3, when depressed, starts the copying operation of the image forming system. A copy clear button A4, when depressed, interrupts the copying operation and clears the various setting conditions (for example, the set density condition). A copy number counter button A5 serves to set the number of copies when depressed. An automatic density setting button A6, when depressed, automatically sets the density in the copying operation. A density setting dial A7 is provided so that the operator can adjust the copy density by rotating this dial as needed.

Process Cartridge

Next, various parts of the process cartridge B which can be mounted within the image forming system A will be explained.

The process cartridge B includes an image bearing member and at least one process means. For example, the process means may comprise a charge means for charging a surface of the image bearing member, a developing means for forming a toner image on the image bearing member and/or a cleaning means for removing the residual toner remaining on the image bearing member. As shown in FIGS. 10 and 13, in the illustrated embodiment, the process cartridge B is formed as a cartridge unit which can be removably mounted within the body 16 of the image forming system. The process cartridge B is formed by enclosing the charger means 10, the developing means 12 containing the toner, and the cleaning means 13, all of which are arranged around the photosensitive drum 9 as the image bearing member, with a housing comprising the upper and lower frames 14, 15. The charger means 10, exposure means 11 (opening 11a) and toner reservoir 12a of the developing means 12 are disposed within the upper frame 14, and the photosensitive drum 9, developing sleeve 12d of the developing means 12 and cleaning means 13 are disposed within the lower frame 15.

Figure 16:
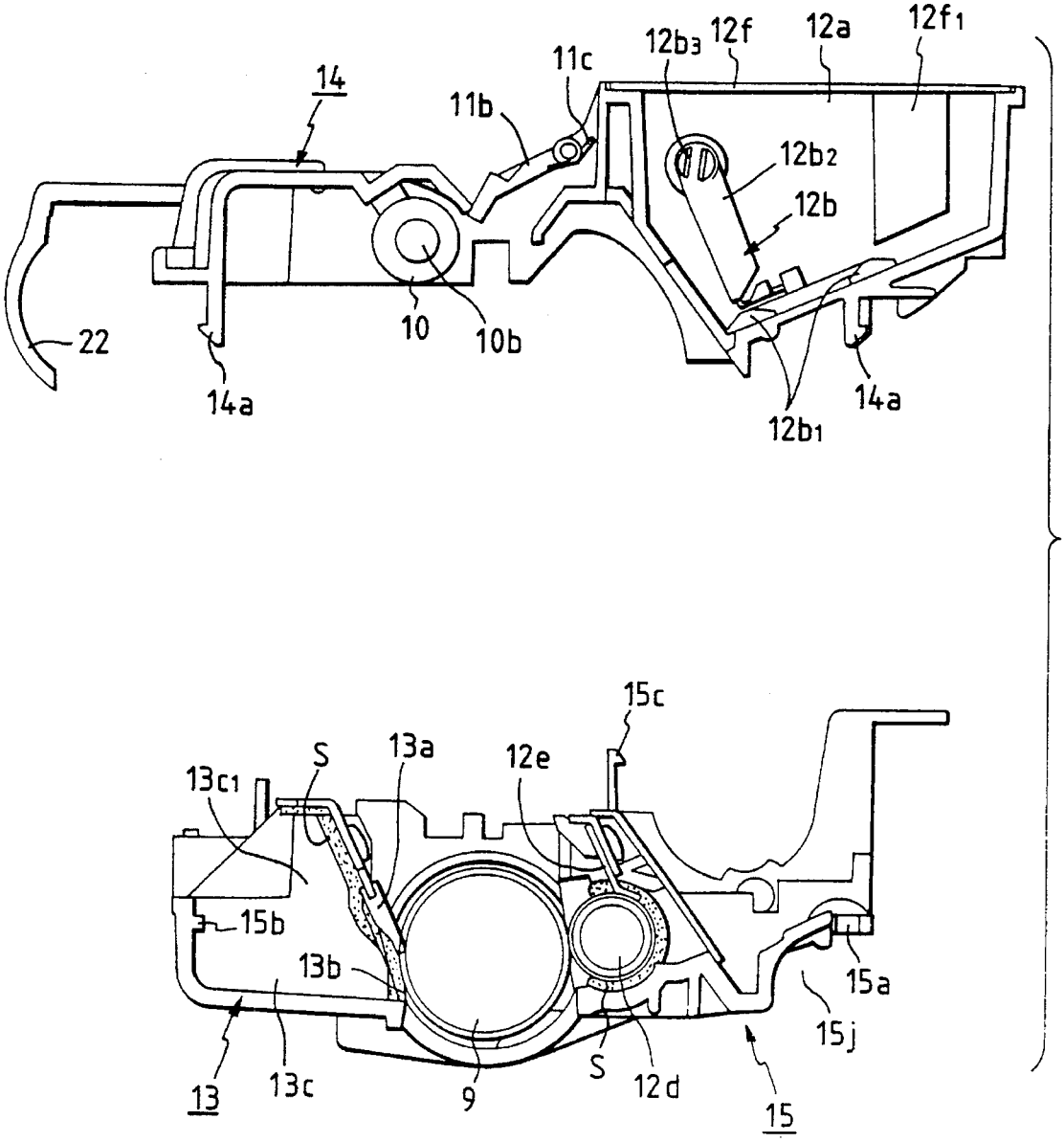
FIG. 16 is an exploded sectional view of the process cartridge in a condition that an upper frame and lower frame are separated.
Figure 17:
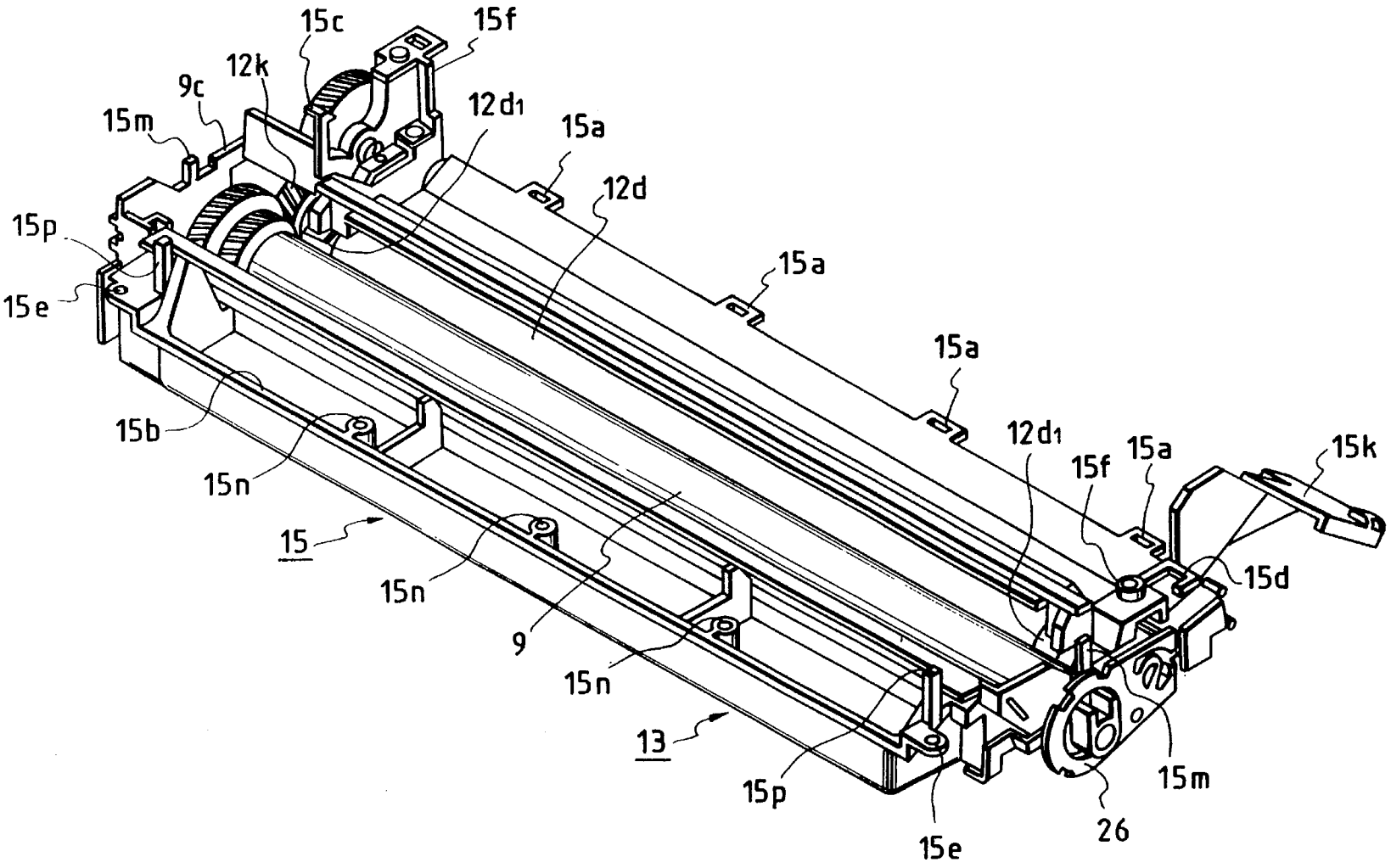
FIG. 17 is a perspective view of the lower frame showing an internal structure thereof.
Figure 18:
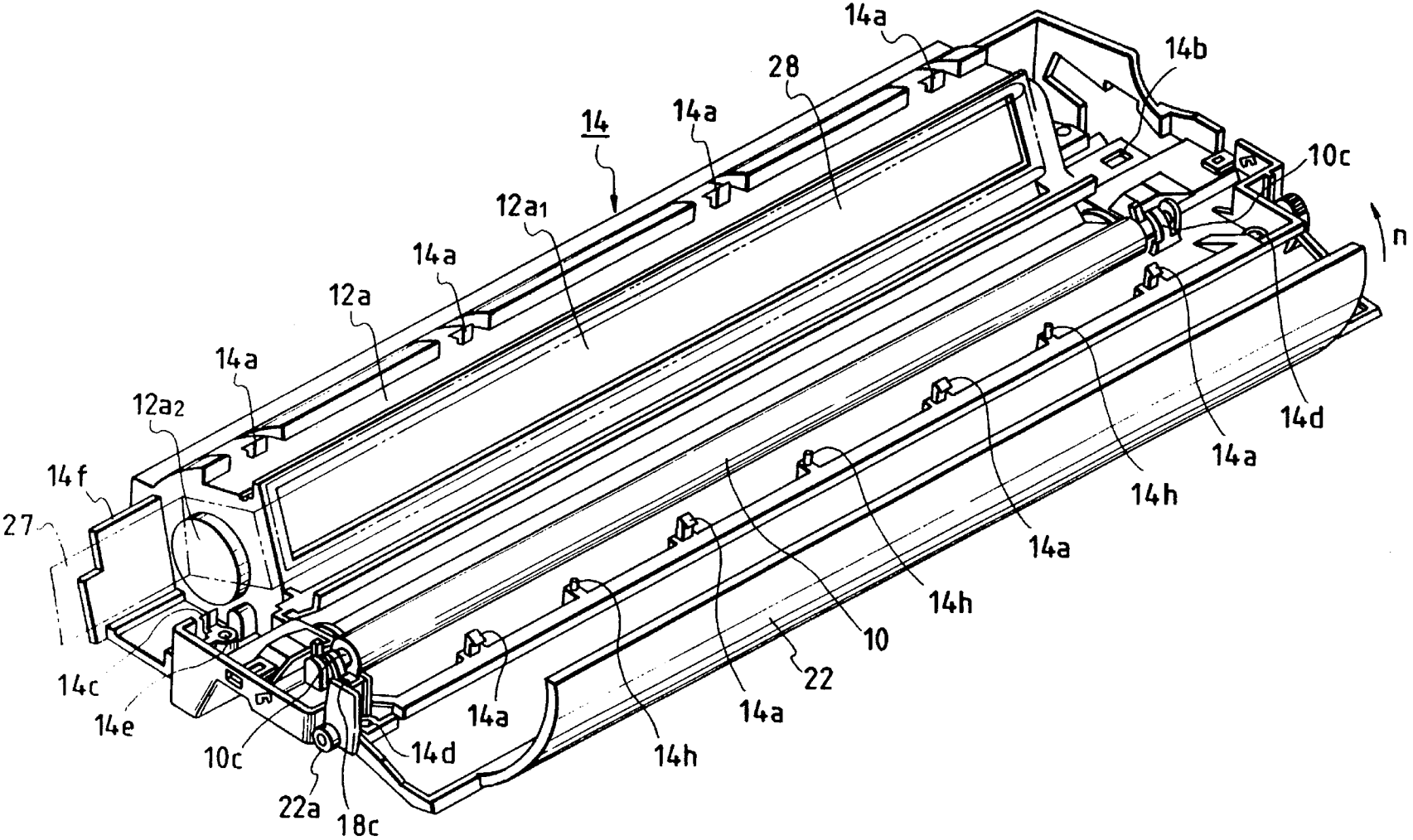
FIG. 18 is a perspective view of the upper frame showing internal structure thereof.

Now, the various parts of the process cartridge B will be fully described regarding the charger means 11, exposure means 11, developing means 12 and cleaning means 13 in order. Incidentally, FIG. 16 is a sectional view of the process cartridge with the upper and lower frames separated from each other, FIG. 17 is a perspective. view showing the internal construction of the lower frame, and FIG. 18 is a perspective view showing the internal construction of the upper frame.

(Photosensitive Drum)

In the illustrated embodiment, the photosensitive drum 9 comprises a cylindrical drum core 9a having a thickness of about 1 mm and made of aluminium, and an organic photosensitive layer 9b disposed on an outer peripheral surface of the drum core, so that an outer diameter of the photosensitive drum 9 becomes 24 mm. The photosensitive drum 9 is rotated in a direction shown by the arrow in response to the image forming operation, by transmitting a driving force of a drive motor 54 (FIG. 65) of the image forming system to a flange gear 9c (FIG. 17) secured to one end of the photosensitive drum 9.

During the image forming operation, when the photosensitive drum 9 is being rotated, the surface of the photosensitive drum 9 is uniformly charged by applying to the charger roller 10 (contacting with the drum 9) a vibrating voltage obtained by overlapping a DC voltage with an AC voltage. In this case, in order to uniformly charge the surface of the photosensitive drum 9, the frequency of the AC voltage applied to the charger roller 10 must be increased. However, if the frequency exceeds about 2000 Hz, the photosensitive drum 9 and the charger roller 10 will be vibrated, thus generating the so-called "charging noise".

That is to say, when the AC voltage is applied to the charger roller 10, an electrostatic attraction force is generated between the photosensitive drum 9 and the charger roller 10, so that the attraction force becomes maximum at the maximum and minimum values of the AC voltage, thus attracting the charger roller 10 against the photosensitive drum 9 while elastically deforming the charger roller. On the other hand, at an intermediate value of the AC voltage, the attraction force becomes minimum, with the result that the elastical deformation of the charger roller 10 is restored to tray to separate the charger roller 10 from the photosensitive drum 9. Consequently, the photosensitive drum 9 and the charger roller 10 are vibrated at the frequency as twice as that of the applied AC voltage. Further, when the charger roller 10 is attracted against the photosensitive drum 9, the rotations of the drum and the roller are braked, thus causing the vibration due to the stick slip, which also results in the charging noise.

Figure 19:
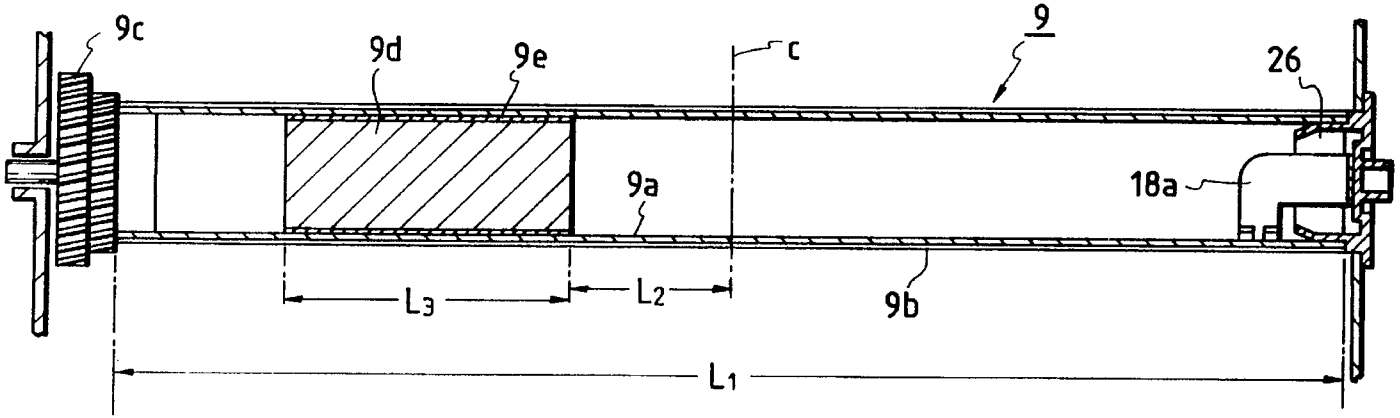
FIG. 19 is a longitudinal sectional view of a photosensitive drum of the process cartridge.

In order to reduce the vibration of the photosensitive drum 9, in the illustrated embodiment, as shown in FIG. 19 (sectional view of the drum), a rigid or elastic filler 9*d* is disposed within the photosensitive drum 9. The filler 9*d* may be made of metal such as aluminium, brass or the like, cement, ceramics such as gypsum, or rubber material such as natural rubber, taking into consideration the effect on productivity, workability, effect of weight and cost. The filler 9*d* has a solid cylindrical shape or a hollow cylindrical shape, and has an outer diameter smaller than an inner diameter of the photosensitive drum 9 by about 100 μm, and is inserted into the drum core 9*a*. That is to say, a gap between the drum core 9*a* and the filler 9*d* is set to have a value of 100 μm at the maximum, and an adhesive (for example, cyanoacrylate resin, epoxy resin or the like) 9*e* is applied on the outer surface of the filler 9*d* or on the inner surface of the drum core 9*a*, and the filler 9*d* is inserted into the drum core 9*a*, thus adhering them to each other.

Figure 20:
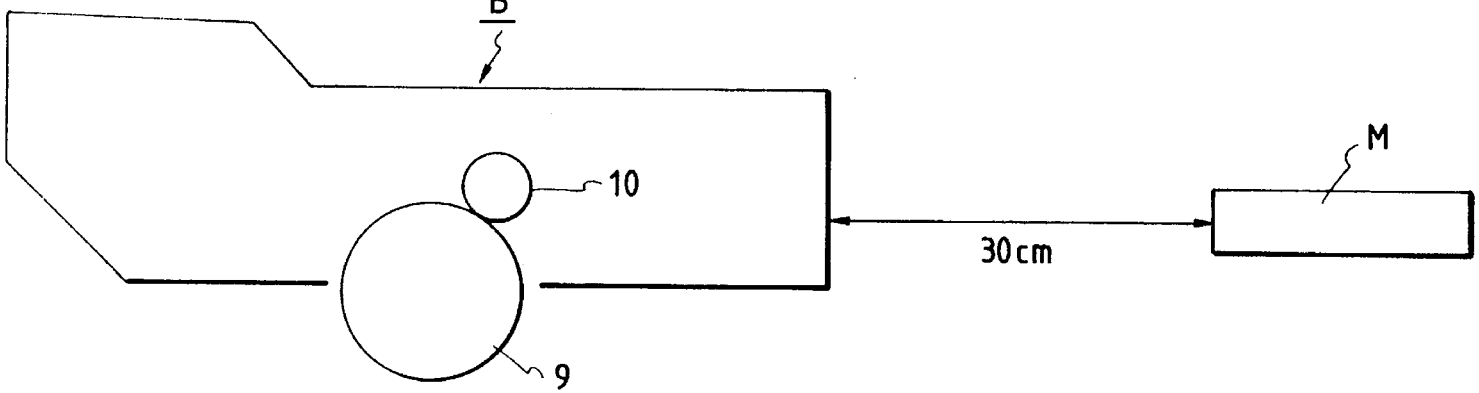
FIG. 20 is a schematic view for explaining the measurement of the charging noise.
Figure 21A:
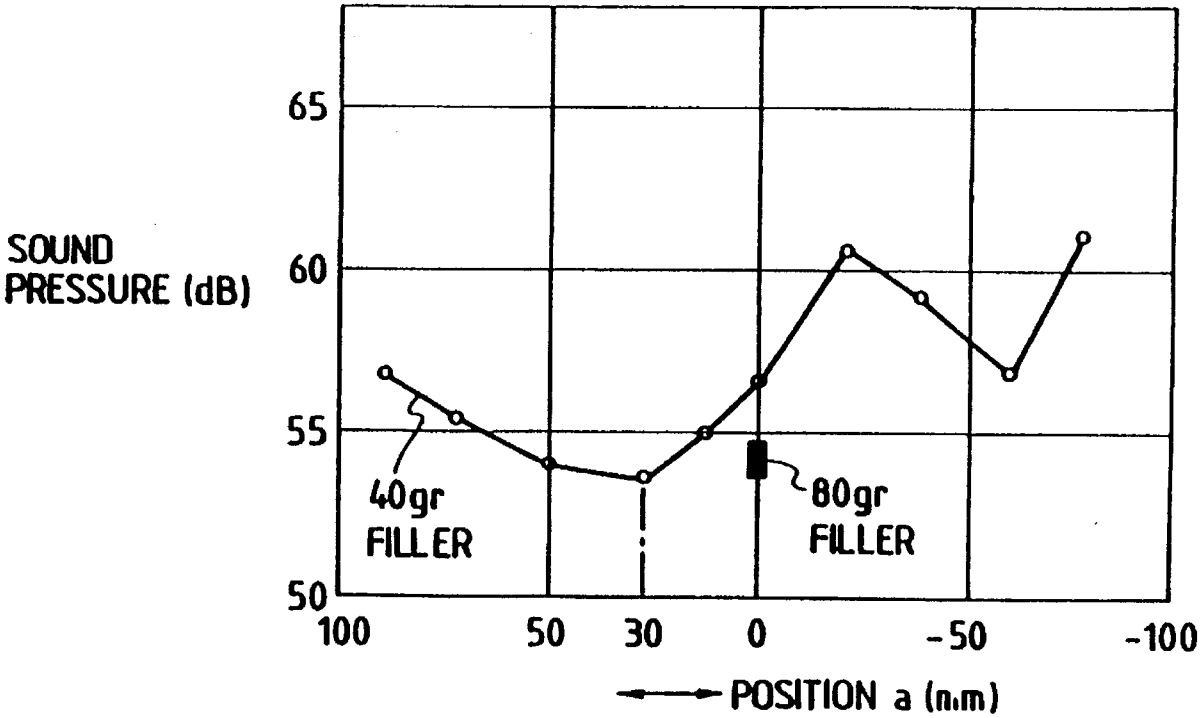
FIGS. 21A and 21B respectively, are a graph and a related illustration of the position of a filler in a photosensitive drum showing the result of the measurement of the charging noise in connection with the position of the filler a graph showing the result of the measurement of the charging noise regarding a position of a filler.
Figure 21B:
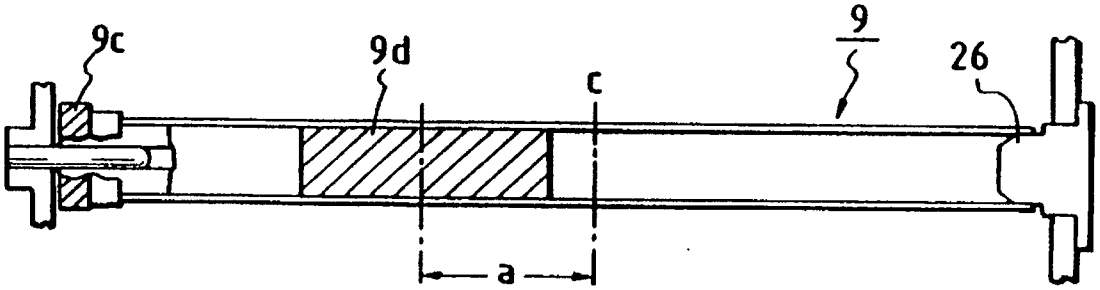

Now, the test results performed by the inventors, wherein the relation between the position of the filler 9*d* and the noise pressure (noise level) was checked by varying the position of the filler 9*d* in the photosensitive drum 9 will be explained. As shown in FIG. 20, the noise pressure was measured by a microphone M arranged at a distance of 30 cm from the front surface of the process cartridge B disposed in a room having the background noise of 43 dB. As result, as shown in FIGS. 21A and 21B, when the filler having a weight of 80 grams was arranged, at a central position in the longitudinal direction of the photosensitive drum 9, the noise pressure was 54.5–54.8 dB. Whereas, when the filler having a weight of 40 grams was arranged at a position offset from the central position toward the flange gear 9*c* by 30 mm, the noise pressure was minimum. From this result, it was found that it was more effective to arrange the filler 9*d* in the photosensitive drum 9 offset from the central position toward the gear flange 9*c*. The reason seems that one end of the photosensitive drum 9 is supported via the flange gear 9*c* while the other end of the drum 9 is supported by a bearing member 26 having no flange, so that the construction of the photosensitive drum 9 is not symmetrical with respect the central position in the longitudinal direction of the drum.

Thus, in the illustrated embodiment, as shown in FIG. 19, the filler 9*d* is arranged in the photosensitive drum 9 offset from the central position c (in the longitudinal direction of the drum) toward the flange gear 9*c*, i.e., toward the drive transmission mechanism to the photosensitive drum 9. Incidentally, in the illustrated embodiment, a filler 9*d* comprising a hollow aluminium member having a length L3 of 40 mm and a weight of about 20–60 grams, preferably 35–45 grams (most preferably about 40 grams) is positioned within the photosensitive drum 9 having a longitudinal length L1 of 257 mm at a position offset from the central position c toward the flange gear 9*c* by a distance L2 of 9 mm. By arranging the filler 9*d* within the photosensitive drum 9, the latter can be rotated stably, thus suppressing the vibration due to the rotation of the photosensitive drum 9 in the image forming operation. Therefore, even when the frequency of the AC voltage applied to the charger roller 10 is increased, it is possible to reduce the charging noise.

Further, in the illustrated embodiment, as shown in FIG. 19, an earthing, or grounding, contact 18*a* is contacted with the inner surface of the photosensitive drum 9 and the other end of the earthing contact is abutted against a drum earth contact pin 35*a*, thereby electrically earthing the photosensitive drum 9. The earthing contact 18*a* is arranged at the end of the photosensitive drum opposite to the end adjacent to the flange gear 9*c*.

Figure 22:
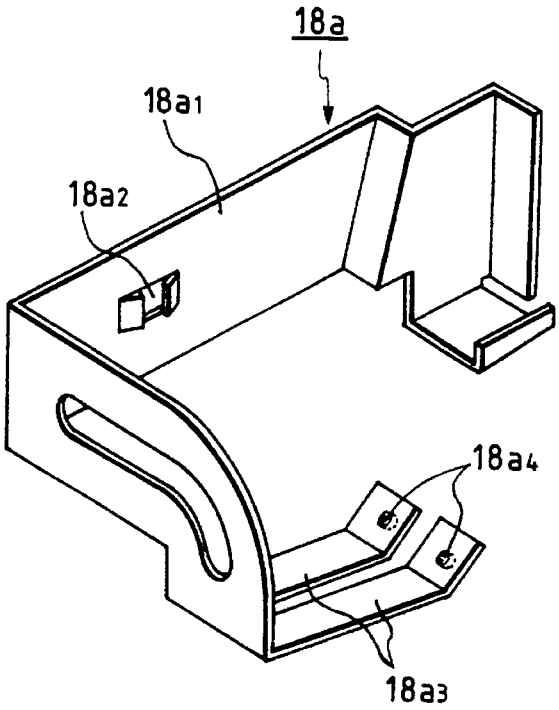
FIG. 22 is a perspective view of an earthing contact for the photosensitive drum.

The earthing contact 18*a* is made of spring stainless steel, spring bronze phosphate or the like and is attached to the bearing member 26. More particularly, as shown in FIG. 22, the earthing contact comprises a base portion 18*a*1 having a locking opening 18*a*2 into which a boss formed on the bearing member 26 can be fitted, and two arm portions 18*a*3 extending from the base portion 18*a*1, each arm portion being provided at its free end with a semi-circular projection 18*a*4 protruding downwardly. When the bearing member 26 is attached to the photosensitive drum 9, the projections 18*a*4 of the earthing contact 18*a* are urged against the inner surface of the photosensitive drum 9 by the elastic force of the arm portions 18*a*3. In this case, since the earthing contact 18*a* is contacted with the photosensitive drum at plural points (two points), the reliability of the contact is improved, and, since the earthing contact 18*a* is contacted with the photosensitive drum via the semi-circular projections 18*a*4, the contact between the earthing contact and the photosensitive drum 9 is stabilized.

Figure 23:
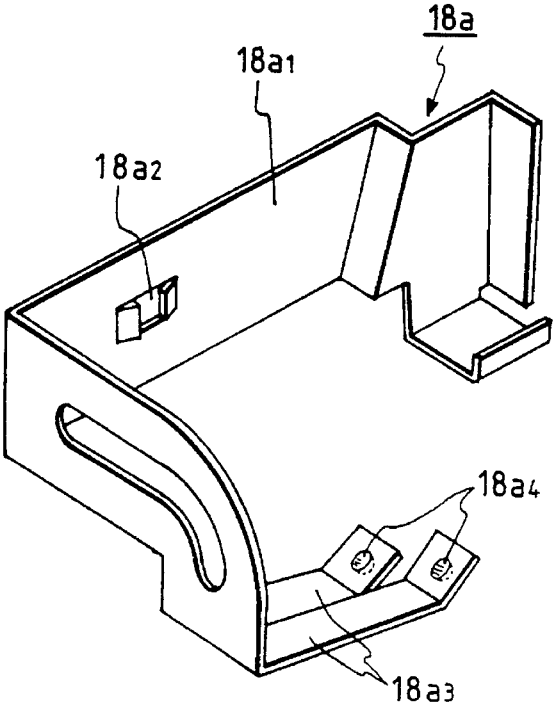
FIG. 23 is a perspective view of an earthing contact for the photosensitive drum, according to another embodiment.

Incidentally, as shown in FIG. 23, lengths of the arm portions 18*a*3 of the earthing contact 18*a* may be differentiated from each other. With this arrangement, since positions where the semi-circular projections 18*a*4 are contacted with the photosensitive drum 9 are offset from each other in the circumferential direction of the drum, even if there is a crack portion extending in the axial direction in the inner surface of the photosensitive drum 9, both projections 18*a*4 do not contact with such crack portion simultaneously, thereby maintaining the earthing contact (between the contact and the drum) without fail. Incidentally, when the lengths of the arm portions 18*a*3 are differentiated, the contacting pressure between one of the arm portions 18*a*3 and the photosensitive drum is differentiated from the contacting pressure between the other arm portion and the drum. However, such difference can be compensated, for example, by changing the bending angles of the arm portions 18*a*3.

Figure 24:
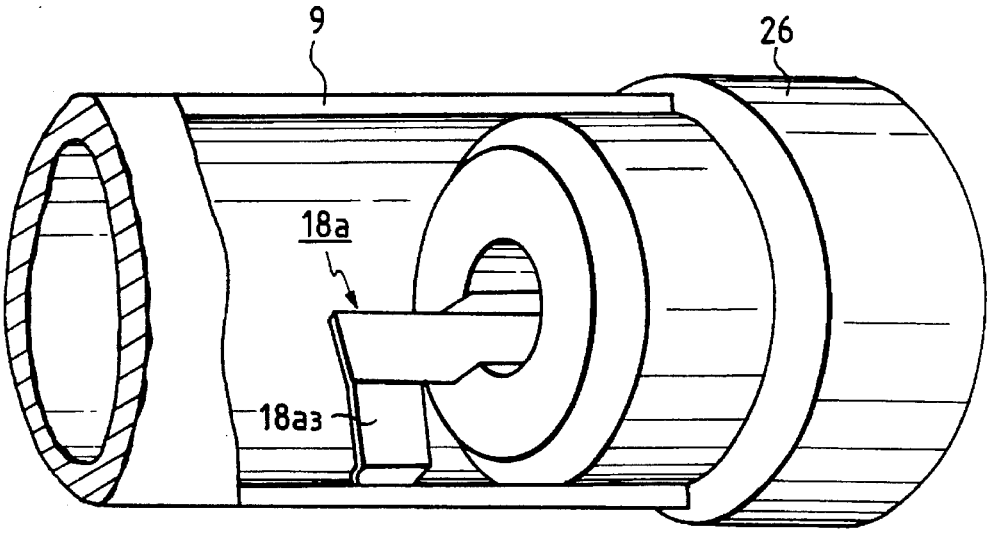
FIG. 24 is a perspective view showing an embodiment wherein an earthing contact which is not bifurcated is used with the photosensitive drum.
Figure 25:
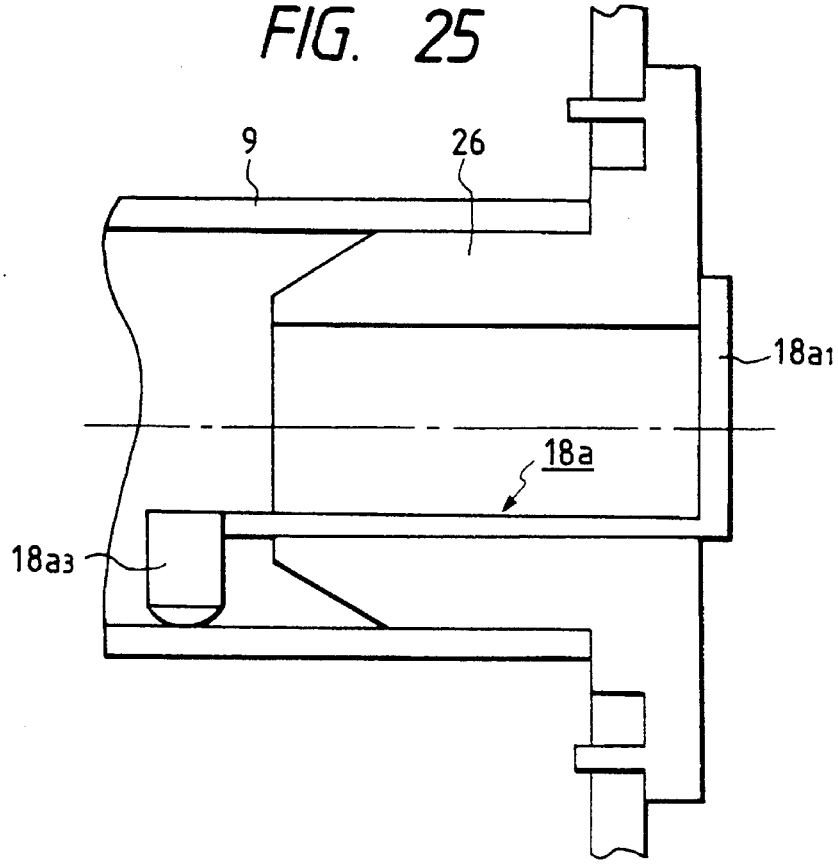
FIG. 25 is a sectional view of the non-bifurcated earthing contact used with the photosensitive drum.

In the illustrated embodiment, while the earthing contact 18*a* had two arm portions 18*a*3 as mentioned above, three or more arm portions may be provided, or, when the earthing contact is contacted with the inner surface of the photosensitive drum 9 without fail, a single arm portion 18*a*3 (not bifurcated) having no projection may be used, as shown in FIGS. 24 and 25.

Now, if the contacting pressure between the earthing contact 18*a* and the inner surface of the photosensitive drum 9 is too weak, the semi-circular projections 18*a*4 cannot follow the unevenness of the inner surface of the photosensitive drum, thus causing the poor contact between the earthing contact and the photosensitive drum and generating the noise due to the vibration of the arm portions 18*a*3. In order to prevent such poor contact and noise, the contacting pressure must be increased. However, if the contacting pressure is too strong, when the image forming system is used for a long time, the inner surface of the photosensitive drum will be damaged by the high pressure of the semicircular projections 18a4. Consequently, when the semicircular projections 18a4 pass through such damaged portion, the vibration occurs, thus causing the poor contact and the vibration noise. In consideration of the above circumstances, it is preferable that the contacting pressure between the earthing contact 18a and the inner surface of the photosensitive drum is set in a range between about 10 grams and about 200 grams. That is to say, according to the test result effected by the inventors, when the contacting pressure was smaller than about 10 grams, it was feared that tile poor contact was likely to occur in response to the rotation of the photosensitive drum, thus causing the radio wave jamming regarding other electronic equipment. On the other hand, when the contacting pressure was greater than about 200 grams, it was feared that the inner surface of the photosensitive drum 9 was damaged due to the sliding contact between the drum inner surface and the earthing contact 18a for a long time, thus causing the abnormal noise and/or poor contact.

Incidentally, although the generation of the above noise and the like sometimes cannot be eliminated completely because of the inner surface condition of the photosensitive drum, it is possible to reduce the vibration of the photosensitive drum 9 by arranging the filler 9d within the drum 9, and it is also possible to prevent the damage of the drum and the poor contact more effectively by disposing the conductive grease on the contacting area between the earthing contact 18a and the inner surface of the photosensitive drum 9. Further, since the earthing contact 18a positioned on the bearing member 26 situated remotely from the filler 9d offset toward the flange gear 9c, the earthing contact can easily be attached to the bearing member.

(Charger Means)

The charger means serves to charge the surface of the photosensitive drum 9. In the illustrated embodiment, the charger means is of so-called contact charging type as disclosed in the Japanese Patent Laid-open Appln. No. 63-149669. More specifically, as shown in FIG. 13, the charger roller 10 is rotatably mounted on the inner surface of the upper frame 14 via a slide bearing 10c. The charger roller 10 comprises a metallic roller shaft 10b (for example, a conductive metal core made of iron, SUS or the like), an elastic rubber layer made of EPDM, NBR or the like and arranged around the roller shaft, and an urethane rubber layer dispersing carbon therein and arranged around the elastic rubber layer, or comprises a metallic roller shaft and a foam urethane rubber layer dispersing carbon therein. The roller shaft 10b of the charger roller 10 is held by bearing slide guide pawls 10d of the upper frame 14 via the slide bearing 10c so that it cannot be detached from the upper frame and it can slightly be moved toward the photosensitive drum 9. The roller shaft 10b is biased by a spring 10a so that the charger roller 10 is urged against the surface of the photosensitive drum 9. Thus, the charger means is formed by the charger roller 10 incorporated into the upper frame 14 via the bearing 10c. In the image forming operation, when the charger roller 10 is driven by the rotation of the photosensitive drum 9, the surface of the photosensitive drum 9 is uniformly charged by applying the overlapped DC and AC voltage to the charger roller 10 as mentioned above.

Now, the voltage applied to the charger roller 10 will be described. Although the voltage applied to the charger roller 10 may be the DC voltage alone, in order to achieve the uniform charging, the vibration voltage obtained by overlapping the DC voltage and the AC voltage as mentioned above should be applied to the charger roller. Preferably, the vibration voltage, obtained by overlapping the DC voltage having the peak-to-peak voltage value greater, by twice or more, than the charging start voltage when the DC voltage alone is used, and the AC voltage is applied to-the charger roller 10 to improve the uniform charging (refer to the Japanese Patent Laid-open Appln. No. 63-149669). The "vibration voltage" described herein means a voltage wherein the voltage value is periodically changed as a function of time and that preferably has the peak-to-peak voltage greater, by twice or more, than the charging start voltage when the surface of the photosensitive drum is charged only by the DC voltage. Further, the wave form of the vibration voltage is not limited to the sinusoidal wave, but may be rectangular wave, triangular wave or pulse wave. However, the sinusoidal wave not including the higher harmonic component, is preferable in view of the reduction of the charging noise. The DC voltage may include a voltage having the rectangular wave obtained by periodically turning ON/OFF a DC voltage source, for example.

Figure 26:
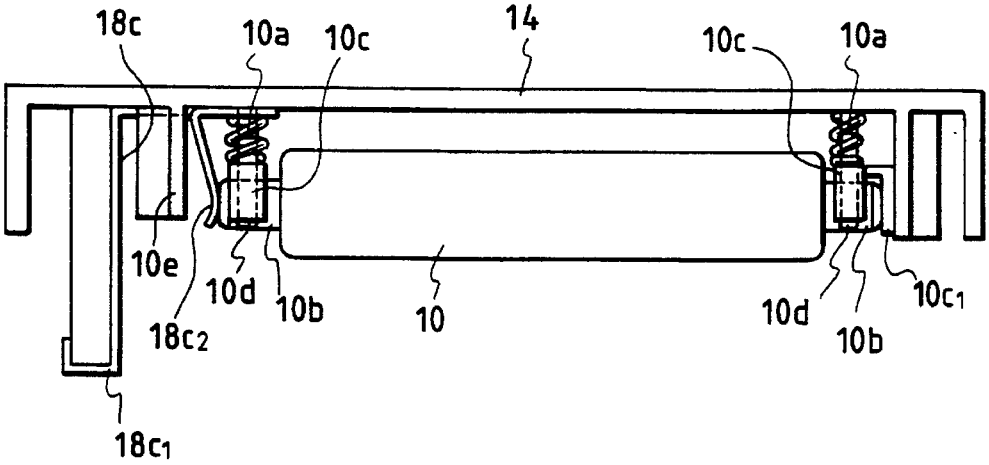
FIG. 26 is an elevational view showing an attachment structure for a charger roller.

As shown in FIG. 26, the application of the voltage to the charger roller 10 is accomplished by urging one end 18c1 of a charging bias contact 18c against a charging bias contact pin of the image forming system as will be described later, and the other end 18c2 of the charging bias contact 18c is urged against the metallic roller shaft 10b, thereby applying the voltage to the charger roller 10. Incidentally, since the charger roller 10 is biased by the elastic contact 18c toward the right in FIG. 26, the charger roller bearing 10c remotely disposed from the contact 18c has a hooked stopper portion 10c1. Further, a stopper portion 10e depending from the upper frame 14 is arranged near the contact 18c in order to prevent the excessive axial movement of the charger 1 roller 10 when the process cartridge B is dropped or vibrated.

In the illustrated embodiment, with the arrangement as mentioned above, the voltage of 1.6–2.4 KVVpp, −600 $VV_{DC}$ (sinusoidal wave) is applied to the charger roller 10.

When the charger roller 10 is incorporated into the upper frame 14, first of all, the bearing 10c is supported by the guide pawls 10d of the upper frame 14 and then the roller shaft 10b of the charger roller 10 is fitted into the bearing 10c. And, when the upper frame 14 is assembled with the lower frame 15, the charger roller 10 is urged against the photosensitive drum 9, as shown in FIG. 13.

Incidentally, the bearing 10c for the charger roller 10 is made of conductive bearing material including a great amount of carbon filler, and the. voltage is applied to the charger roller 10 from the charging bias contact 18c via the metallic spring 10a so that the stable charging bias can be supplied.

(Exposure Means )

The exposure means 11 serves to expose the surface of the photosensitive drum 9, which has been uniformly charged by the charger roller 10 with a light image from the reading means 1. As shown in FIGS. 10 and 13, the upper frame 14 is provided with an opening 11a through which the light from the lens array 1c2 of the image forming system is illuminated onto the photosensitive drum 9. Incidentally, when the process cartridge B is removed from the image forming system A, if the photosensitive drum 9 is exposed by the ambient light through the opening 11a, it is feared that the photosensitive drum will be deteriorated. To avoid this, a shutter member 11b is attached to the opening 11a so that when the process cartridge B is removed from the image forming system A the opening 11a is closed by the shutter member 11b and when the process cartridge is mounted within the image forming system the shutter member opens the opening 11a.

Figure 27A:
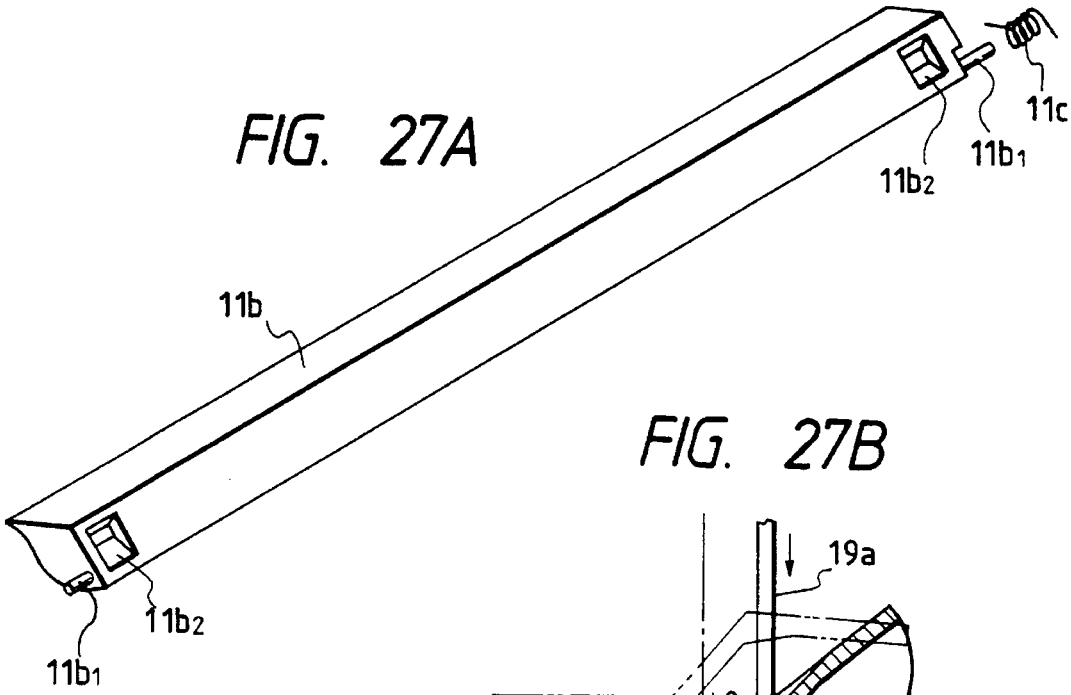
FIG. 27A is a perspective view of an exposure shutter.
Figure 27B:
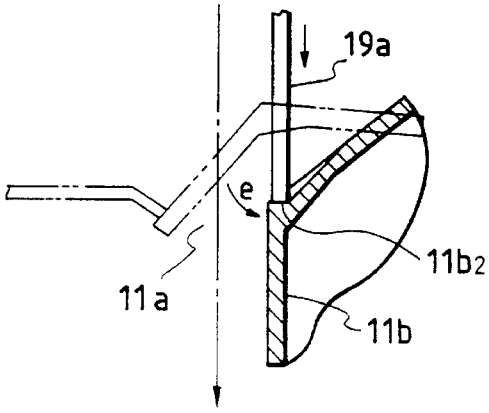
FIG. 27B is a partial sectional view of the exposure shutter.

As shown in FIGS. 27A and 27B the shutter member 11*b* has an L-shaped cross-section having a convex portion directing toward the outside of the cartridge, and is pivotally mounted on the upper frame 14 via pins 11*b*1. A torsion coil spring 11*c* is mounted around one of the pins 11*b*1 so that the shutter member 11*b* is biased by the coil spring 11*c* to close the opening 11*a* when the process cartridge B is dismounted from the image forming system A.

As shown in FIG. 27A, abutment portions 11*b*2 are formed on the outer surface of the shutter member 11*b* so that, when the process cartridge B is mounted within the image forming system A and an upper opening/closing cover 19 (FIG. 10) openable with respect to the body 16 of the image forming system is closed, a projection 19*a* formed on the cover 19 is abutted against the abutment portions 11*b*2, thereby rotating the shutter member 11*b* in a direction shown by the arrow e (FIG. 27B) to open the opening 11*a*.

In the opening and closing operation of the shutter member 11*b*, since the shutter member 11*b* has the L-shaped cross-section and the abutment portions 11*b*2 are disposed outwardly of the contour of the cartridge B and near the pivot pins 11*b*1, as shown in FIGS. 13 and 27B, the shutter member 11*b* is abutted against the projection 19*a* of the cover 19 outwardly of the contour of the process cartridge B. As a result, even when the opening and closing angle of the shutter member 11*b* is small, a leading end of the rotating shutter member 11*b* is surely opened, thereby surely illuminating the light from the lens array 1*c*2 disposed above the shutter member onto the photosensitive drum to form the good electrostatic latent image on the surface of the photosensitive drum 9. By constituting the shutter member 11*b* as mentioned above, when the process cartridge B is inserted into the image forming system, it is not necessary to retard the cartridge B from the shutter opening projection 19*a* of the cover 19 of the image forming system, with the result that it is possible to shorten the stroke of the projection, thereby making the process cartridge B and the image forming system A small-sized.

(Developing Means)

Next, the developing means 12 will be explained. The developing means 12 serves to visualize the electrostatic latent image formed on the photosensitive drum 9 by the exposure means with toner as a toner image. Incidentally, in this image forming system A, although magnetic toner or non-magnetic toner can be used, in the illustrated embodiment, the developing means in the process cartridge B includes the magnetic toner as one-component magnetic developer.

Binder resin of the one-component magnetic toner used in the developing operation may be the following: or a mixture of the following polymer of styrene and substitute thereof such as polystyrene and polyvinyltoluene; styrene copolymer such as styrene-propylene copolymer, styrene-vinyltoluene copolymer, styrene-vinylnaphthalene copolymer, styrene-acrylic acid ethyl copolymer or styrene-acrylic acid butyl copolymer; polymetylmethacrylate, polybuthymethacrylate, polyvinylacetate, polyethylene, polypropylene, polyvinylbutyral, polycrylic acid resin, rosin, modified rosin, turpentine resin, phenolic resin, aliphatic hydrocarbon resin, alicyclic hydrocarbon resin, aromatic petroleium resin, paraffin wax, carnauba wax or the like.

As for the coloring material added to the magnetic toner it may be known carbon black, copper phthalocyanine, iron black or the like. The magnetic fine particles contained in the magnetic toner may be of a material magnetizable when placed in a magnetic field, such as ferromagnetic powder of metal such as iron, cobalt, and nickel, powder of metal alloy or powder of compound such as magnetite or ferrite.

As shown in FIG. 13, the developing means 12 for forming the toner image with the magnetic toner has a toner reservoir 12*a* for containing the toner, and a toner feed mechanism 12*b* disposed within the toner reservoir 12*a* and adapted to feed out the toner. Further, the developing means is so designed that the developing sleeve 12*d* having a magnet 12*c* therein is rotated to form a thin toner layer on a surface of the developing sleeve. When the toner layer is being formed on the developing sleeve 12*d*, the developable frictional charging charges are applied to the electrostatic latent image on the photosensitive drum 9 by the friction between the toner and the developing sleeve 12*d*. Further, in order to regulate the thickness of the toner layer, a developing blade 12*e* is urged against the surface of the developing sleeve 12*d*. The developing sleeve 12*d* is disposed in a confronting relation to the surface of the photosensitive drum 9 with a gap of about 100–400 μm therebetween.

As shown in FIG. 13, the magnetic toner feed mechanism 12*b* has feed members 12*b*1 made of polypropylene (PP), acrylobutadienestyrol (ABS), high-impact styrol (HIPS) or the like and reciprocally shiftable in a direction shown by the arrows f along a bottom surface of the toner reservoir 12*a*. Each feed member 12*b*1 has a substantial triangular cross-section and is provided with a plurality of long rod members extending along the rotation axis of the photosensitive drum (direction perpendicular to the plane of FIG. 13) for scraping the whole bottom surface of the toner reservoir 12*a*. The rod members are interconnected at both of their ends to form an integral structure. Further, there are three feed members 12*b*1, and the shifting range of the feed members are selected to be greater than a bottom width of the triangular cross-section so that all of the toner on the bottom surface of the toner reservoir can be scraped. In addition, an arm member 12*b*2 is provided at its free end with a projection 12*b*6, thereby preventing the feed members 12*b*1 from floating and being disordered.

The feed member 12*b*1 has a lock projection 12*b*4 at its one longitudinal end, which projection is rotatably fitted into a slot 12*b*5 formed in the arm member 12*b*2. The arm member 12*b*2 is rotatably mounted on the upper frame 14 via a shaft 12*b*3 and is connected to an arm (not shown) disposed outside the toner reservoir 12*a*. Further, a drive transmitting means is connected to the feed members 12*b*1 so that, when the process cartridge B is mounted within the image forming system A, the driving force from the image forming system is transmitted to the feed members to swing the arm member 12*b*2 around the shaft 12*b*3 by a predetermined angle. Incidentally, as shown in FIG. 7 and the like, the feed members 12*b*1 and the arm member 12*b*2 may be integrally formed from resin such as polypropylene, polyamide or the like so that they can be folded at a connecting portion therebetween.

Accordingly, in the image forming operation, when the arm member 12*b*2 is rocked by the predetermined angle, the feed members 12*b*1 are reciprocally shifted along the bottom surface of the toner reservoir 12*a* in direction f between a condition shown by the solid lines and a condition shown by the broken lines. Consequently, the toner situated near the bottom surface of the toner reservoir 12*a* is fed toward the developing sleeve 12*d* by the feed members 12*b*1. In this case, since each feed member 12*b*1 has the triangular cross-section, the toner is scraped by the feed members and is gently fed along inclined surfaces of the feed members 12*b*1. Thus, the toner near the developing sleeve 12*d* is difficult to be agitated, and, therefore, deterioration of the toner layer formed on the surface of the developing sleeve 12*d* is minimized.

Further, as shown in FIG. 13, a lid member 12*f* of the toner reservoir 12*a* is provided with a depending member 12*f*1. A distance between a lower end of the depending member 12*f*1 and the bottom surface of the toner reservoir is selected so as to be slightly greater than a height of the triangular cross-section of each toner feed member 12*b*1. Accordingly, the toner feed member 12*b*1 is reciprocally shifted between the bottom surface of the toner reservoir and the depending member 12*f*1, with the result that, if the feed member 12*b*1 tries to float from the bottom surface of the toner reservoir, such floating is limited or regulated, thus preventing the floating of the feed members 12*b*1.

Incidentally, the image forming system A according to the illustrated embodiment can also receive a process cartridge including the non-magnetic toner. In this case, the toner feed mechanism is driven to agitate the non-magnetic toner near the developing sleeve 12*d*.

Figure 28:
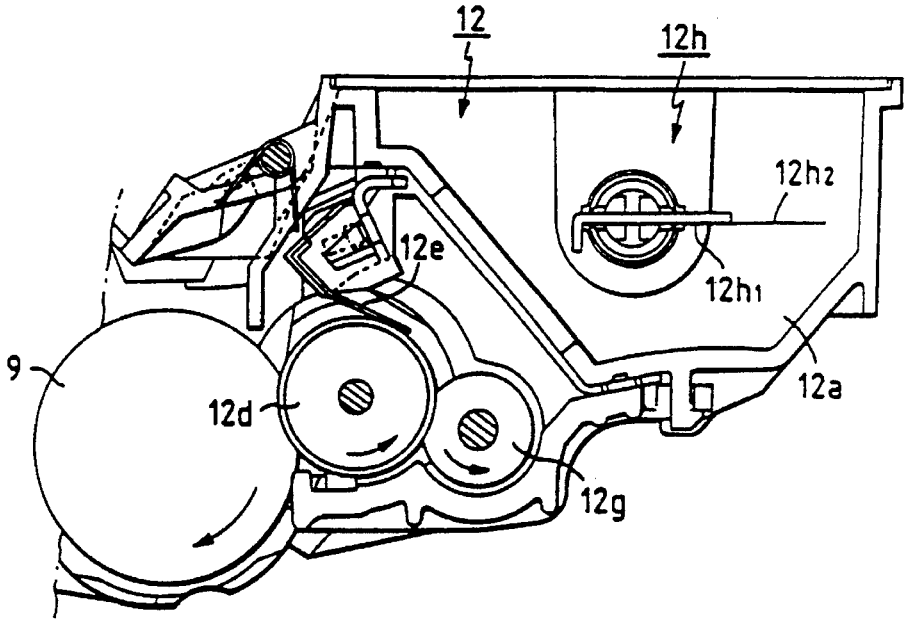
FIG. 28 is a sectional view showing a non-magnetic toner feeding mechanism having an agitating vane.

That is to say, when the non-magnetic toner is used, as shown in FIG. 28, an elastic roller 12*g* rotated in a direction same as that of the developing sleeve 12*d* feeds the non-magnetic toner fed from the toner reservoir 12*a* by the toner feed mechanism 12*h* toward the developing sleeve 12*d*. In this case, at a nip between the developing sleeve 12*d* and the elastic roller 12*g*, the toner on the elastic roller 12*g* is frictionally charged by the sliding contact between the toner and the developing sleeve 12*d* to be adhered onto the developing sleeve 12*d* electrostatically. Thereafter, during the rotation of the developing sleeve 12*d*, the non-magnetic toner adhered to the developing sleeve 12*d* enters into an abutment area between the developing blade 12*e* and the developing sleeve 12*d* to form the thin toner layer on the developing sleeve, and the toner is frictionally charged by the sliding contact between the toner and the developing sleeve with polarity sufficient to develop the electrostatic latent image. However, when the toner remains on the developing sleeve 12*d*, the remaining toner is mixed with the new toner fed to the developing sleeve 12*d* and is fed to the abutment area between the developing sleeve and the developing blade 12*e*. The remaining toner and the new toner are frictionally charged by the sliding contact between the toner and the developing sleeve 12*d*. In this case, however, although the new toner is charged with the proper charge, since the remaining toner is further charged from the condition that it has already been charged with the proper charge, it is over-charged. The over-charged or excessively charged toner has an adhesion force (to the developing sleeve 12*d*) stronger than that of the properly charged toner, thus becoming harder to use in the developing operation.

To avoid this, in the illustrated embodiment, regarding the process cartridge containing the non-magnetic toner, as shown in FIG. 28, the non-magnetic toner feed mechanism 12*h* comprises a rotary member 12*h*1 disposed in the toner reservoir 12*a*, which rotary member 12*h*1 has an elastic agitating vane 12*h*2. When the non-magnetic toner cartridge is mounted within the image forming system A, the drive transmitting means is connected to the rotary member 12*h*1 so that the latter is rotated by the image forming system in the image forming operation. In this way, when the image is formed by using the cartridge containing the non-magnetic toner and mounted within the image forming system, the toner in the toner reservoir 12*a* is greatly agitated by the agitating vane 12*h*2. As a result, the toner near the developing sleeve 12*d* is also agitated to be mixed with the toner in the toner reservoir 12*a*, thereby dispersing the charged toner removed from the developing sleeve 12*d* in the toner within the toner reservoir to prevent the deterioration of the toner.

By the way, the developing sleeve 12*d* on which the toner layer is formed is arranged in a confronting relation to the photosensitive drum 9 with a small gap therebetween (about 300 μm regarding the process cartridge containing the magnetic toner, or about 200 μm regarding the process cartridge containing the non-magnetic toner). Accordingly, in the illustrated embodiment, abutment rings each having an outer diameter greater than that of the developing sleeve by an amount corresponding to the small gap are arranged in the vicinity of both axial ends of the developing sleeve 12*d* and outside the toner layer forming area so that these rings are abutted against the photosensitive drum 9 at zones outside the latent image forming area.

Figure 29:
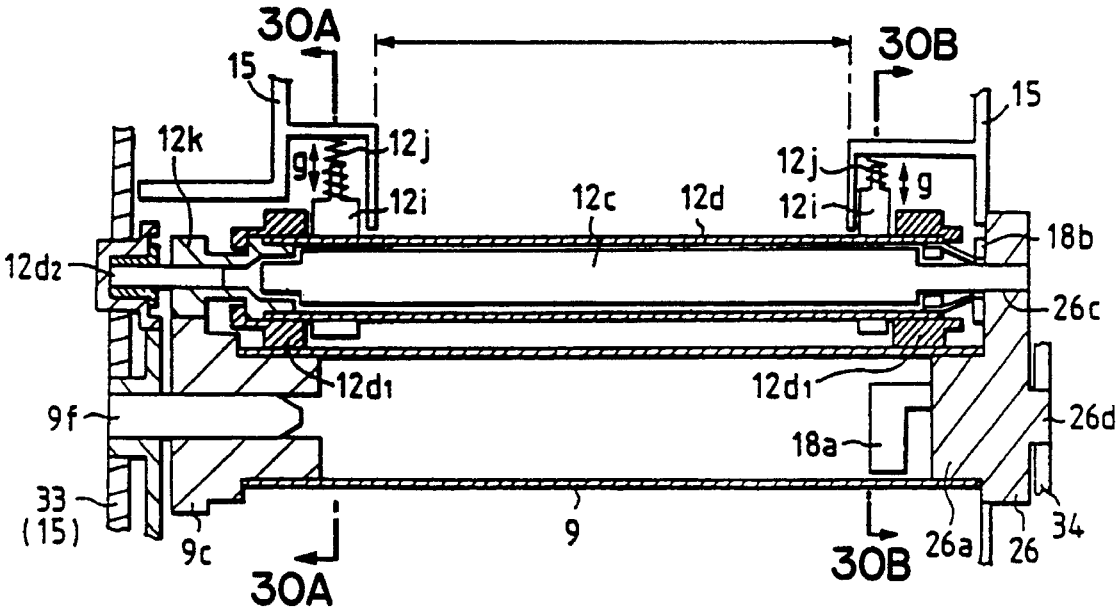
FIG. 29 is a longitudinal sectional view showing a positional relation between the photosensitive drum (9) and a developing sleeve (12*d*) and a structure for pressurizing the developing sleeve.
Figure 30A:
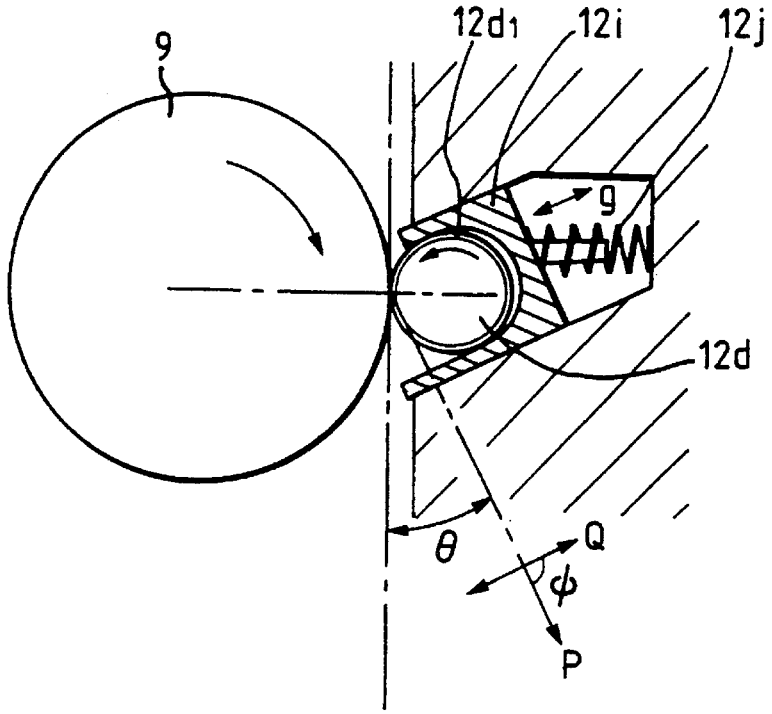
FIG. 30A is a sectional view taken along the line 30A—30A of FIG. 29.
Figure 30B:
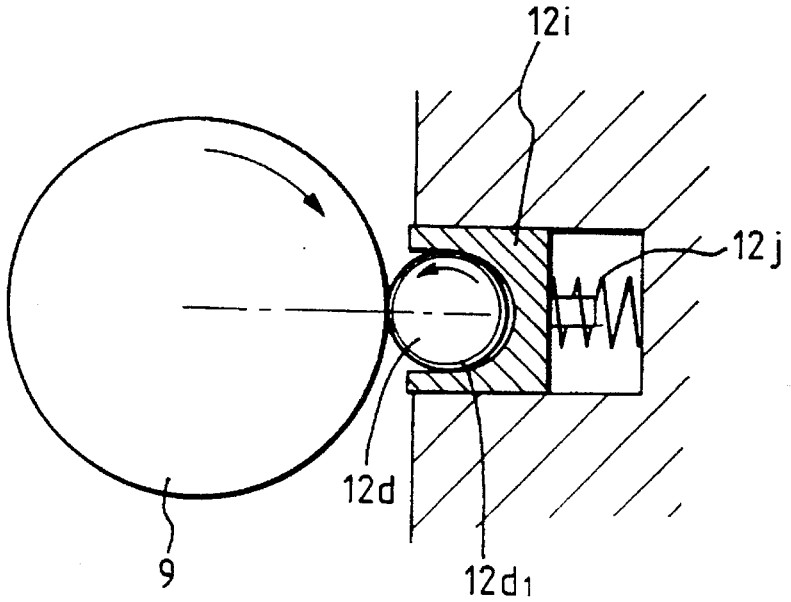
FIG. 30B is a sectional view taken along the line 30B—30B of FIG. 29.

Now, the positional relation between the photosensitive drum 9 and the developing sleeve 12*d* will be explained. FIG. 29 is a longitudinal sectional view showing a positional relation between the photosensitive drum 9 and the developing sleeve 12*d* and a structure for pressurizing the developing sleeve, FIG. 30A is a sectional view taken along the line 30A—30A of FIG. 29, and FIG. 30B is a sectional view taken along the line 30B—30B of FIG. 29.

As shown in FIG. 29, the developing sleeve 12*d* on which the toner layer is formed is arranged in a confronting relation to the photosensitive drum 9 with the small gap therebetween (about 200–300 μm). In this case, the photosensitive drum 9 is rotatably mounted on the lower frame 15 by rotatably supporting a rotary shaft 9*f* of the flange gear 9*c* at the one end of the drum via a supporting member 33. The other end of the photosensitive drum 9 is also rotatably mounted on the lower frame 15 via a bearing portion 26*a* of the bearing member 26 secured to the lower frame. The developing sleeve 12*d* has the above-mentioned abutment rings 12*d*1 each having the outer diameter greater than that of the developing sleeve by the amount corresponding to the small gap and arranged in the vicinity of both axial ends of the developing sleeve and outside the toner layer forming area so that these rings are abutted against the photosensitive drum 9 at the zones outside the latent image forming area.

Further, the developing sleeve 12*d* is rotatably supported by sleeve bearings 12*i* disposed between the abutment rings 12*d*1 in the vicinity of both axial ends of the developing sleeve and outside the toner layer forming area, which sleeve bearings 12*i* are mounted on the lower frame 15 in such a manner that they can be slightly shifted in directions shown by the arrow g in FIG. 29. Each sleeve bearing 12*i* has a rearwardly extending projection around which an urging spring 12*j* having one end abutted against the lower frame 15 is mounted. Consequently, the developing sleeve 12*d* is always biased toward the photosensitive drum 9 by these urging springs. With this arrangement, the abutment rings 12*da* are always abutted against the photosensitive drum 9, with the result that the predetermined gap between the developing sleeve 12*d* and the photosensitive drum 9 is always maintained, thereby transmitting the driving force to the flange gear 9*c* of the photosensitive drum 9 and a sleeve gear 12*k* of the developing sleeve 12*d* meshed with the flange gear 9*c*.

The sleeve gear 12*k* also constitutes a flange portion of the developing sleeve 12*d*. That is to say, according to the illustrated embodiment, the sleeve gear 12*k* and the flange portion are integrally formed from resin material (for example, polyacetylene resin). Further, a metallic pin 12*d*2 having a small diameter (for example, made of stainless steel) and having one end rotatably supported by the lower frame 15 is press-fitted into and secured to the sleeve gear 12*k* (flange portion) at its center. This metallic pin 12*d*2 acts as a rotary shaft at one end of the developing sleeve 12*d*. According to the illustrated embodiment, since the sleeve gear and the flange portion can be integrally formed from resin, it is possible to facilitate the manufacturing of the developing sleeve and to make the developing sleeve 12*d* and the process cartridge B light-weight.

Figure 31:
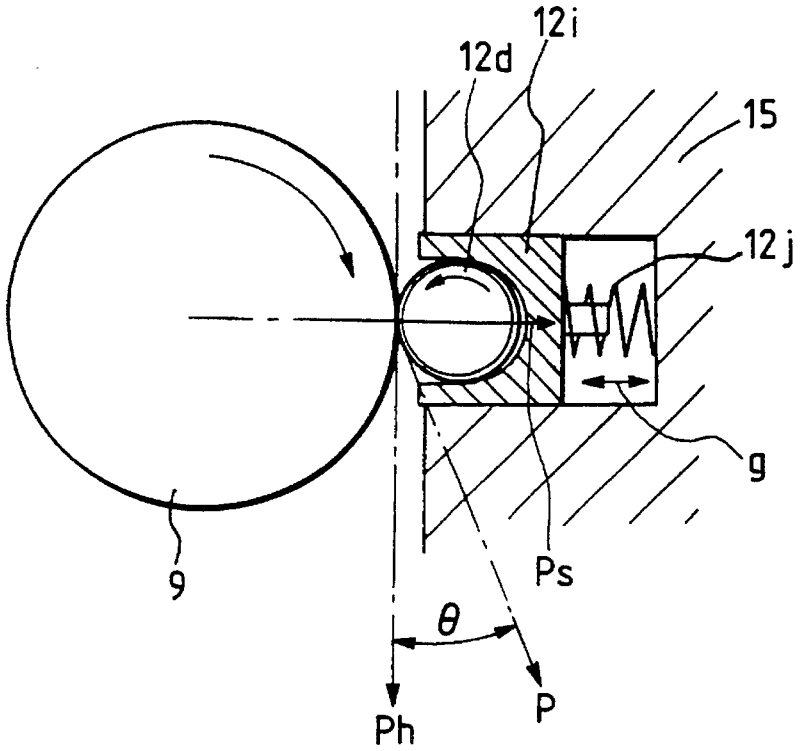
FIG. 31 is a sectional view for explaining the pressurizing force acting on the developing sleeve.

Now, the sliding directions of the sleeve bearings 12*i* will be explained with reference to FIG. 31. First of all, the driving of the developing sleeve 12*d* will be described. When the driving force is transmitted from the drive source (drive motor 54) of the image forming system to the flange gear 9*c* and then is transmitted from the flange gear 9*c* to the sleeve gear 12*k*, the meshing force between the gears is directed to a direction inclined or offset from a tangential line contacting a meshing pitch circle of the flange gear 9*c* and a meshing pitch circle of the sleeve gear 12*k* by a pressure angle (20° in the illustrated embodiment). Thus, the meshing force is directed to a direction shown by the arrow P in FIG. 31 ($\theta \simeq 20°$). In this case, if the sleeve bearings 12*i* are slid in a direction parallel to a line connecting the center of rotation of the photosensitive drum 9 and the center of rotation of the developing sleeve 12*d*, when the meshing force P is divided into a force component Ps of a horizontal direction parallel with the sliding direction and a force component Ph of a vertical direction perpendicular to the sliding direction, as shown in FIG. 31, the force component of the horizontal direction parallel with the sliding direction is directed away from the photosensitive drum 9. As a result, regarding the driving of the developing sleeve 12*d*, the distance between the photosensitive drum 9 and the developing sleeve 12*d* is easily varied in accordance with the meshing force between the flange gear 9*c* and the sleeve gear 12*k*, with the result that the toner on the developing sleeve 12*d* cannot be moved to the photosensitive drum 9 properly, thus worsening the developing ability.

To avoid this, in the illustrated embodiment, as shown in FIG. 30A, in consideration of the transmission of the driving force from the flange gear 9*c* to the sleeve gear 12*k*, the sliding direction of the sleeve bearing 12*i* at the driving side (side where the sleeve gear 12*k* is disposed) is coincided with directions shown by the arrow Q. That is to say, an angle $\Phi$ formed between the direction of the meshing force P (between the flange gear 9*c* and the sleeve gear 12*k*) and the sliding direction is set to have a value of about 90° (92° in the illustrated embodiment). With this arrangement, the force component Ps of the horizontal direction parallel with the sliding direction is negligible, and, in the illustrated embodiment, the force component Ps acts to slightly bias the developing sleeve 12*d* toward the photosensitive drum 9. In such a case, the developing sleeve 12*d* is pressurized by an amount corresponding to spring pressure $\alpha$ of the urging springs 12*j* to maintain the distance between the photosensitive drum 9 and the developing sleeve 12*d* constant, thereby ensuring the proper development.

Next, the sliding direction of the slide bearing 12*i* at the non-driving side (side where the sleeve gear 12*k* is not arranged) will be explained. At the non-driving side, unlike the above-mentioned driving side, since the slide bearing 12*i* does not receive a driving force, as shown in FIG. 30B, the sliding direction of the slide bearing 12*i* is selected to be substantially parallel with a line connecting a center of the photosensitive drum 9 and a center of the developing sleeve 12*d*.

In this way, when the developing sleeve 12*d* is pressurized toward the photosensitive drum 9, by changing the urging angle for urging the developing sleeve 12*d* at the driving side from that at the non-driving side, the positional relation between the developing sleeve 12*d* and the photosensitive drum 9 is always maintained properly, thus permitting the proper development.

Incidentally, the sliding direction of the slide bearing 12*i* at the driving side may be set to be substantially parallel with the line connecting the center of the photosensitive drum 9 and the center of the developing sleeve 12*d* as in the case of the non-driving side. That is to say, as described in the above-mentioned embodiment, at the driving side, since the developing sleeve 12*d* is urged away from the photosensitive drum 9 by the force component Ps (of the meshing force between the flange gear 9*c* and the sleeve gear 12*k*) directing toward the sliding direction of the slide bearing 12*i*, in this embodiment, the urging force of the urging spring 12*j* at the driving side may be set to have a value greater than that at the non-driving side by an amount corresponding to the force component Ps. That is, when the urging force of the urging spring 12*j* to the developing sleeve 12*d* at the non-driving side is P, the urging force P2 of the urging spring 12*j* at the driving side is set to have a relation P2=P1+Ps, with the result that the developing sleeve 12*d* is always subjected to the proper urging force, thus ensuring the constant distance between the developing sleeve and the photosensitive drum 9.

(Cleaning Means )

The cleaning means 13 serves to remove the residual toner remaining on the photosensitive drum 9 after the toner image on the photosensitive drum 9 has been transferred to the recording medium 4 by the transfer means 6. As shown in FIG. 13, the cleaning means 13 comprises an elastic cleaning blade 13*a* contacting with the surface of the photosensitive drum 9 and adapted to remove or scrape off the residual toner remaining on the photosensitive drum 9, a squeegee sheet 13*b* slightly contacting with the surface of the photosensitive drum 9 and disposed below the cleaning blade 13*a* to receive the removed toner, and a waste toner reservoir 13*c* for collecting the waste toner received by the sheet 13*b*. Incidentally, the squeegee sheet 13*b* is slightly contacted with the surface of the photosensitive drum 9 and this serves to permit the passing of the residual toner remaining on the photosensitive drum, while directing the toner removed from the photosensitive drum 9 by the cleaning blade 13*a*, to a direction away from the surface of the photosensitive drum 9.

Figure 32:
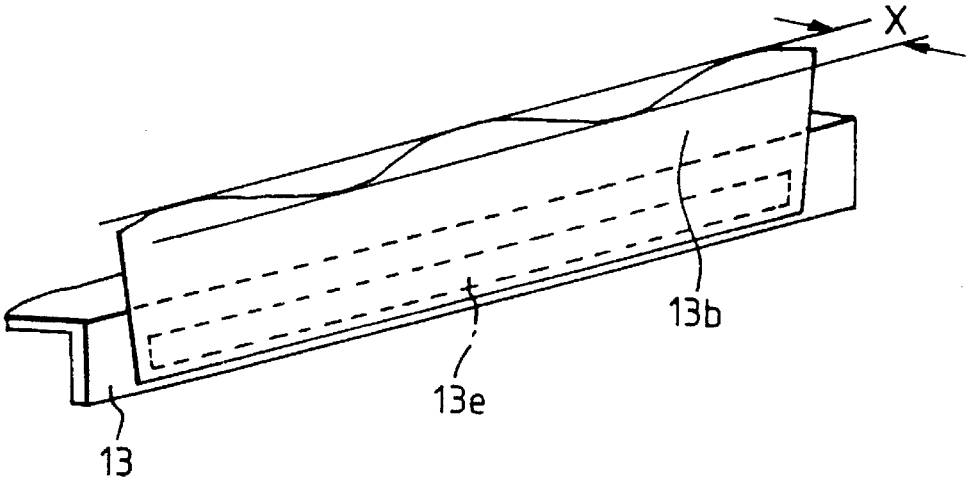
FIG. 32 is a perspective view of a squeegee sheet in a condition that an upper edge of the sheet is tortuous.

Now, a method for attaching the squeegee sheet 13*b* will be described. The squeegee sheet 13*b* is adhered to an attachment surface 13*d* of the waste toner reservoir 13*c* via both-side adhesive tape 13*e*. In this case, the waste toner reservoir 13*c* is made of resin material (for example, high-impact styrol (HIPS) or the like) and has a slight uneven surface. Thus, as shown in FIG. 32, if the both-sided adhesive tape 13*e* is merely stuck to the attachment surface 13*d* and the squeegee sheet 13*b* is merely attached to the adhesive tape 13*e*, it is feared that a free edge of the squeegee sheet 13*b* (to be contacted with the photosensitive drum 9) will be tortuous as shown by x. If such a tortuous edge x of the squeegee sheet 13*b* is generated, the squeegee sheet 13*b* does not closely contact with the surface of the photosensitive drum 9, so that it cannot surely receive the toner removed by the cleaning blade 13*a*.

Figure 33A:
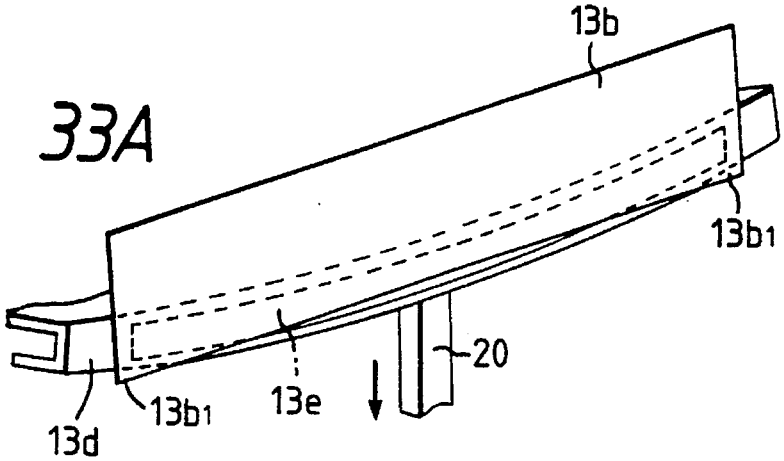
FIG. 33A is a perspective view showing a condition that a both-sided adhesive tape is protruded from a lower end of the squeegee sheet.

In order to avoid this, it is considered that, when the squeegee sheet 13*b* is attached to the attachment surface, as shown in FIG. 33A, the attachment surface 13*d* at a lower portion of the waste toner reservoir is pulled downwardly by a pulling tool 20 to elastically deform the attachment surface to a curvature and then the squeegee sheet 13*b* is stuck to the curved attachment surface, and, thereafter the curvature of the attachment surface is released to apply the tension to the free edge of the squeegee sheet 13*b*, thereby preventing the free edge from becoming tortuous. However, in the recent small-sized process cartridges B, since the dimension of the attachment surface 13*d* is small, if the squeegee sheet 13*b* is stuck to the curved attachment surface 13*d*, as shown in FIG. 33A, both lower ends or corners 13*b*1 of the squeegee sheet 13*b* will be protruded from the attachment surface 13*d* downwardly. And, when the squeegee sheet 13*b* is protruded downwardly from the attachment surface 13*d*, as apparent from the sectional view of FIG. 10, it is feared that the recording medium 4 is interfered with the protruded squeegee sheet 13*b*.

Figure 33B:
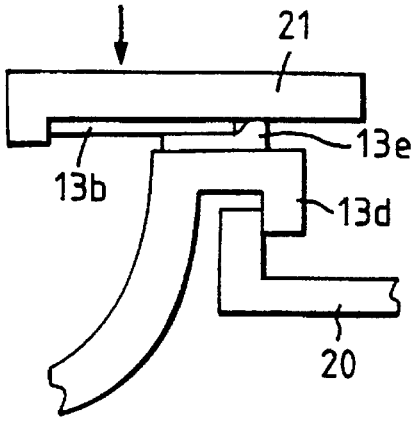
FIGS. 33B and 33C are views showing a condition that a sticking tool is adhered to the protruded both-sided adhesive tape.
Figure 33C:
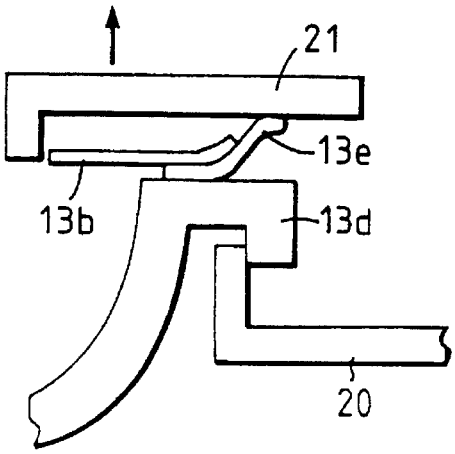

Further, if the squeegee sheet 13*b* is attached to the curved attachment surface 13*d*, as shown in FIG. 33A, the both-sided adhesive tape 13*e* will be protruded from the lower end of the squeegee sheet 13*b*. Thus, in this condition, when the squeegee sheet 13*b* is urged against the both-sided adhesive tape 13*e* by a sticking tool 21, as shown in FIG. 33B, the protruded portion of the both-sided adhesive tape 13*e* is stuck to the sticking tool 21, with the result that, when the sticking tool 21 is removed, as shown in FIG. 33C, the both-sided adhesive tape 13*e* is peeled from the attachment surface 13*d*, thus causing the poor attachment of the squeegee sheet 13*b*.

Figure 34A:
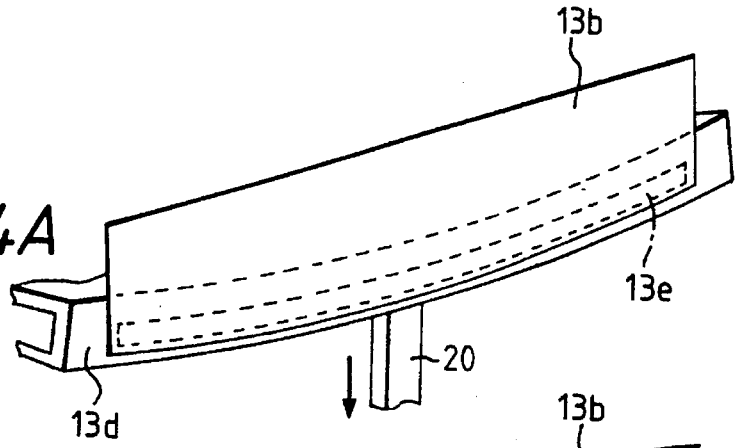
FIG. 34A is a perspective view showing a condition that the squeegee sheet is stuck to a curved attachment surface with a lower end portion of the sheet being curved.
Figure 34B:
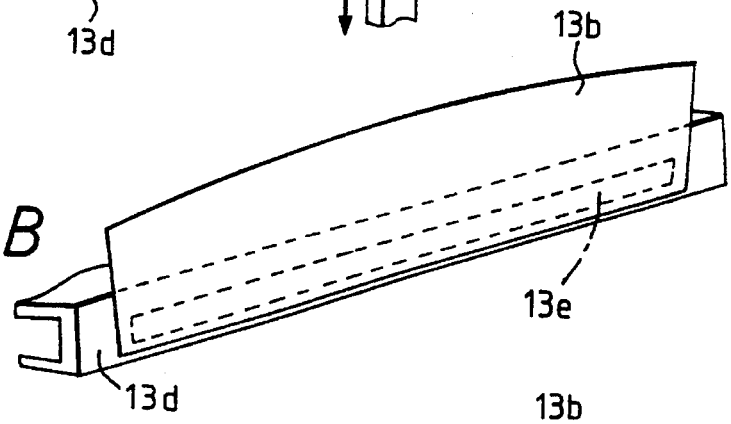
FIG. 34B is a perspective view showing a condition that an upper end portion of the squeegee sheet is tensioned by releasing the curvature of the attachment surface.

To avoid this, in the illustrated embodiment, as shown in FIG. 34A, the configuration of the lower end of the squeegee sheet 13*b* becomes substantially the same as the curvature configuration of the attachment surface 13*d* which has been curved by the pulling tool 20. That is to say, a width of the squeegee sheet 13*b* is varied from both longitudinal ends to a central portion so that the latter becomes greater than the former (for example, width at the central portion is about 7.9 mm, and width at both ends is about 7.4 mm). In this way, when the squeegee sheet 13*b* is attached to the attachment surface, the curved both-sided adhesive tape 13*e* does not protrude from the squeegee sheet 13*b*. Further, when the pulling tool 20 is removed to release the curvature of the attachment surface 13*d* thereby to apply the tension to the upper edge of the squeegee sheet 13*b* as shown in FIG. 34B, the lower end of the squeegee sheet does not protrude from the attachment surface 13*d* downwardly. Therefore, the above-mentioned interference between the recording medium 4 and the squeegee sheet 13*b* and the poor attachment of the squeegee sheet 13*b* can be prevented.

Figure 35:
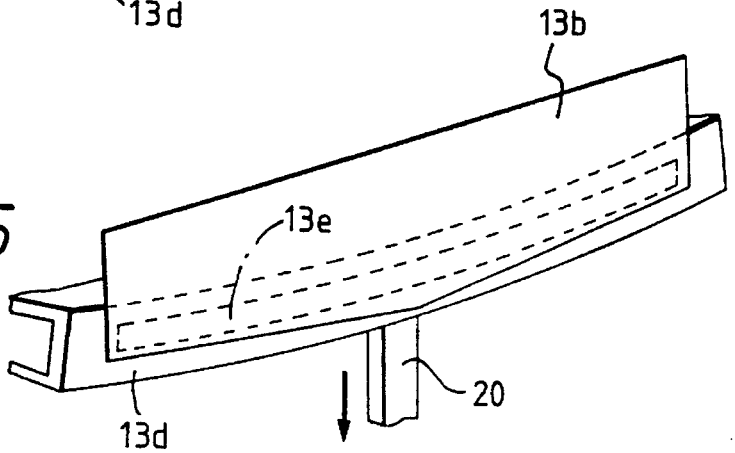
FIG. 35 is a perspective view of a squeegee sheet according to another embodiment wherein a width of the sheet is widened straightly and gradually from both to a central portion thereof.
Figure 36:
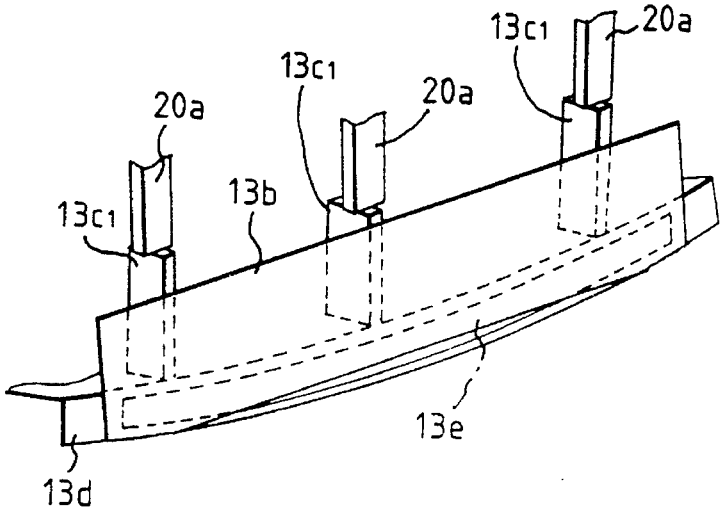
FIG. 36 is a perspective view for explaining the formation of the curvature of the squeegee sheet attachment surface by pressing the surface.

Incidentally, in view of the workability and the service life of a working tool, it is desirable that the lower edge of the squeegee sheet 13*b*be straight. Thus, as shown in FIG. 35, the width of the squeegee sheet 13*b* may be varied linearly so that the width at the central portion becomes greater than those at both longitudinal ends in correspondence to the amount of the curvature of the attachment surface 13*d*. In the above-mentioned embodiment, while the attachment surface 13*d* was curved by pulling it by the pulling tool 20, it is to be understood that, as shown in FIG. 36, the attachment surface 13*d* may be curved by pushing toner reservoir partition plates 13*c*1 integrally formed with the attachment surface 13*d* by pushing tools 20*a*.

Further, in the illustrated embodiment, while the squeegee sheet attachment surface 13*d* was formed on the lower portion of the waste toner reservoir 13*c*, the squeegee sheet 13*b* may be stuck to a metallic plate attachment surface independently formed from the waste toner reservoir 13*c* and then metallic plate may be incorporated into the waste toner reservoir 13*c*.

Incidentally, in the illustrated embodiment, the squeegee sheet 13*b* is made of polyethylene terephthalate (PET) and has a thickness of about 38 μm, a length of about 241.3 mm, a central width of about 7.9 mm, end widths of about 7.4 mm and an appropriate radius of curvature of about 14556.7 mm.

(Upper and Lower Frames)

Next, the upper and lower frames 14, 15 constituting the housing of the process cartridge B will be explained. As shown in FIGS. 16 and 17, the photosensitive drum 9, the developing sleeve 12*d* and developing blade 12*e* of the developing means 12, the cleaning means 13 are provided in the lower frame 15. On the other hand, as shown in FIGS. 7 and 9, the charger roller 10, the toner reservoir 12*a* of the developing means 12 and the toner feed mechanism 12*b* are provided in the upper frame 14.

In order to assemble the upper and lower frames 14, 15 together, four pairs of locking pawls 14*a* are integrally formed with the upper frame 14 and are spaced apart from each other equidistantly in a longitudinal direction of the upper frame. Similarly, locking openings 15*a* and locking projections 15*b* for engaging by the locking pawls 14*a* are integrally formed on the lower frame 15. Accordingly, when the upper and lower frames 14, 15 are forcibly urged against each other to engage the locking pawls 14*a* by the corresponding locking openings 15*a* and locking projections 15*b*, the upper and lower frames 14, 15 are interconnected. Incidentally, in order to ensure the interconnection between the upper and lower frames, as shown in FIG. 17, a locking pawl 15*c* and a locking opening 15*d* are formed near both longitudinal ends of the lower frame 15, respectively, whereas, as shown in FIG. 18, a locking opening 14*b* (to be engaged by the locking pawl 15*c*) and a locking pawl 14*c* (to be engaged by the locking opening 15*d*) are formed near both longitudinal ends of the upper frame 14, respectively.

When the parts constituting the process cartridge B are separately contained within the upper and lower frames 14, 15 as mentioned above, by arranging the parts which should be positioned with respect to the photosensitive drum 9 (for example, developing sleeve 12*d*, developing blade 12*e* and cleaning blade 13*a*) within the same frame (lower frame 15 in the illustrated embodiment), it is possible to ensure the excellent positioning accuracy of each part and to facilitate the assembling of the process cartridge B. Further, as shown in FIG. 17, fitting recesses 15*n* are formed in the lower frame 15 in the vicinity of one lateral edge thereof. On the other hand, as shown in FIG. 18, fitting projections 14*h* (to be fitted into the corresponding fitting recesses 15*n*) are formed on the upper frame 14 in the vicinity of one lateral edge thereof at intermediate locations between the adjacent locking pawls 14*a*.

Further, in the illustrated embodiment, as shown in FIG. 17, fitting projections 15*e* are formed on the lower frame 15 near two corners thereof, whereas fitting recesses 15*f* are formed in the lower frame near the other two corners. On the other hand, as shown in FIG. 18, fitting recesses 14*d* (to be engaged by the corresponding fitting projections 15*e*) are formed in the upper frame 14 near two corners thereof, whereas fitting projections 14*e* (to be fitted into the corresponding fitting recesses 15*f*) are formed in the lower frame near the other two corners. Accordingly, when the upper and lower frames 14, 15 are interconnected, by fitting the fitting projections 14*h*, 14*e*, 15*e* (of the upper and lower frames 14, 15) into the corresponding fitting recesses 15*n*, 15*f*, 14*d*, the upper and lower frames 14, 15 are firmly interconnected to each other so that, even if a torsion force is applied to the interconnected upper and lower frames 14, 15, they are not disassembled.

Incidentally, the positions of the above-mentioned fitting projections and fitting recesses may be changed so long as the interconnected upper and lower frames 14, 15 are not disassembled by any torsion force applied thereto.

Further, as shown in FIG. 18, a protection cover 22 is rotatably mounted on the upper frame 14 via pivot pins 22*a*. The protection cover 22 is biased toward a direction shown by the arrow h in FIG. 18 by torsion coil springs (not shown) arranged around the pivot pins 22*a*, so that the projection cover 22 closes or covers the photosensitive drum 9 in the condition that the process cartridge B is removed from the image forming system A as shown in FIG. 13.

More specifically, as shown in FIG. 1, the photosensitive drum 9 is so designed that it is exposed from an opening 15*g* formed in the lower frame 15 to be opposed to the transfer roller 6 in order to permit the transferring of the toner image from the photosensitive drum onto the recording medium 4. However, in the condition that the process cartridge B is removed from the image forming system A, if the photosensitive drum 9 is exposed to the atmosphere, it will be deteriorated by the ambient light and the dirt and the like will be adhered to the photosensitive drum 9. To avoid this, when the process cartridge B is dismounted from the image forming system A, the opening 15*g* is closed by the protection cover 22, thereby protecting the photosensitive drum 9 from the ambient light and dirt. Incidentally, when the process cartridge B is mounted within the image forming system A, the protection cover 22 is rotated by a rocking mechanism (not shown) to expose the photosensitive drum 9 from the opening 15*g*.

Further, as apparent from FIG. 10, in the illustrated embodiment, the lower surface of the lower frame 15 also acts as a guide for conveying the recording medium 4. The lower surface of the lower frame is formed as both side guide portions 15*h*1 and a stepped central guide portion 15*h*2 (FIG. 15). The longitudinal length (i.e., distance between the steps) of the central guide portion 15*h*2 is about 102–120 mm (107 mm in the illustrated embodiment) which is slightly greater than a width (about 100 mm), and the depth of the step is selected to have a value of about 0.8–2 mm. With this arrangement, the central guide portion 15*h*2 increases the conveying space for the recording medium 4, with the result that, even when thicker and resilient sheet such as a post card, visiting card or envelope is used as the recording medium 4, such thicker sheet does not interfere with the guide surface of the lower frame 15, thereby preventing the recording medium from jamming. On the other hand, when a thin sheet having a greater width than that of the post card such as a plain sheet is used as the recording medium, since such sheet (recording medium) is guided by both side guide portions 15*h*1, it is possible to convey the sheet without floating.

Figure 37A:
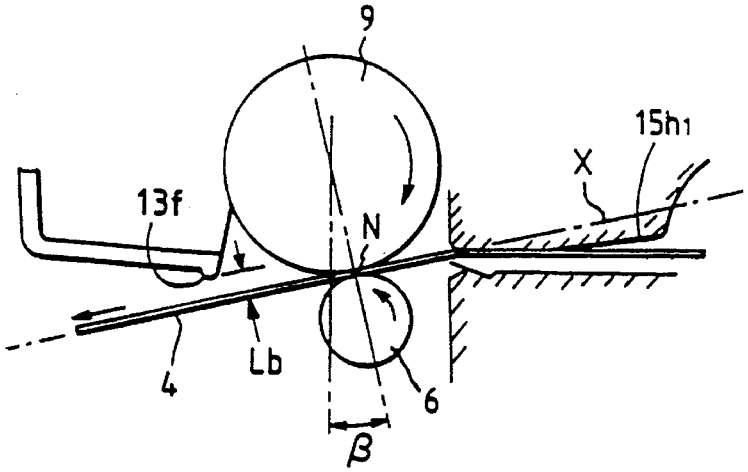
FIGS. 37A–37C are views showing conditions that a recording medium is being guided by a lower surface of the lower frame.
Figure 37B:
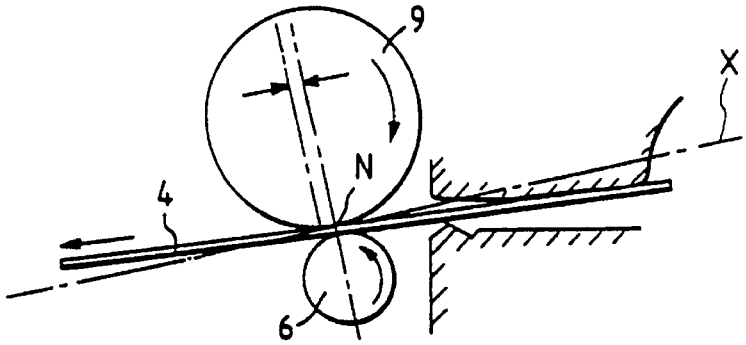
Figure 37C:
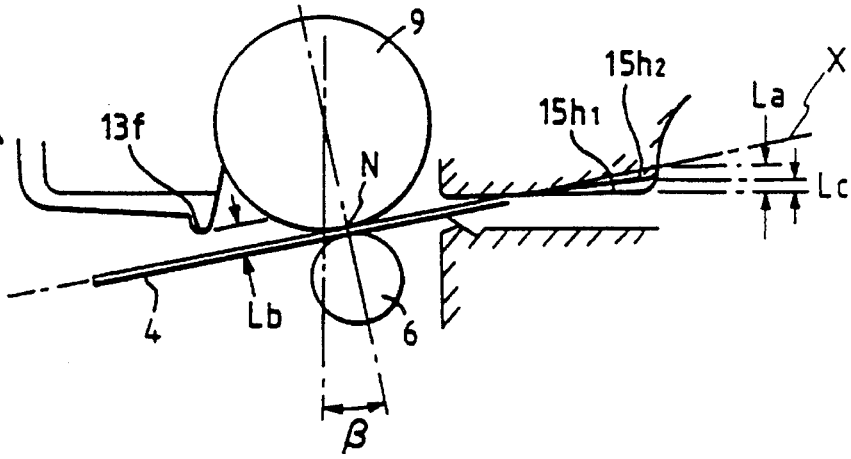

Now, the lower surface of the lower frame 15 acting as the conveying guide for the recording medium will be described more concretely. As shown in FIGS. 37A and 37B and 37C, both side guide portions 15*h*1 can be flexed by an amount La (=5–7 mm) with respect to a tangential direction X regarding a nip N between the photosensitive drum 9 and the transfer roller 6. Since both side guide portions 15*h*1 are formed on the lower surface of the lower frame 15 designed to provide the required space between the lower frame and the developing sleeve 12*d* and the required space for sufficiently supplying the toner to the developing sleeve, such guide portions are determined by the position of the developing sleeve 12*d* selected to obtain the optimum developing condition. If the lower surfaces of the side guide portions are approached to the tangential line X, the thickness of the lower portion of the lower frame 15 is decreased, thus causing a problem regarding the strength of the process cartridge B.

Further, the position of a lower end 13*f* of the cleaning means 13 is determined by the positions of the cleaning blade 13*a*, the squeegee sheet 13*b* and the like constituting the cleaning means 13 as described later, and is so selected to provide a distance Lb (=3–5 mm) preventing the interference with the recording medium 4 being fed. Incidentally, in the illustrated embodiment, angle β between a vertical line passing through the rotational center of the photosensitive drum 9 shown in FIGS. 37A and 37C and a line connecting the rotational center of the photosensitive drum and the rotational center of the transfer roller 6 is selected to have a value of 5–20 degrees.

In consideration of the above affairs, by providing the recess or step having a depth Lc (=1–2 ram) only in the central guide portion 15*h*2 to approach this guide portion to the tangential line X, it is possible to feed the thicker and resilient recording medium 4 smoothly without reducing the strength of the lower frame 15. Incidentally, in most cases, since the thicker and resilient recording medium 4 is the visiting card, envelope or the like which is narrower than the post card under the general specification of the image forming system, so long as the width of the stepped or recessed central guide portion 15*h*2 is selected to be slightly greater than that of the post card, there is no problem in the practical use.

Further, regulating projections 15*i* protruding downwardly are formed on the outer surface of the lower frame 15 in areas outside of the recording medium guiding zone. The regulating projections 15*i* each protrudes from the guide surface of the lower frame for the recording medium 4 by about 1 mm. With this arrangement, even if the process cartridge B is slightly lowered for some reason during the image forming operation, since the regulating projections 15*i* are abutted against a lower guide member 23 (FIG. 10) of the body 16 of the image forming system, the further lowering of the process cartridge can be prevented. Accordingly, a space of at least 1 mm is maintained between the lower guide member 23 and the lower guide surface of the lower frame 15 to provide a conveying path for the recording medium 4, thereby conveying the recording medium without jamming. Further, as shown in FIG. 10, a recess 15*j* is formed in the lower surface of the lower frame 15 not to interfere with the registration roller 5*c*2. Thus, when the process cartridge B is mounted within the image forming system A, since it can be mounted near the registration roller 5*c*2, the whole image forming system can be small-sized.

(Assembling of Process Cartridge)

Figure 38:
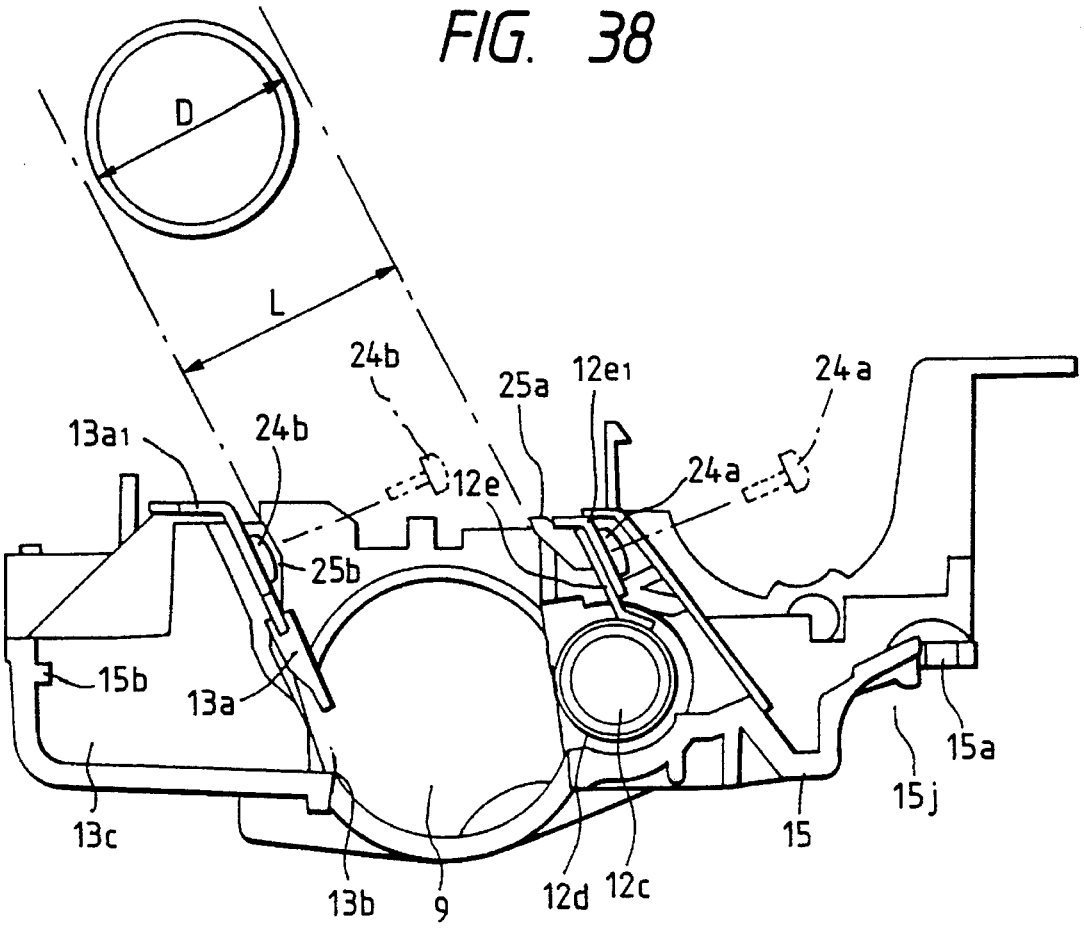
FIG. 38 is a sectional view showing a condition that the photosensitive drum is finally assembled.

Next, the assembling of the process cartridge having the above-mentioned construction will be explained. In FIG. 38, toner leak preventing seals S having a regular shape and made of Moltopren (flexible polyurethane, manufactured by INOAC Incorp.) rubber for preventing the leakage of toner are stuck on ends of the developing means 12 and of the cleaning means 13 and on the lower frame 15. Incidentally, the toner leak preventing seals S each may not have the regular shape. Alternatively, seals preventing toner leak may be attached by forming recesses in portions (to be attached) of the seals and by pouring liquid material which becomes elastomer when solidified into the recesses.

A blade support member 12*e*1 to which the developing sleeve 12*e* is attached and a blade support member 13*a*1 to which the cleaning blade 13*a* is attached are attached to the lower frame 15 by pins 24*a*, 24*b*, respectively. According to the illustrated embodiment, as shown by the phantom lines in FIG. 38, the attachment surfaces of the blade support members 12*e*1, 13*a*1 may be substantially parallel to each other so that the pins 24*a*, 24*b* can be driven from the same direction. Thus, when a large number of process cartridges B are manufactured, the developing blades 12*e* and the cleaning blades 13*a* can be continuously attached by the pins by using an automatic device. Further, the assembling ability for the blades 12*e*, 13*a* can be improved by providing a space for a screw driver, and the shape of a mold can be simplified by aligning the housing removing direction from the mold, thereby achieving the cost down.

Figure 39:
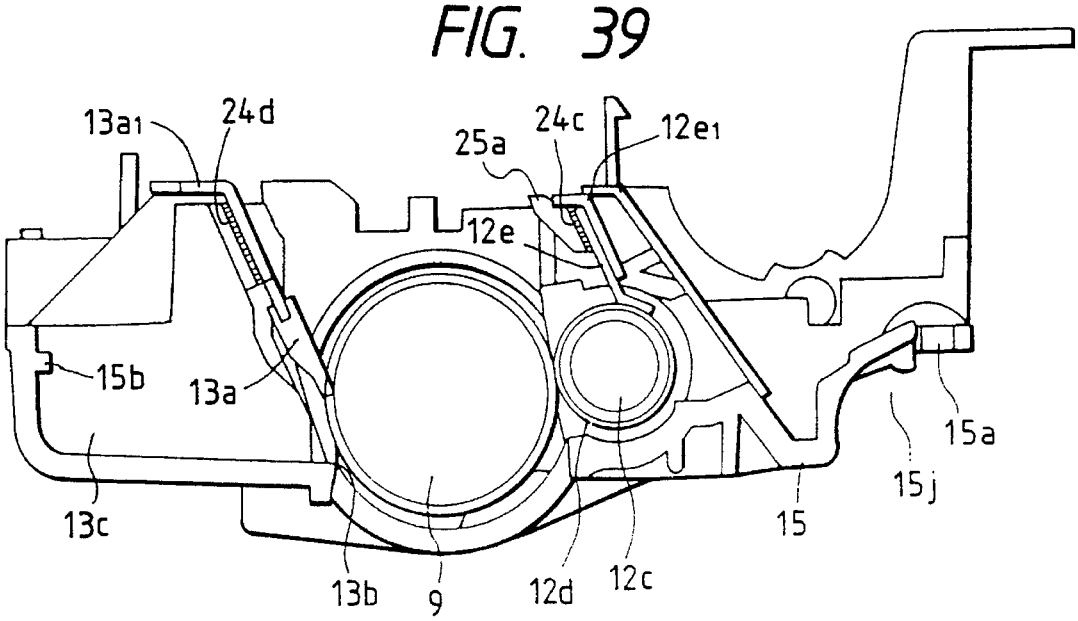
FIG. 39 is a sectional view showing a condition that a developing blade and a cleaning blade are stuck.

Incidentally, the developing blade 12*e* and the cleaning blade 13*a* may not be attached by the pins (screws), but may be attached to the lower frame 15 by adhesives 24*c*, 24*d* as shown in FIG. 39. Also in this case, when the adhesives can be applied from the same direction, the attachment of the developing blade 12*e* and the cleaning blade 13*a* can be automatically and continuously performed by using an automatic device.

Figure 40:
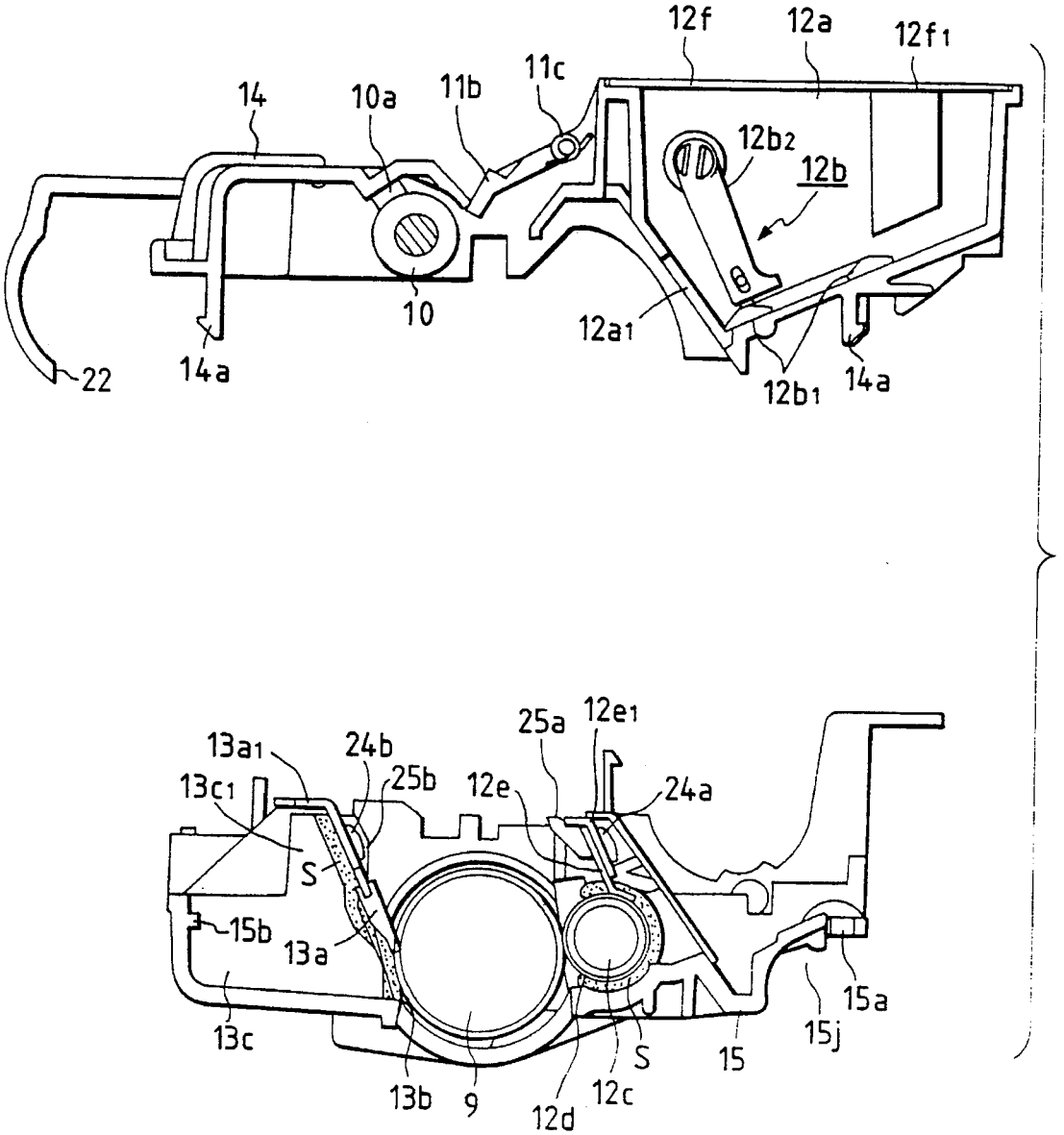
FIG. 40 is an exploded view for explaining the assembly of the process cartridge.
Figure 41:
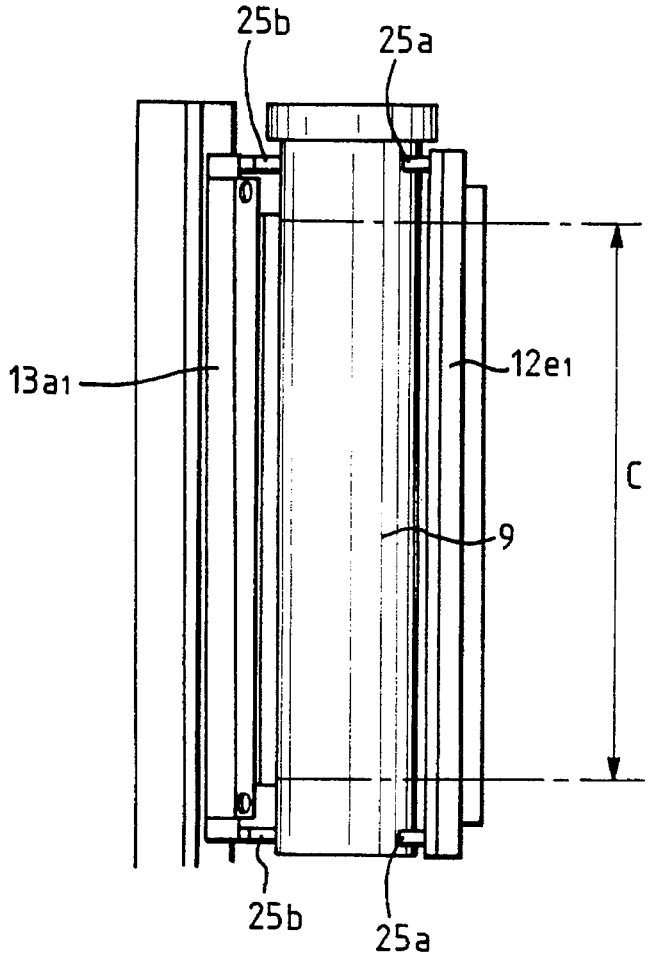
FIG. 41 is a view for explaining a position of guide members when the photosensitive drum of the process cartridge is assembled.

After the blades 12*e*, 13*a* have been attached as mentioned above, the developing sleeve 12*d* is attached to the lower frame 15. Then, the photosensitive drum 9 is attached to the lower frame 15. To this end, in the illustrated embodiment, guide members 25*a*, 25*b* are attached to surfaces (opposed to the photosensitive drum) of the blade support members 12*e*1, 13*a*1, respectively, at zones outside of the longitudinal image forming area C (FIG. 41) of the photosensitive drum 9. (Incidentally, in the illustrated embodiment, the guide members 25*a*, 25*b* are integrally formed with the lower frame 15). A distance between the guide members 25*a* and 25*b* is set to be greater than the outer diameter D of the photosensitive drum 9. Thus, after the various parts such as the developing blade 12*e*, cleaning blade 13*a* and the like have been attached to the lower frame 15, as shown in FIG. 40, the photosensitive drum 9 can be finally attached to the lower frame while guiding both longitudinal ends (outside of the image forming area) of the photosensitive drum by the guide members 25*a*, 25*b*. That is to say, the photosensitive drum 9 is attached to the lower frame 15 while slightly flexing the cleaning blade 13*a* and/or slightly retarding and rotating the developing sleeve 12*d*.

If the photosensitive drum 9 is first attached to the lower frame 15 and then the blades 12*e*, 13*a* and the like are attached to the lower frame, it is feared that the surface of the photosensitive drum 9 is damaged during the attachment of the blades 12*e*, 13*a* and the like. Further, during the assembling operation, it is difficult or impossible to check the attachment positions of the developing blade 12*e* and the cleaning blade 13*a* and to measure the contacting pressures between the blades and the photosensitive drum. In addition, although lubricant must be applied to the blades 12*e*, 13*a* to prevent an increase in torque and/or a blade turn-up due to the close contact between the initial blades 12*e*, 13*a* (at the non-toner condition) and the photosensitive drum 9 and the developing sleeve 12*d* before the blades 12*e*, 13*a* are attached to the lower frame 15, such lubricant is likely to be dropped off from the blades during the assembling of the blades. However, according to the illustrated embodiment, since the photosensitive drum 9 is finally attached to the lower frame, the above-mentioned drawbacks and problems can be eliminated.

As mentioned above, according to the illustrated embodiment, it is possible to check the attachment positions of the developing means 12 and the cleaning means 13 in the condition that these means 12, 13 are attached to the frames, and to prevent the image forming area of the photosensitive drum from being damaged or scratched during the assembling of the drum. Further, since it is possible to apply the lubricant to the blades in the condition that these means 12, 13 are attached to the frames, the dropping of the lubricant can be prevented, thereby preventing the occurrence of the increase in torque and/or the blade turn-up due to the close contact between the developing blade 12*e* and the developing sleeve 12*d*, and the cleaning blade 13*a* and the photosensitive drum 9.

Figure 42:
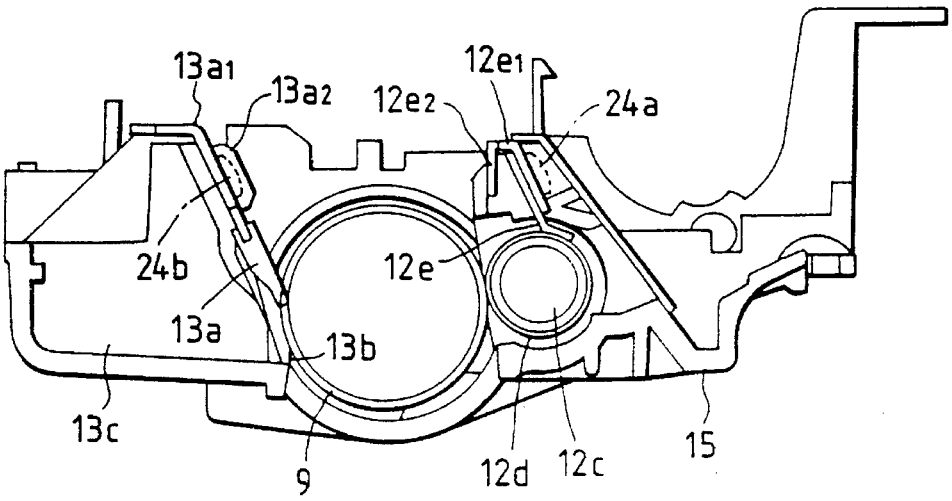
FIG. 42 is a sectional view of a structure wherein drum guides are arranged at ends of blade supporting members.

Incidentally, in the illustrated embodiment, while the guide members 25*a*, 25*b* were integrally formed with the lower frame 15, as shown in FIG. 42, projections 12*e*2, 13*a*2 may be integrally formed on the blade support members 12*e*1, 13*a*1 or other guide members may be attached to the blade support members at both longitudinal end zones of the blade support members outside of the image forming area of the photosensitive drum 9, so that the photosensitive drum 9 is guided by these projections or other guide members during the assembling of the drum.

Figure 43:
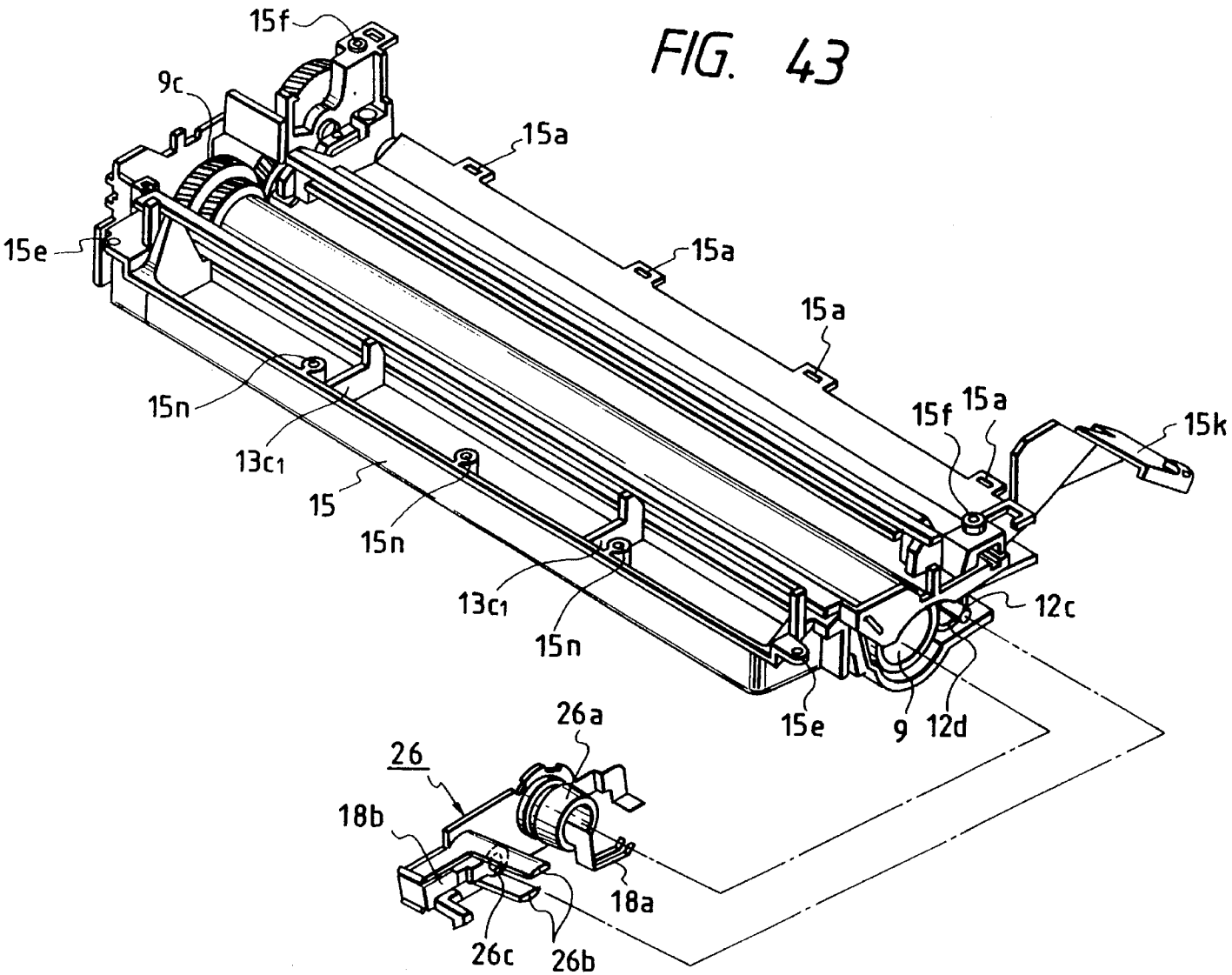
FIG. 43 is a perspective view for explaining the attachment of bearing members for the photosensitive drum and the developing sleeve.
Figure 44:
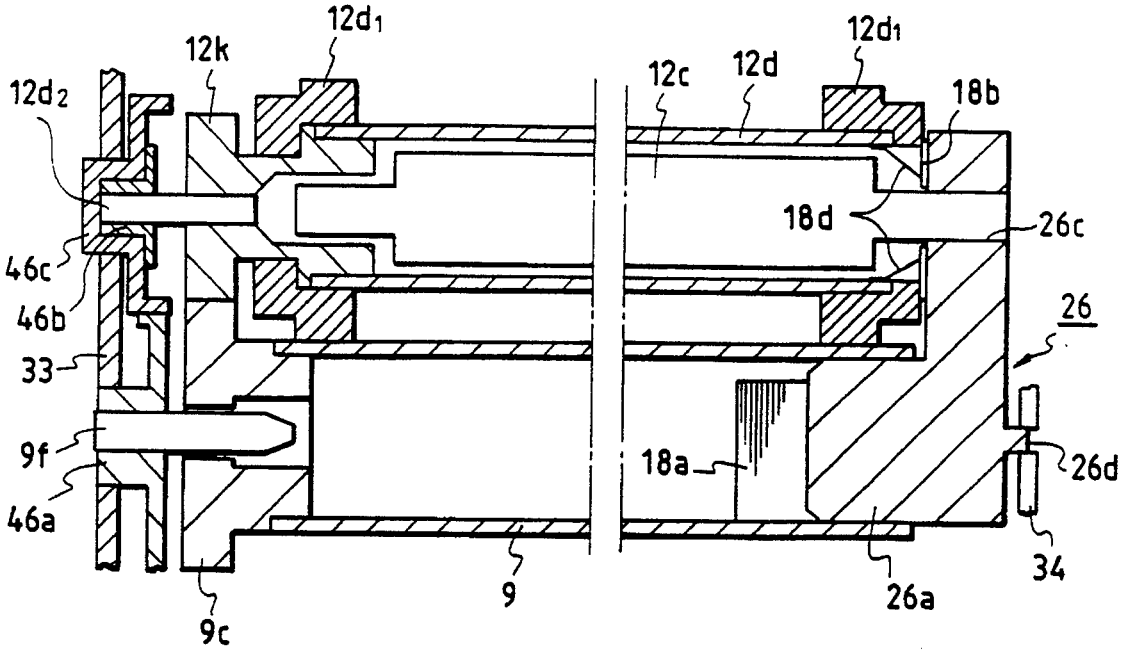
FIG. 44 is a sectional view of the photosensitive drum and the developing sleeve with the bearing members attached thereto.

After the developing sleeve 12*d*, developing blade 12*e*, cleaning blade 13*a* and photosensitive drum 9 have been attached to the lower frame 15 as mentioned above, as shown in FIG. 43 (perspective view) and FIG. 44 (sectional view), the bearing member 26 is incorporated to rotatably support one end of the photosensitive drum 9 and one end of the developing sleeve 12*d*. The bearing member 26 is made of anti-wear material such as polyacetal and comprises a drum bearing portion 26*a* to be fitted on the photosensitive drum 9, a sleeve bearing portion 26*b* to be fitted on the outer surface of the developing sleeve 12*d*, and a D-cut hole portion 26*c* to be fitted on an end of a D-cut magnet 12*c*. Alternatively, the sleeve bearing portion 26*b* may be fitted on the outer surface of the sleeve bearing 12*i* supporting the outer surface of the developing sleeve 12*d* or may be fitted between slide surfaces 15Q of the lower frame 15 which are fitted on the outer surface of the slide bearing 12*i*.

Accordingly, when the drum bearing portion 26*a* is fitted on the end of the photosensitive drum 9 and the end of the magnet 12*c* is inserted into the D-cut hole portion 26*c* and the developing sleeve 12*d* is inserted between into the sleeve bearing portion 26*b* and the bearing member 26 is fitted into the side of the lower frame 15 while sliding it in the longitudinal direction of the drum, the photosensitive drum 9 and the developing sleeve 12*d* are rotatably supported. Incidentally, as shown in FIG. 43, the earthing contact 18*a* is attached to the bearing member 26, and, when the bearing member 26 is fitted into the side of the lower frame, the earthing contact 18*a* is contacted with the aluminum drum core 9*a* of the photosensitive drum 9 (see FIG. 19). Further, the developing bias contact 18*b* is also attached to the bearing member 26, and, when the bearing member 26 is attached to the developing sleeve 12*d*, the bias contact 18*b* is contacted with a conductive member 18*d* contacting the inner surface of the developing sleeve 12*d*.

In this way, by rotatably supporting the photosensitive drum 9 and the developing sleeve 12*d* by the single bearing member 26, it is possible to improve the positional accuracy of the elements 9, 12*d*, and to reduce the number of parts, thereby facilitating the assembling operation and achieving the cost-down. Further, since the positioning of the photosensitive drum 9 and the positioning of the developing sleeve 12*d* and the magnet 12*c* can be performed by using the single member, it is possible to determine the positional relation between the photosensitive drum 9 and the magnet 12*c* with high accuracy, with the result that it is possible to maintain a constant magnetic force regarding the surface of the photosensitive drum 9, thus obtaining the high quality image. In addition, since the earthing contact 18*a* for earthing the photosensitive drum 9 and the developing bias contact 18*b* for applying the developing bias to the developing sleeve 12*d* are attached to the bearing member 26, the compactness of the parts can be achieved effectively, thus making the process cartridge B small-sized effectively.

Further, by providing (on the bearing member 26) supported portions for positioning the process cartridge B within the image forming system when the process cartridge is mounted within the image forming system, the positioning of the process cartridge B regarding the image forming system can be effected accurately. Furthermore, as apparent from FIGS. 14 and 15, an outwardly protruding U-shaped projection, i.,e, drum shaft portion 26*d* (FIG. 29) is also formed on the bearing member 26. When the process cartridge B is mounted within the body 16 of the image forming system, the drum shaft portion 26*d* is supported by a shaft support member 34 as will be described later, thereby positioning the process cartridge B. In this way, since the process cartridge B is positioned by the bearing member 26 for directly supporting the photosensitive drum 9 when the cartridge is mounted within the system body 16, the photosensitive drum 9 can be accurately positioned regardless of the manufacturing and/or assembling errors of other parts.

Further, as shown in FIG. 44, the other end of the magnet 12*c* is received in an inner cavity formed in the sleeve gear 12*k*, and an outer diameter of the magnet 12*c* is so selected as to be slightly smaller than an inner diameter of the cavity. Thus, at the sleeve gear 12*k*, the magnet 12*c* is held in the cavity without any play and is maintained in a lower position in the cavity by its own weight or is biased toward the blade support member 12*e*1 made of magnetic metal such as ZINKOTE (zinc plated steel plate, manufactured by shin Nippon Steel Incorp.) by a magnetic force of the magnet 12*c*. In this way, since the sleeve gear 12*k* and the magnet 12*c* are associated with each other with any play, the friction torque between the magnet 12*c* and the rotating sleeve gear 12*k* can be reduced, thereby reducing the torque regarding the process cartridge.

On the other hand, as shown in FIG. 40, the charger roller 10 is rotatably mounted within the upper frame 14, and the shutter member 11*b*, the protection cover 22 and the toner feed mechanism 12*b* are also attached to the upper frame 15. The opening 12*a*1 for feeding out the toner from the toner reservoir 12*a* to the developing sleeve 12*d* is closed by a cover film 28 (FIG. 45) having a tear tape 27. Further, the lid member 12*f* is secured to the upper frame, and, thereafter, the toner is supplied to the toner reservoir 12*a* through the filling opening 12*a*3 and then the filling opening 12*a*3 is closed by the lid 12*a*2, thus sealing the toner reservoir 12*a*.

Figure 45:
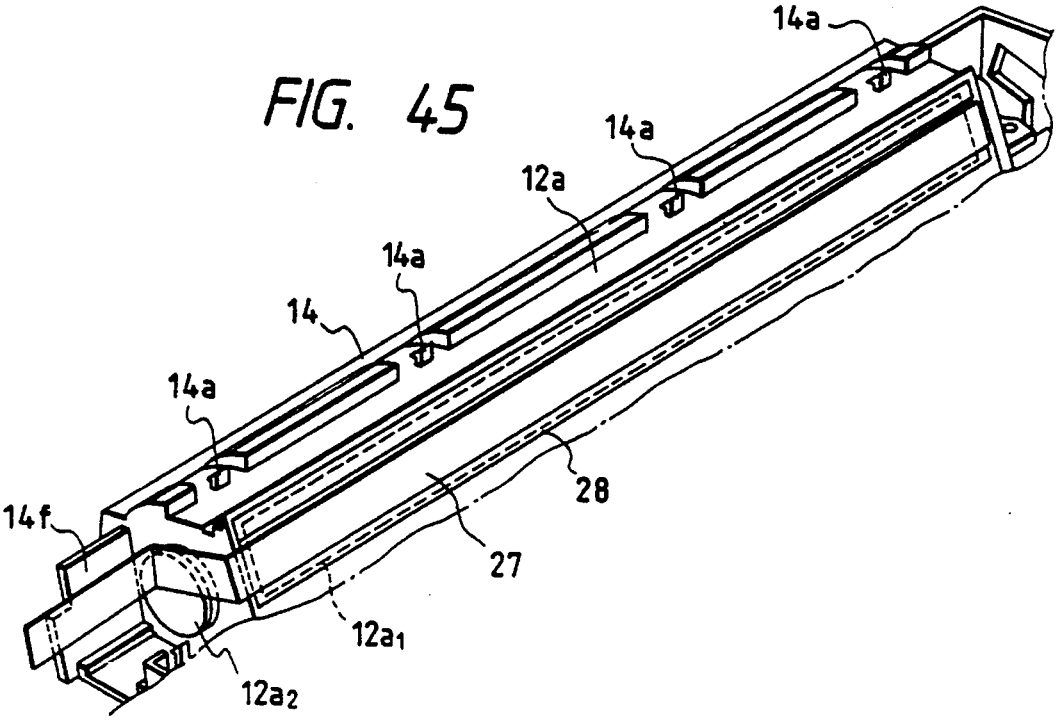
FIG. 45 is a perspective view for explaining a cover film and a tear tape.

Incidentally, as shown in FIG. 45, the tear tape 27 of the cover film 28 stuck around the opening 12*a*1 extends from one longitudinal end (right end in FIG. 45) of the opening 12*a*1 to the other longitudinal end (left end in FIG. 45) and is bent at the other end and further extends along a gripper portion 14*f* formed on the upper frame 14 and protrudes therefrom outwardly.

Figure 46:
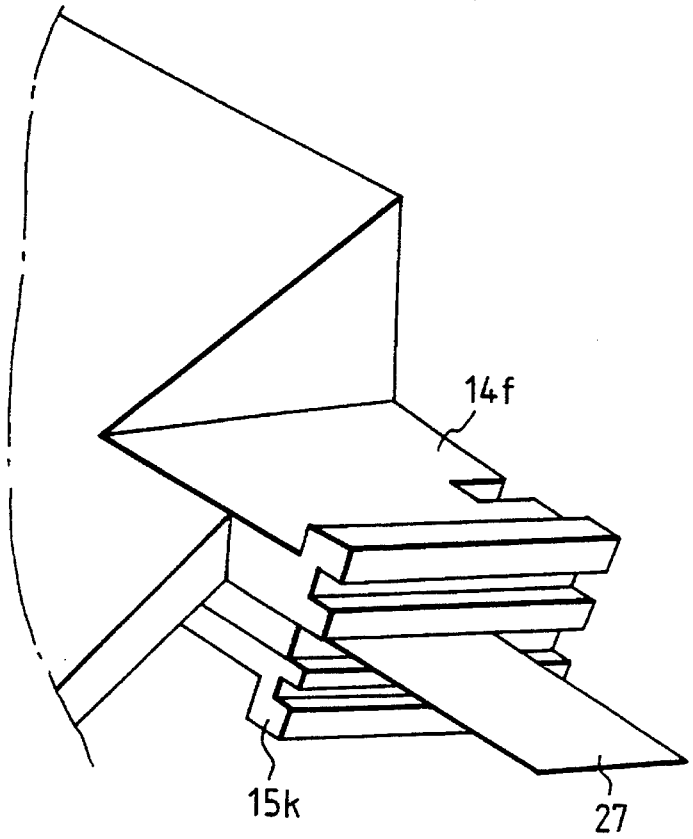
FIG. 46 is a perspective view showing a condition that the tear tape is protruded from a gripper.

Next, the process cartridge B is assembled by interconnecting the upper and lower frames 14, 15 via the above-mentioned locking pawls and locking openings or recesses. In this case, as shown in FIG. 46, the tear tape 27 is exposed between the gripper portion 14f of the upper frame 14 and a gripper portion 15*k* of the lower frame 15. Therefore, when a new process cartridge B is used, the operator pulls a protruded portion of the tear tape 27 exposed between the gripper portions 14*f*, 15*k* to peel the tear tape 27 from the cover film 28 so as to open the opening 12*a*1, thus permitting the movement of the toner in the toner reservoir 12*a* toward the developing sleeve 12*d*. Thereafter, the process cartridge is mounted within the image forming system A.

As mentioned above, by exposing the tear tape 27 between the gripper portions 14*f*, 15*k* of the upper and lower frames 14, 15, the tear tape 27 can easily be exposed from the process cartridge in assembling the upper and lower frames 14, 15. The gripper portions 14*f*, 15*k* are utilized when the process cartridge B is mounted within the image forming system. Thus, if the operator forgets to remove the tear tape 27 before the process cartridge is mounted within the image forming system, since he must grip the gripper portions in mounting the process cartridge, he will know the existence of the non-removed tear tape 27. Further, when the color of the tear tape 27 is clearly differentiated from the color of the frames 14, 15 (for example, if the frames are black, a white or yellow tear tape 27 is used), the noticeability is improved, thus reducing the missing of the removal of the tear tape.

Figure 47:
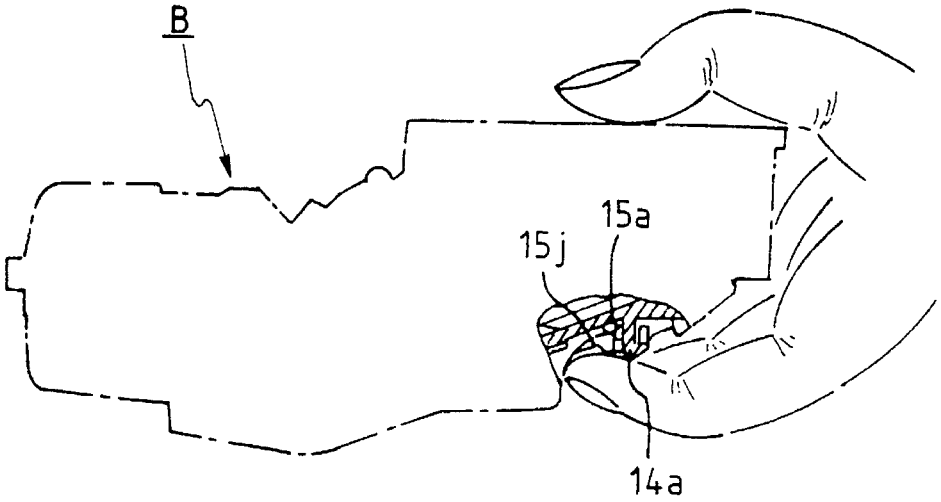
FIG. 47 is a schematic view showing a condition that the process cartridge is gripped by an operator's hand.

Further, for example, when a U-shaped guide rib for temporarily holding the tear tape 27 is provided on the gripper portion 14*f* of the upper frame 14, it is possible to surely and easily expose the tear tape 27 at a predetermined position during the interconnection between the upper and lower frames 14, 15. Incidentally, when the process cartridge B is assembled by interconnecting the upper and lower frames 14, 15, since the recess 15*j* for receiving the registration roller 5*c*2 is formed in the outer surface of the lower frame 15, as shown in FIG. 47, the operator can surely grip the process cartridge B by inserting his fingers into the recess 15*j*. Further, in the illustrated embodiment, as shown in FIG. 15, slip preventing ribs 14*i* are formed on the process cartridge B so that the operator can easily grip the process cartridge by hooking his fingers against the ribs. Incidentally, since the recess for receiving (preventing the contact with) the registration roller 5*c*2 is formed in the lower frame 15 of the process cartridge B, it is possible to make the image forming system more small-sized.

Further, as shown in FIG. 15 since the recess 15*j* is formed along and in the vicinity of the locking pawls 14*a* and the locking openings 15*b* through which the upper and lower frames 14, 15 are interconnected, when the operator grips the process cartridge B by hooking his fingers against the recess 15*j*, the gripping force from the operator acts toward the locking direction, thus surely interlocking the locking pawls 14*a* and the locking openings 15*b*.

Figure 48A:
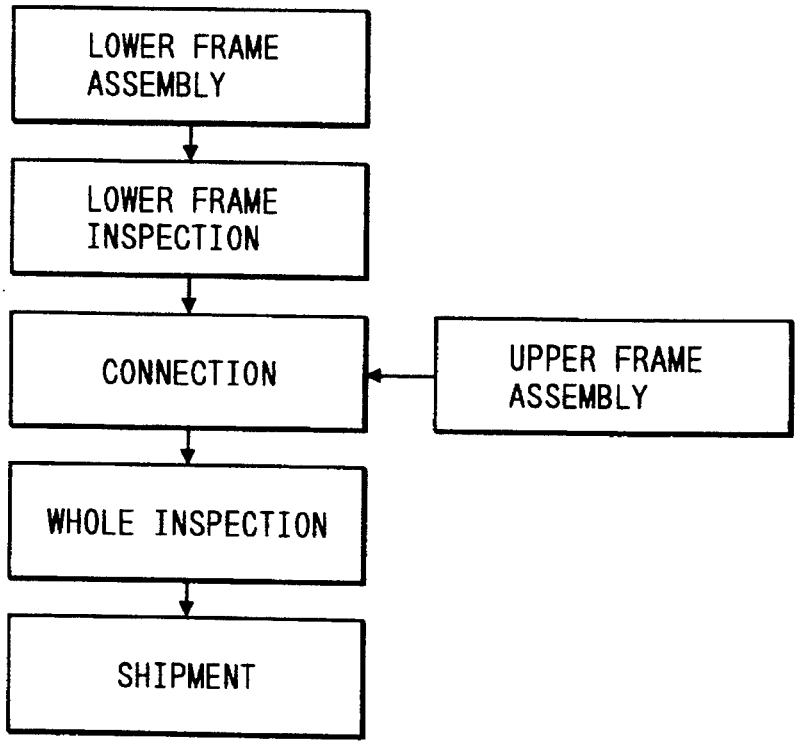
FIG. 48A is a flow chart showing the assembling and shipping line for the process cartridge.

Now, the assembling and shipping sequence for the process cartridge B will be explained with reference to FIG. 48A. As shown, the various parts are assembled in the lower frame 15, and then, the lower frame into which the various parts are incorporated is checked (for example, the positional relation between the photosensitive drum 9 and the developing sleeve 12*d* is checked). Then, the lower frame 15 is interconnected to the upper frame 14 within which the parts such as the charger roller 10 are assembled, thereby forming the process cartridge B. Thereafter, the total check of the process cartridge B is effected, and then the process cartridge is shipped. Thus, the assembling and shipping sequence is very simple.

(Mounting of Cartridge)

Next, the construction for mounting the process cartridge B within the image forming system A will be explained.

Figure 49:
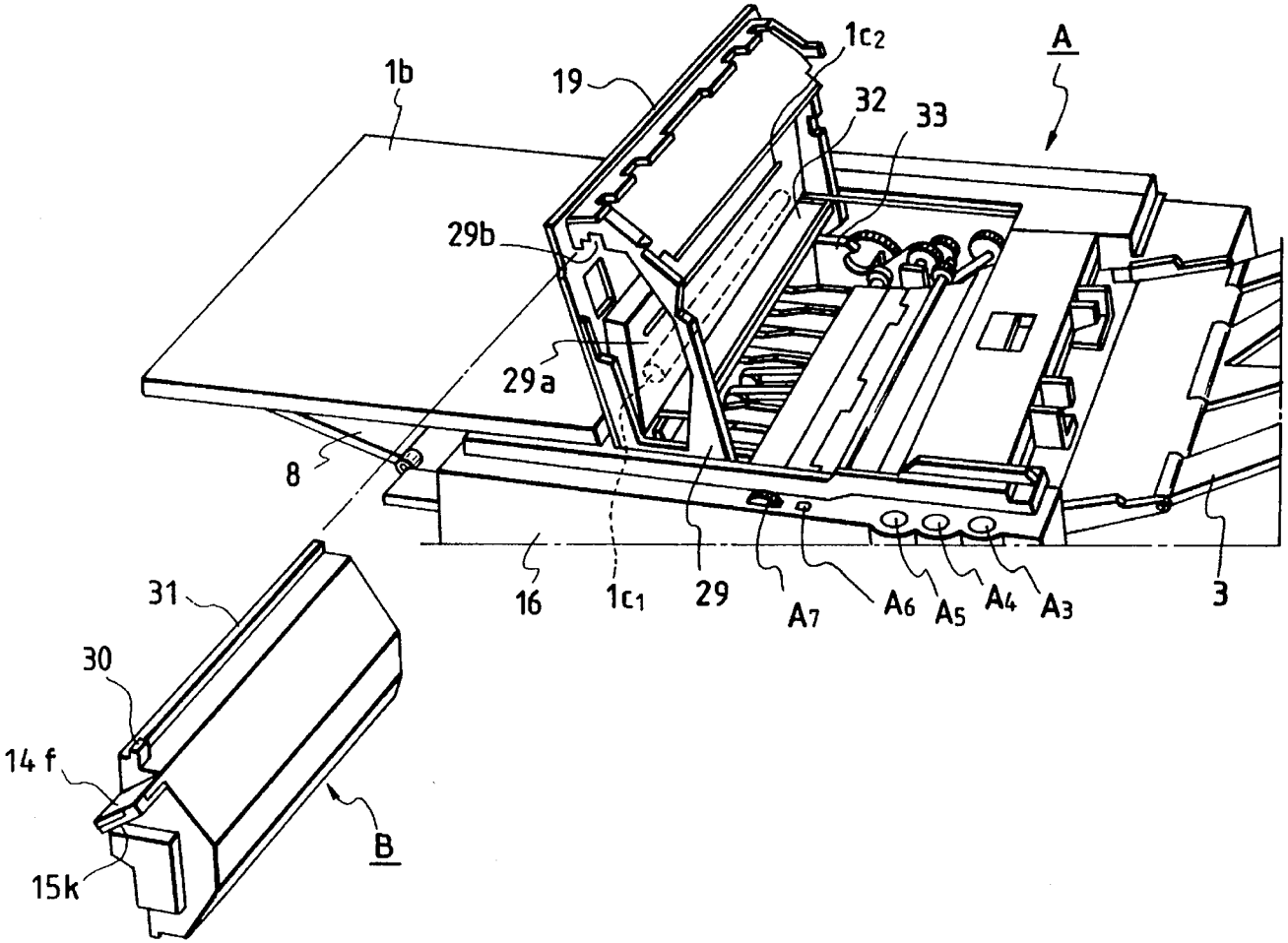
FIG. 49 is a perspective view showing a condition that the process cartridge is being mounted within the image forming system.

As shown in FIG. 49, a loading member 29 having a fitting window 29*a* matched to the contour of the process cartridge B is provided on the upper opening/closing cover 19 of the image forming system A. The process cartridge B is inserted into the image forming system through the fitting window 29*a* by gripping the gripper portions 14*f*, 15*k*. In this case, a guide ridge 31 formed on the process cartridge B is guided by a guide groove (not numbered) formed in the cover 19 and the lower portion of the process cartridge is guided by a guide plate 32 having a hook at its free end.

Figure 50:
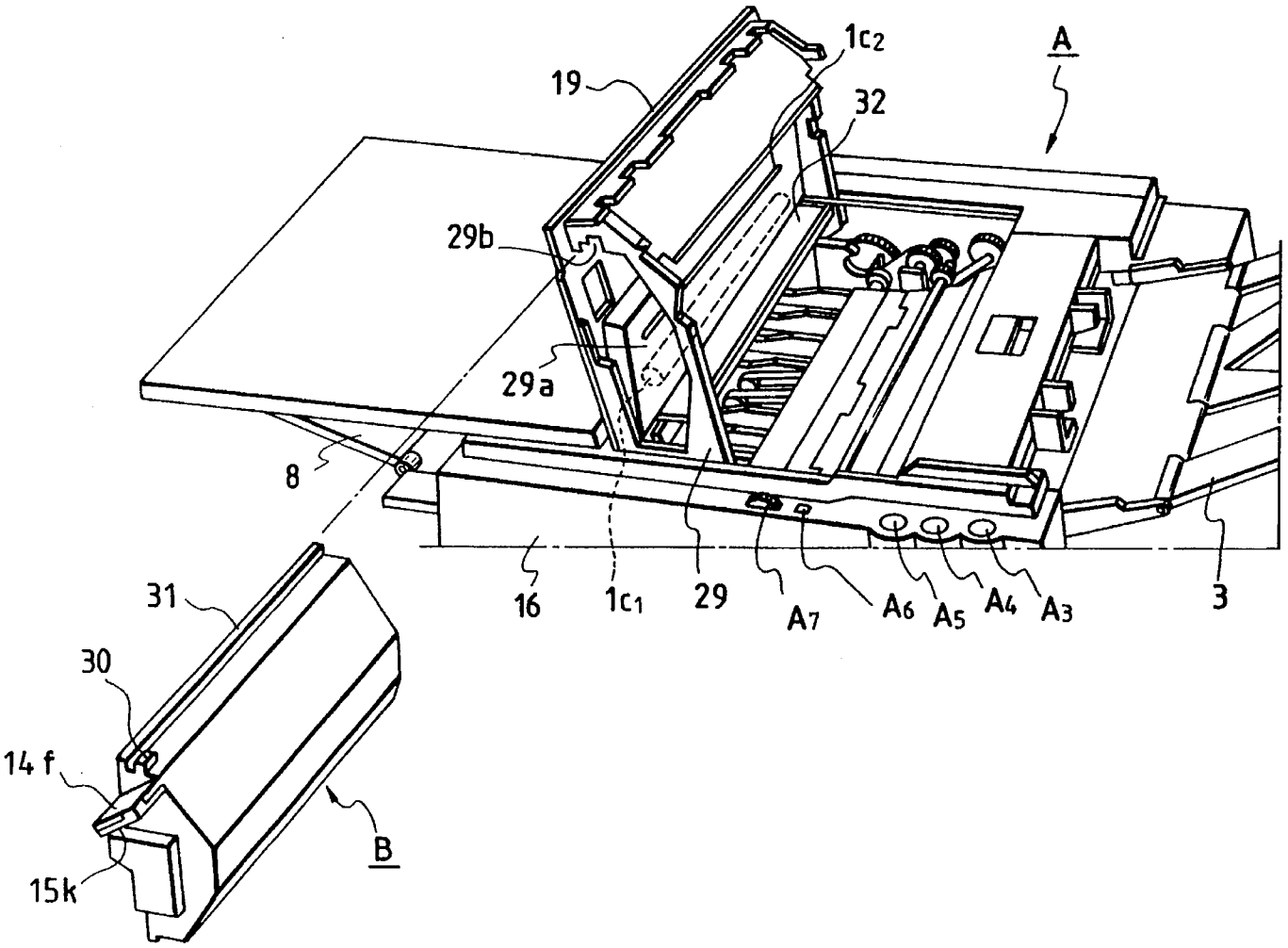
FIG. 50 is a perspective view showing a condition that the process cartridge of FIG. 24 is being mounted within the image forming system.

Incidentally, as shown in FIG. 49, a miss-mount preventing projection 30 is formed on the process cartridge B and the fitting window 29*a* has a recess 29*b* for receiving the projection 30. As shown in FIGS. 49 and 50, the configuration or position of the projection 30 is differentiated depending upon a particular process cartridge containing the toner having the developing sensitivity suitable to a particular image forming system (i.e. differentiated for each process cartridge), so that, even when a process cartridge containing the toner having the different developing sensitivity is tried to be mounted within the particular image forming system, since the projection 30 does not match with the fitting window 29*a* of that image forming system, it cannot be mounted within that image forming system. Accordingly, the miss-mounting of the process cartridge B can be prevented, thus preventing the formation of the obscure image due to the different developing sensitive toner. Incidentally, it is also possible to prevent the miss-mounting of a process cartridge including a different kind of photosensitive drum, as well as the different developing sensitivity. Further, since the recess 29*b* and the projection 30 are situated this side when the process cartridge is mounted, if the operator tries to erroneously mount the process cartridge within the image forming system, he can easily ascertain with his eyes the fact that the projection 30 is blocked by the filling member 29. Thus, the possibility that the operator will forcibly push the process cartridge into the image forming system to damage the process cartridge B and/or the image forming system A as in the conventional case can be avoided.

After the process cartridge B is inserted into the fitting window 29*a* of the opening/closing cover 19, when the cover 19 is closed, the rotary shaft 9*f* of the photosensitive drum 9 which is protruded from one side of the upper and lower frames 14, 15 is supported by a shaft support member 33 (FIG. 49) via a bearing 46*a*, and the rotary shaft 12*d*2 of the developing sleeve 12*d* which is protruded from one side of the upper and lower frames 14, 15 is supported by the shaft support member 33 via a slide bearing 46*b* and a bearing 46*c* (FIG. 44). On the other hand, the drum shaft portion 26*d* (FIG. 44) of the bearing member 26 attached to the other end of the photosensitive drum 9 is supported by a shaft support member 34 shown in FIG. 51.

In this case, the protection cover 22 is rotated to expose the photosensitive drum 9, with the result that the photosensitive drum 9 is contacted with the transfer roller 6 of the image forming system A. Further, the drum earthing contact 18*a* contacting the photosensitive drum 9, the developing bias contact 18*b* contacting the developing sleeve 12*d* and the charging bias contact 18*c* contacting the charger roller 10 are provided on the process cartridge B so that these contacts protrude from the lower surface of the lower frame 15, and these contacts 18*a*, 18*b*, 18*c* are urgingly contacted with the drum earthing contact pin 35*a*, developing bias contact pin 35*b* and charging bias contact pin 35*c* (FIG. 51), respectively.

Figure 51:
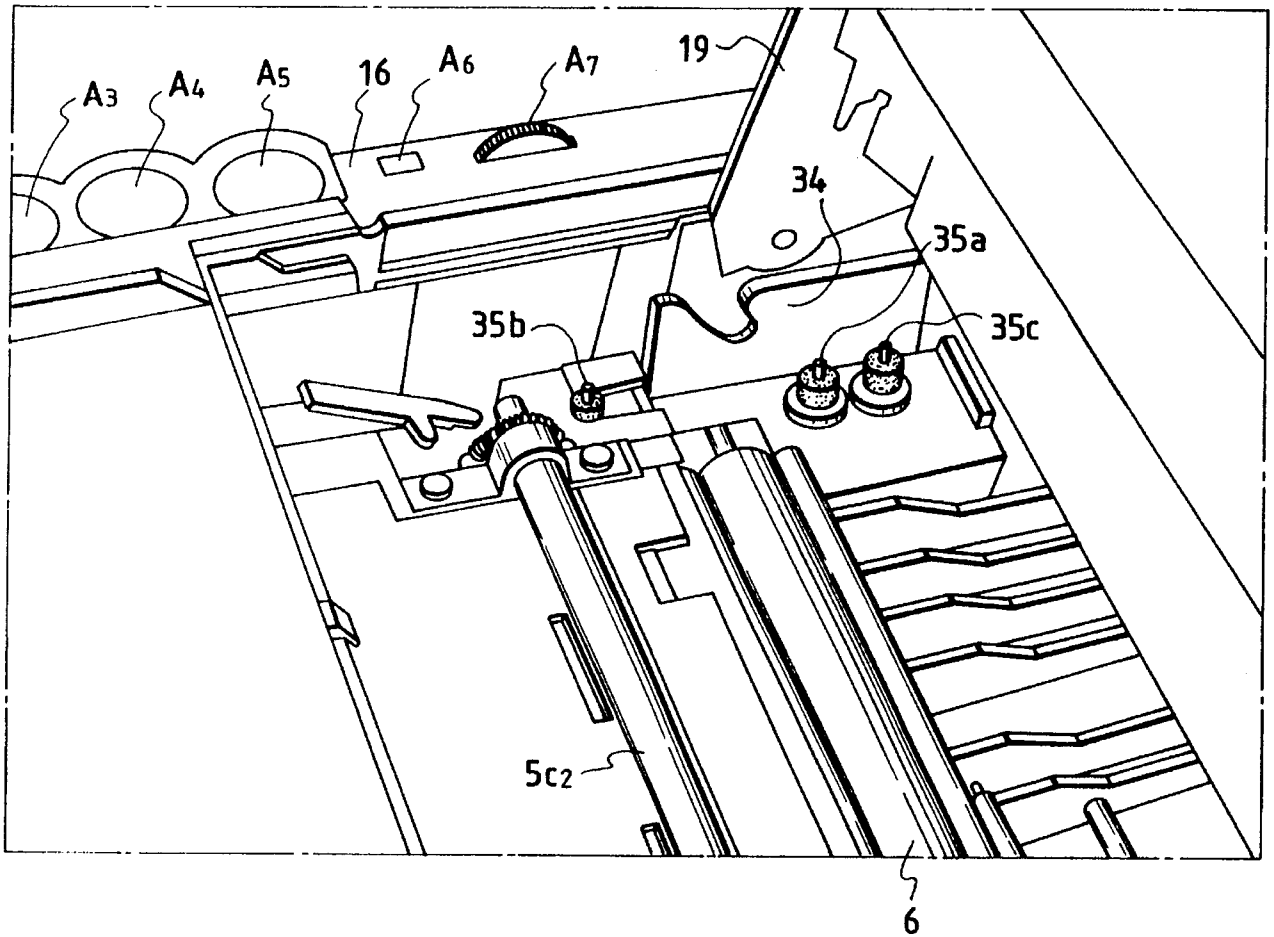
FIG. 51 is a perspective view showing the arrangement of three contacts provided on the image forming system.
Figure 52A:
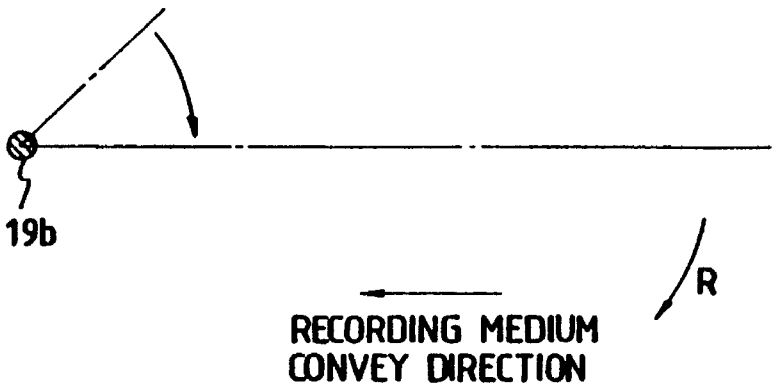
FIG. 52 is a sectional view showing the construction of the three contacts.

As shown in FIG. 51, these contact pins 35*a*, 35*b*, 35*c* are arranged so that the drum earthing contact pin 35*a* and the charging bias contact pin 35*c* are disposed at a downstream side of the transfer roller 6 in the recording medium feeding direction and the developing bias contact pin 35*b* is disposed at an upstream side of the transfer roller 6 in the recording medium feeding direction. Accordingly, as shown in FIGS. 52A and B, the contacts 18*a*, 18*b*, 18*c* provided on the process cartridge B are similarly arranged so that the drum earthing contact 18a and the charging bias contact 18*c* are disposed at a downstream side of the photosensitive drum 9 in the recording medium feeding direction and the developing bias contact 18*b* is disposed at an upstream side of the photosensitive drum 9 in the recording medium feeding direction.

Now, the disposition of the electric contacts of the process cartridge B will be explained with reference to FIG. 60. Incidentally, FIG. 60 is a schematic plan view showing the positional relation between the photosensitive drum 9 and the electric contacts 18*a*, 18*b*, 18*c*.

Figure 60:
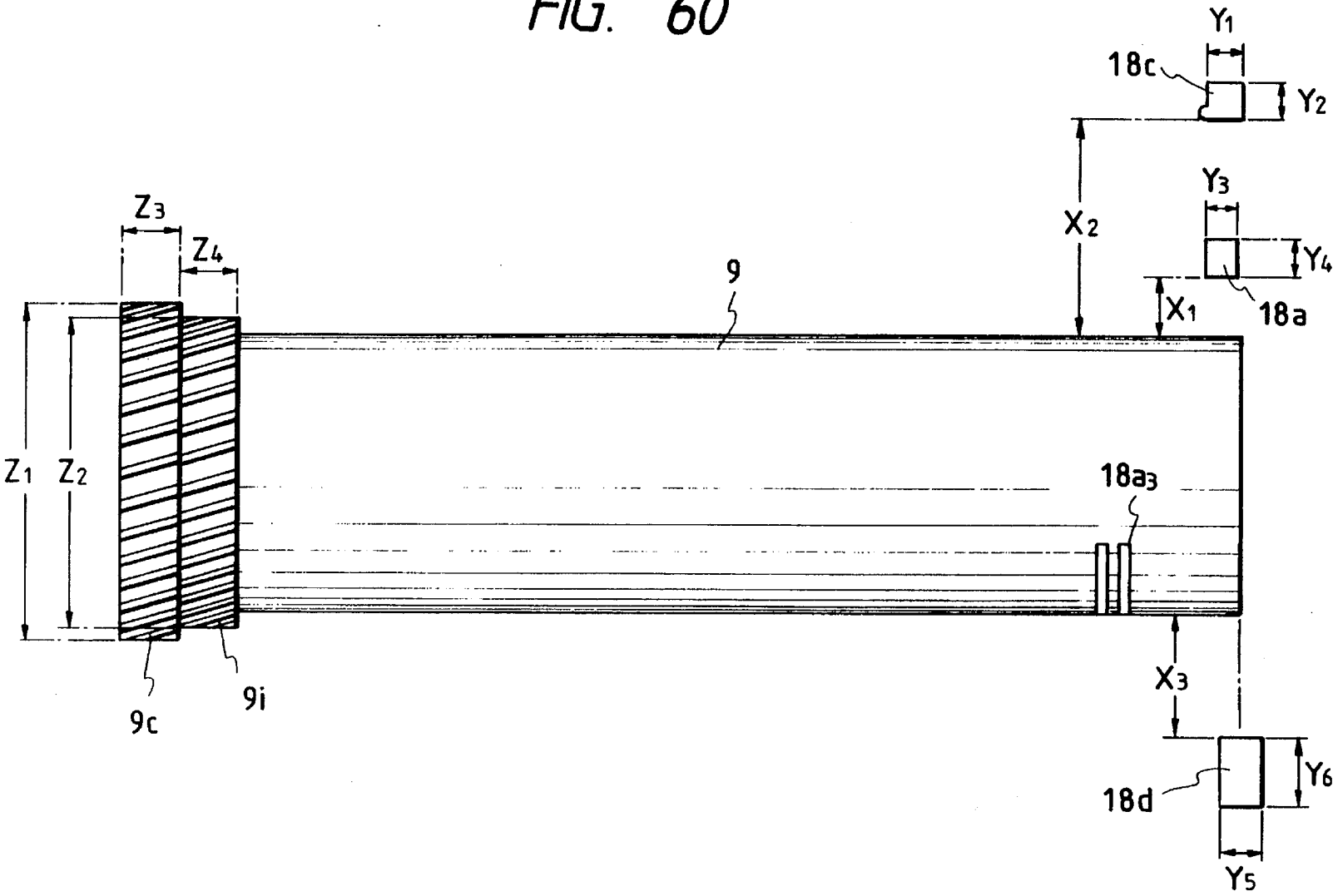
FIG. 60 is a view showing gears and contacts attached to the photosensitive drum.

As shown in FIG. 60, the contacts 18*a*, 18*b*, 18*c* are disposed at the end of the photosensitive drum 9 opposite to the end where the flange gear 9*c* is arranged in the longitudinal direction of the drum. The developing bias contact 18*b* is disposed at one side of the photosensitive drum 9 (i.e. side where the developing means 12 is arranged), and the drum earthing contact 18*a* and the charging bias contact 18*c* are disposed at the other side of the photosensitive drum (where the cleaning means 13 is arranged). The drum earthing contact 18*a* and the charging bias contact 18*c* are substantially arranged on a straight line. Further, the developing bias contact 18*b* is arranged slightly outwardly of the positions of the drum earthing contact 18*a* and the charging bias contact 18*c* in the longitudinal direction of the photosensitive drum 9. The drum earthing contact 18*a*, the developing bias contact 18*b* and the charging bias contact 18*c* are spaced apart from the outer peripheral surface of the photosensitive drum 9 gradually in order (i.e. a distance between the contact 18*a* and the drum is smallest, and a distance between the contact 18*c* and the drum is greatest). Further, an area of the developing bias contact 18*b* is greater than an area of the drum earthing contact 18*a* and an area of the charging bias contact 18*c*. Furthermore, the developing bias contact 18*b*, the drum earthing contact 18*a* and the charging bias contact 18*c* are disposed outwardly of a position where the arm portions 18*a*3 of the drum earthing contact 18*a* are contacted with the inner surface of the photosensitive drum 9, in the longitudinal direction of the photosensitive drum 9.

As mentioned above, by arranging the electric contacts between the process cartridge (which can be mounted within the image forming system) and the image forming system at the positioning and abutting side of the process cartridge, it is possible to improve the positional accuracy between the contacts of the process cartridge and the contact pins of the image forming system, thereby preventing the poor electrical connection, and, by arranging the contacts at the non-driving side of the process cartridge, it is possible to make the configurations of the contact pins of the image forming system simple and small-sized.

Further, since the contacts of the process cartridge are disposed inside of the contour of the frames of the process cartridge, it is possible to prevent foreign matters from adhering to the contacts, and, thus, to prevent the corrosion of the contacts; and further to prevent the deformation of the contacts due to the external force. Further, since the developing bias contact 18*b* is arranged at the side of the developing means 12 and the drum earthing contact 18*a* and the charging bias contact 18*c* are arranged at the side of the cleaning means 13, the arrangement of electrodes in the process cartridge can be simplified, thus making the process cartridge small-sized.

Now, dimensions of various parts in the illustrated embodiment will be listed below. However, it should be noted that these dimensions are merely an example, and the present invention is not limited to this example:

(1) Distance (X1) between the photosensitive drum

-continued 9 and the drum earthing contact 18a about 6.0 mm;
(2) Distance (X2) between the photosensitive drum, 9 and the charging bias contact 18c about 18.9 Em;
(3) Distance (X3) between the photosensitive drum 9 and the developing bias contact 18b about 13.5 m;
(4) Width (Y1) of the charging bias contact 18c about 4.9 mm;
(5) Length (Y2) of the charging bias contact 18c about 6.5 mm;
(6) Width (Y3) of the drum earthing contact 18a about 5.2 mm;
(7) Length (Y4) of the drum earthing contact 18a about 5.0 mm;
(8) Width (Y5) of the developing bias contact 18a about 7.2 mm;
(9) Length (Y6) of the developing bias contact 18a about 8.0 mm
(10) Diameter (Z1) of the flange gear 9c about 28.6 mm;
(11) Diameter (Z2) of the gear 9i about 26.1 mm;
(12) Width (Z3) of the flange gear 9c about 6.7 mm;
(13) Width (Z3) of the gear 9i about 4.3 mm;
(14) Number of teeth of the flange gear 9c 33; and
(15) Number of teeth of the gear 9i 30.

Now, the flange gear 9c and the gear 9i will be explained. The gears 9c, 9i comprise helical gears. When the driving force is transmitted from the image forming system to the flange gear 9c, the photosensitive drum 9 mounted in the lower frame 15 with play is subjected to the thrust force to be shifted toward the flange gear 9c, thereby positioning the drum at the side of the lower frame 15.

The gear 9c is used with a process cartridge containing the magnetic toner for forming a black image. When the black image forming cartridge is mounted within the image forming system, the gear 9c is meshed With a gear of the image forming system to receive the driving force for rotating the photosensitive drum 9 and is meshed with a gear of the developing sleeve 12d to rotate the latter. The gear 9i is meshed with a gear connected to the transfer roller 6 of the image forming system to rotate the transfer roller. In this case, the rotational load does not act on the transfer roller 6.

Incidentally, the gear 9i is used with a color image forming cartridge containing the non-magnetic toner. When the color image forming cartridge is mounted within the image forming system, the gear 9c is meshed with the gear of the image forming system to receive the driving force for rotating the photosensitive drum 9. On the other hand, the gear 9i is meshed with the gear connected to the transfer roller 6 of the image forming system to rotate the transfer roller and is meshed with the gear of the developing sleeve 12d for the non-magnetic toner to rotate the latter. The flange gear 9c has a diameter greater than that of the gear 9i, a width greater than that of the gear 9i and a number of teeth greater than that of the gear 9i. Thus, even when the greater load is applied to the gear 9c, the gear 9c can receive the driving force to rotate the photosensitive drum 9 more surely and can transmit the greater driving force to the developing sleeve 12d for the magnetic toner to rotate the latter more surely.

Figure 52B:
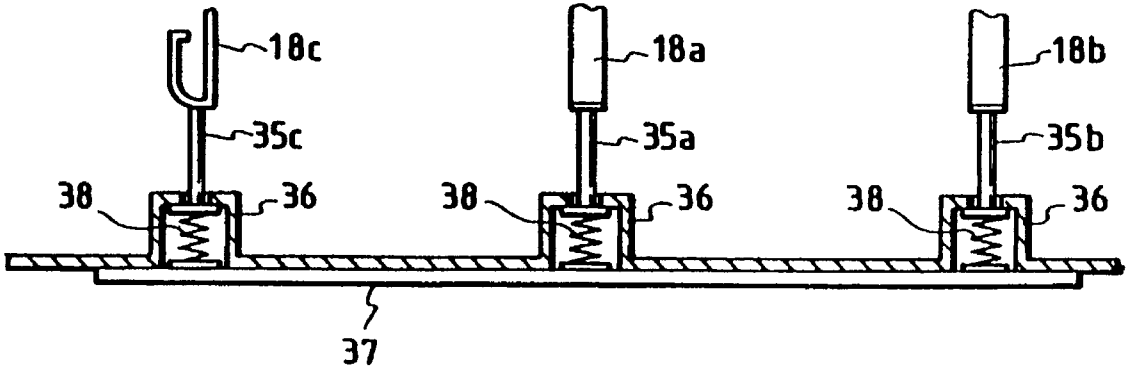

Incidentally, as shown in FIGS. 52A and 52B, each of the contact pins 35a–35c is held in a corresponding holder cover 36 in such a manner that it can be shifted in the holder cover but cannot be detached from the holder cover. Each contact pin 35a–35c is electrically connected to a wiring pattern printed on an electric substrate 37 to which the holder covers 36 are attached, via a corresponding conductive compression spring 38. Incidentally, the charging bias contact 18c to be abutted against the contact pin 35c has the arcuated curvature in the vicinity of the pivot axis 19b of the upper opening/closing cover 19, with the process cartridge B mounted thereon so that, the opening/closing cover 19 is rotated around the pivot axis 19b in a direction shown by the arrow R to close the cover, and in so doing the charging bias contact 18c nearest to the pivot axis 19b (i.e. having the minimum stroke) can contact with the contact pin 35c effectively.

(Positioning)

When the process cartridge B is mounted and the opening/closing cover 19 is closed, the positioning is established so that a distance between the photosensitive drum 9 and the lens unit 1c and a distance between the photosensitive drum 9 and the original glass support 1a are kept constant. Such positioning will now be explained.

As shown in FIG. 17, positioning projections 15m are formed on the lower frame 15 to which the photosensitive drum 9 is attached, in the vicinity of both longitudinal ends of the frame. As shown in FIG. 14, when the upper and lower frames 14, 15 are interconnected, these projections 15m protrude upwardly through holes 14g formed in the upper frame 14.

Figure 53:
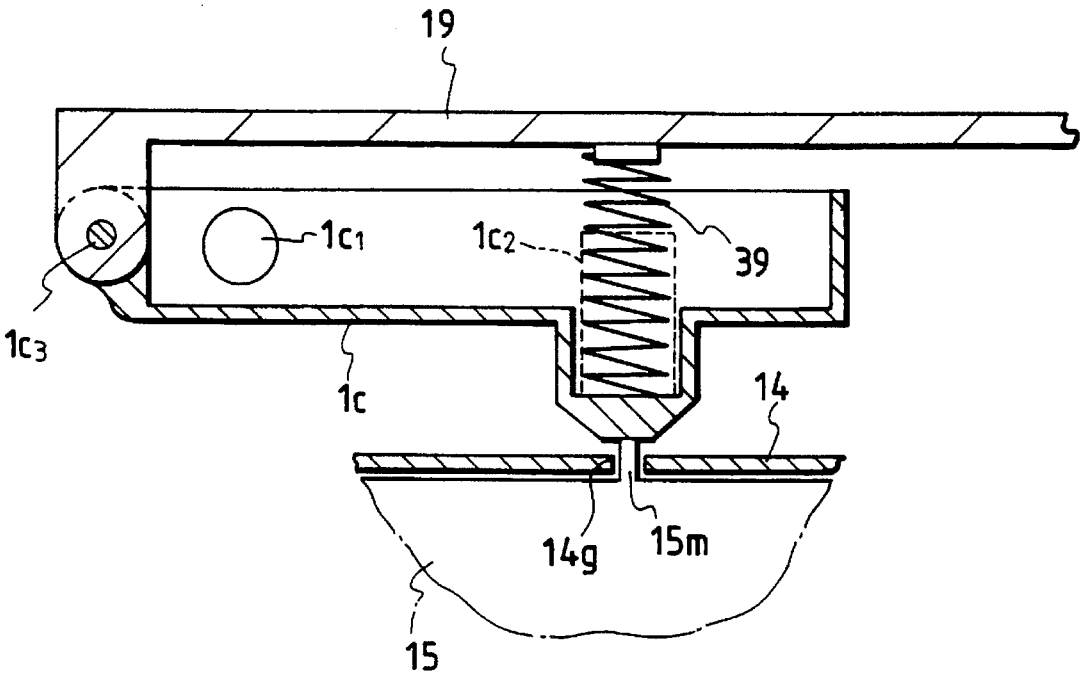
FIG. 53 is a sectional view for explaining the relative positioning between the lower frame and a lens unit.

Further, as shown in FIG. 53, the lens unit 1c containing therein the lens array 1c2 for reading the original 2 is attached to the upper opening/closing cover 19 (on which the process cartridge B is mounted) via a pivot pin 1c3 for slight pivotal movement around the pivot pin and is biased downwardly (FIG. 53) by an urging spring 39. Thus, when the process cartridge B is mounted on the upper cover 19 and the latter is closed, as shown in FIG. 53, the lower surface of the lens unit 1c is abutted against the positioning projections 15m of the process cartridge B. As a result, when the process cartridge B is mounted within the image forming system A, the distance between the lens array 1c2 in the lens unit 1c and the photosensitive drum 9 mounted on the lower frame 15 is accurately determined, so that the light image optically read from the original 2 can be accurately illuminated onto the photosensitive drum 9 via the lens array 1c2.

Figure 54:
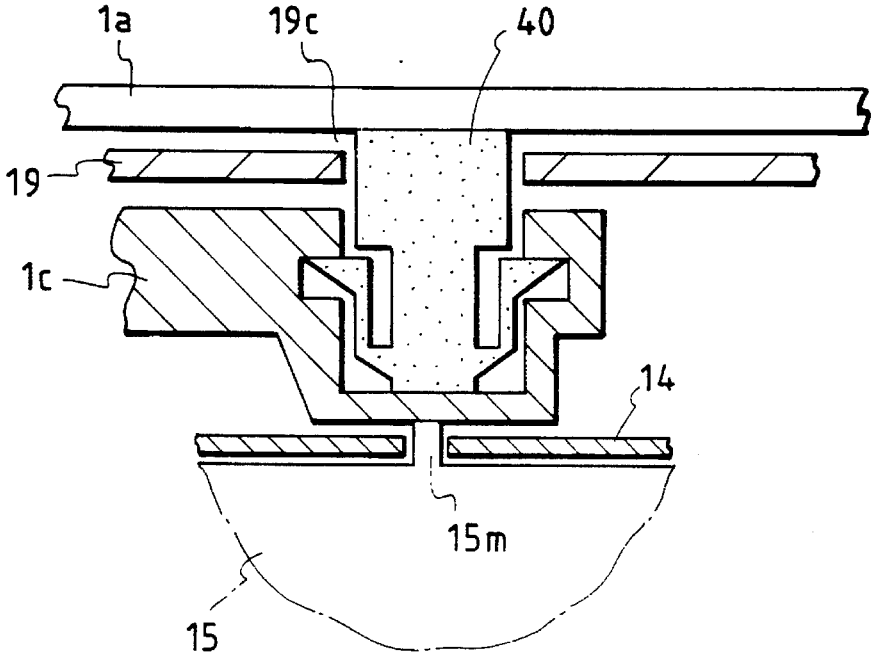
FIG. 54 is a sectional view for explaining the relative positioning between the lower frame and an original glass support.
Figure 55:
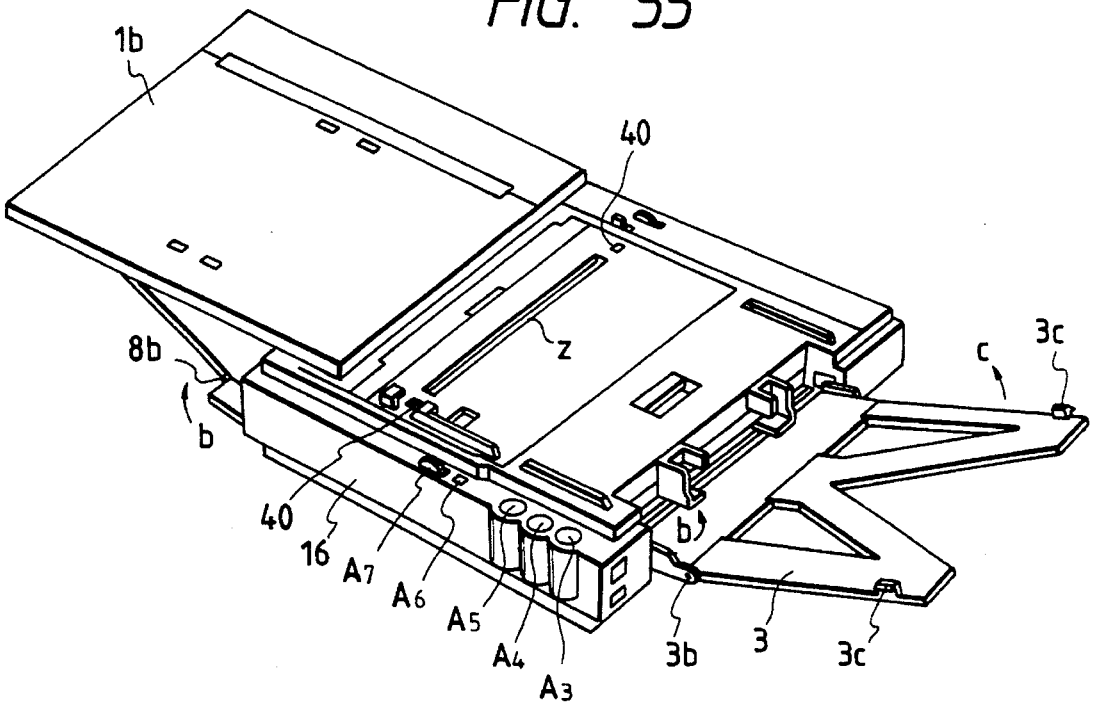
FIG. 55 is a perspective view showing the attachment positions of positioning pegs.

Further, as shown in FIG. 54, positioning pegs 40 are provided in the lens unit 1c, which positioning pegs can be protruded slightly from the upper cover 19 upwardly through holes 19c formed in the upper cover. As shown in FIG. 55, the positioning pegs 40 are protruded slightly at both longitudinal sides of an original reading slit Z (FIGS. 10 and 55). Thus, when the process cartridge B is mounted on the upper cover 19 and the latter is closed and then the image forming operation is started, as mentioned above, since the lower surface of the lens unit 1c is abutted against the positioning projections 15m, the original glass support 1a is shifted while riding on the positioning pegs 40. As a result, a distance between the original 2 rested on the original glass support 1a and the photosensitive drum 9 mounted on the lower frame 15 is always kept constant, thus illuminating the light reflected from the original 2 onto the photosensitive drum 9 accurately. Therefore, since the information written on the original 2 can be optically read accurately and the exposure to the photosensitive drum 9 can be effected accurately, it is possible to obtain a high quality image.

(Drive Transmission)

Next, the driving force transmission to the photosensitive drum 9 in the process cartridge B mounted within the image forming system A will be explained.

Figure 56:
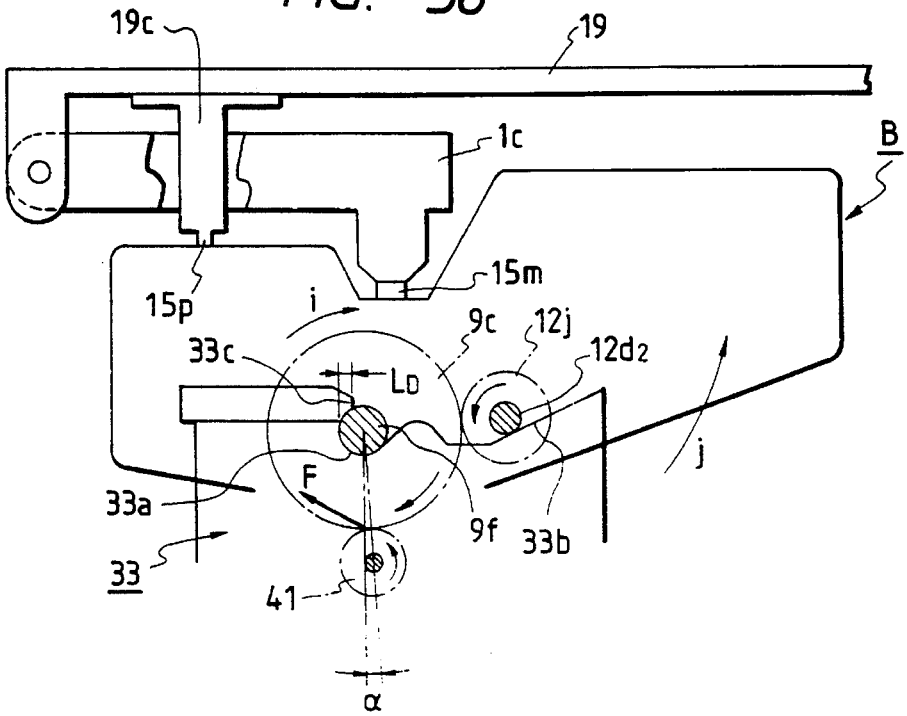
FIG. 56 is a schematic elevational view showing the relation between rotary shafts of the drum and of the sleeve and shaft supporting members therefor, and a transmitting direction of a driving force from a drive gear to a flange gear of the photosensitive drum.

When the process cartridge B is mounted within the image forming system A, the rotary shaft 9f of the photosensitive drum 9 is supported by the shaft support member 33 of the image forming system as mentioned above. As shown in FIG. 56, the shaft support member 33 comprises a supporting portion 33*a* for the drum rotary shaft 9*f*, and an abutment portion 33*b* for the rotary shaft 12*d*2 of the developing sleeve 12*d*. An overlap portion 33*c* having a predetermined overhanging amount L (1.8 mm in the illustrated embodiment) is formed on the supporting portion 33*a*, thus preventing the drum rotary shaft 9*f* from floating upwardly. Further, when the drum rotary shaft 9*f* is supported by the supporting portion 33*a*, the rotary shaft 12*d*2 of the developing sleeve is abutted against the abutment portion 33*b*, thus preventing the rotary shaft 12*d*2 from dropping downwardly. Further, when the upper opening/closing cover 19 is closed, positioning projections 15*p* of the lower frame 15 protruding from the upper frame 14 of the process cartridge B are abutted against an abutment portion 19*c* of the opening/closing cover 19.

Accordingly, when the driving force is transmitted to the flange gear 9*c* of the photosensitive drum 9 by driving the drive gear 41 of the image forming system meshed with the flange gear, the process cartridge B is subjected to a reaction force tending to rotate the process cartridge around the drum rotary shaft 9*f* in a direction shown by the arrow i in FIG. 56. However, since the rotary shaft 12*d*2 of the developing sleeve is abutted against the abutment portion 33*b* and the positioning projections 15*p* of the lower frame 15 protruding from the upper frame 14 are abutted against the abutment portion 19*c* of the upper cover, the rotation of the process cartridge B is prevented.

As mentioned above, although the lower surface of the lower frame 15 acts as the guide for the recording medium 4, since the lower frame is positioned by abutting it against the body of the image forming system as mentioned above, the positional relation between the photosensitive drum 9, the transfer roller 6 and the guide portions 15*h*1, 15*h*2 for the recording medium 4 is maintained with high accuracy, thus performing the feeding of the recording medium and the image transfer with high accuracy.

During the driving force transmission, the developing sleeve 12*d* is biased downwardly now only by the rotational reaction force acting on the process cartridge B but also by a reaction force generated when the driving force is transmitted from the flange gear 9*c* to the sleeve gear 12*j*. In this case, if the rotary shaft 12*d*2 of the developing sleeve is not abutted against the abutment portion 33*b*, the developing sleeve 12d will be always biased downwardly during the image forming operation. As a result, it is feared that the developing sleeve 12*d* will be displaced downwardly and/or the lower frame 15 on which the developing sleeve 12*d* will be mounted is deformed. However, in the illustrated embodiment, since the rotary shaft 12*d*2 of the developing sleeve is abutted against the aboutment portion 33*b* without fail, the above-mentioned inconvenience does not occur.

Figure 57:
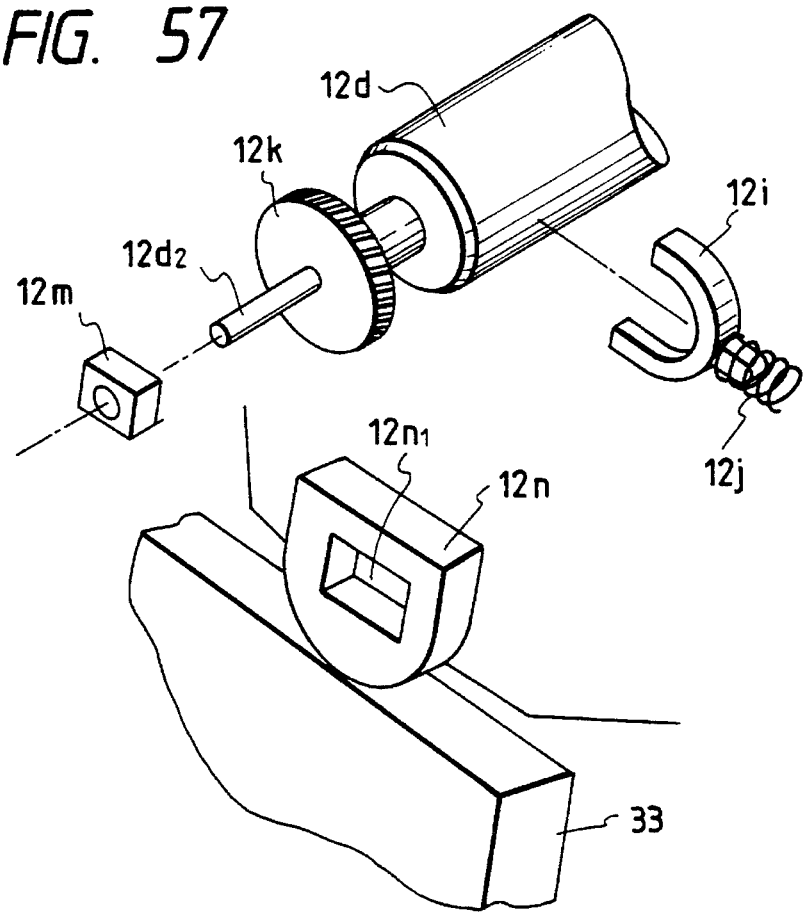
FIG. 57 is an exploded perspective view of a developing sleeve according to an embodiment wherein it can easy be slid.
Figure 58:
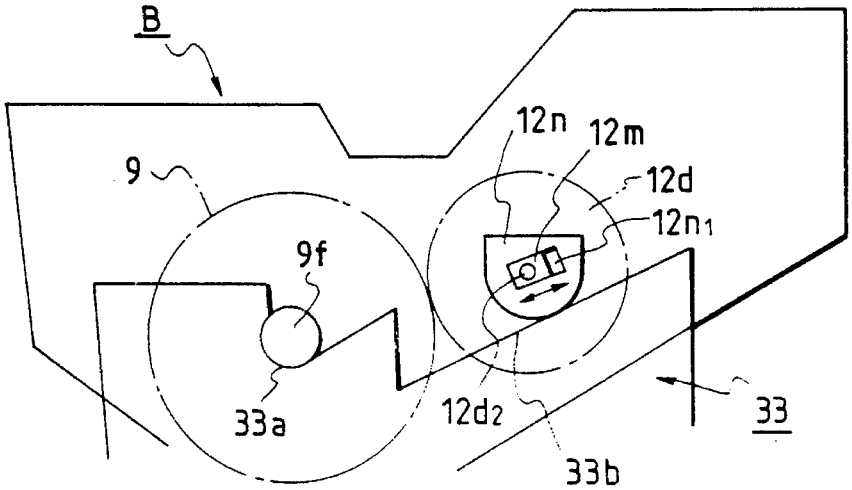
FIG. 58 is a schematic elevational view of the developing sleeve of FIG. 57.

Incidentally, as shown in FIG. 29 the developing sleeve 12*d* is biased against the photosensitive drum 9 by the springs 12*j* via the sleeve bearings 12*i*. In this case, the arrangement as shown in FIG. 57 may be adopted to facilitate the sliding movement of sleeve bearings 12*i*. That is to say, a bearing 12*m* for supporting the rotary shaft 12*d*2 of the developing sleeve is held in a bearing holder 12*n* in such a manner that the bearing 12*m* can slide along a slot 12*n*1 formed in the bearing holder. With this arrangement, as shown in FIG. 58, the bearing holder 12*n* is abutted against the abutment portion 33*b* of the shaft support member 33 and is supported thereby; in this condition, the bearing 12*m* can be slid along the slot 12*n*1 in directions shown by the arrow. Incidentally, in the illustrated embodiment, an inclined angle θ (FIG. 56) of the abutment portion 33*b* is selected to have a value of about 40 degrees.

Figure 61A:
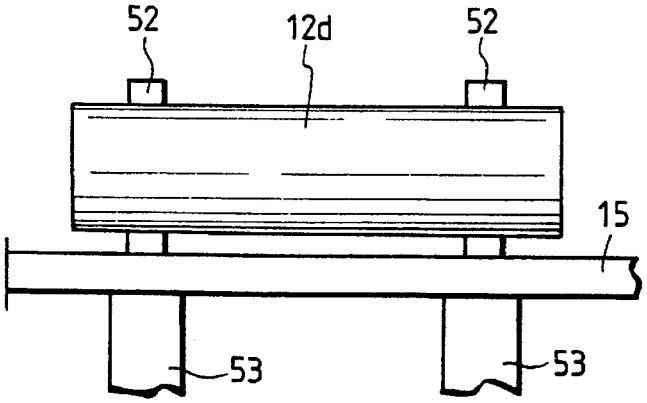
FIG. 61A is an elevational view showing a developing sleeve receiving member according to another embodiment.
Figure 61B:
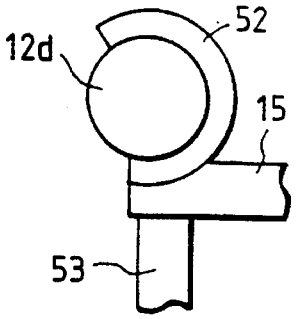
FIG. 61B is an end view of the receiving member of FIG. 61A.

Further, the developing sleeve 12*d* may be supported by means other than the sleeve rotary shaft. For example, as shown in FIGS. 61A and 61B, it may be supported at both of its ends portions by sleeve bearings 52 lower ends of which are supported by the lower frame 15 which is in turn supported by receiving portions 53 formed on the image forming system.

Further, in the illustrated embodiment, the flange gear 9*c* of the photosensitive drum 9 is meshed with the drive gear 41 for transmitting the driving force to the flange gear in such a manner that, as shown in FIG. 56, a line connecting a rotational center of the flange gear 9*c* and a rotational center of the drive gear 41 is offset from a vertical line passing through the rotational center of the flange gear 9*c* in an anti-clockwise direction by a small angle α (about 1° in the illustrated embodiment), whereby a direction F of the driving force transmission from the drive gear 41 to the flange gear 9*c* directs upwardly. In general, although the floating of the process cartridge can be prevented by a downwardly directing force generated by setting the angle α to a value of 20° or more, in the illustrated embodiment, such angle α is set to about 1°.

By setting the above-mentioned angle α to about 1°, when the upper opening/closing cover 19 is opened in a direction shown by the arrow j to remove the process cartridge B, the flange gear 9*c* is not blocked by the drive gear 41 and, thus, can be smoothly disengaged from the drive gear 41. Further, when the direction F of the driving force transmission is directed upwardly as mentioned above, the rotary shaft 9*f* of the photosensitive drum is pushed upwardly and, therefore, tends to be disengaged from the drum supporting portion 33*a*. However, in the illustrated embodiment, since the overlap portion 33*c* is formed on the supporting portion 33*a*, the drum rotary shaft 9*f* is not disengaged from the drum supporting portion 33*a*.

(Re-cycle)

The process cartridge having the above-mentioned construction permits recycling of the used-up process cartridges. That is to say, the used-up process cartridge(s) can be collected from the market and the parts thereof can be re-used to form a new process cartridge. Such re-cycle will now be explained. Generally, the used-up process cartridge was disposed or dumped in the past. However, the process cartridge B according to the illustrated embodiment can be collected from the market after the toner in the toner reservoir has been used up, to protect the resources of the earth and the natural environment. Then, the collected process cartridge is disassembled into the upper and lower frames 14, 15 which are in turn cleaned. Thereafter, reusable parts and new parts are mounted on the upper frame 14 or the lower frame 15 as needed, and then new toner is supplied into the toner reservoir 12*a* again. In this way, a new process cartridge is obtained.

Figure 59:
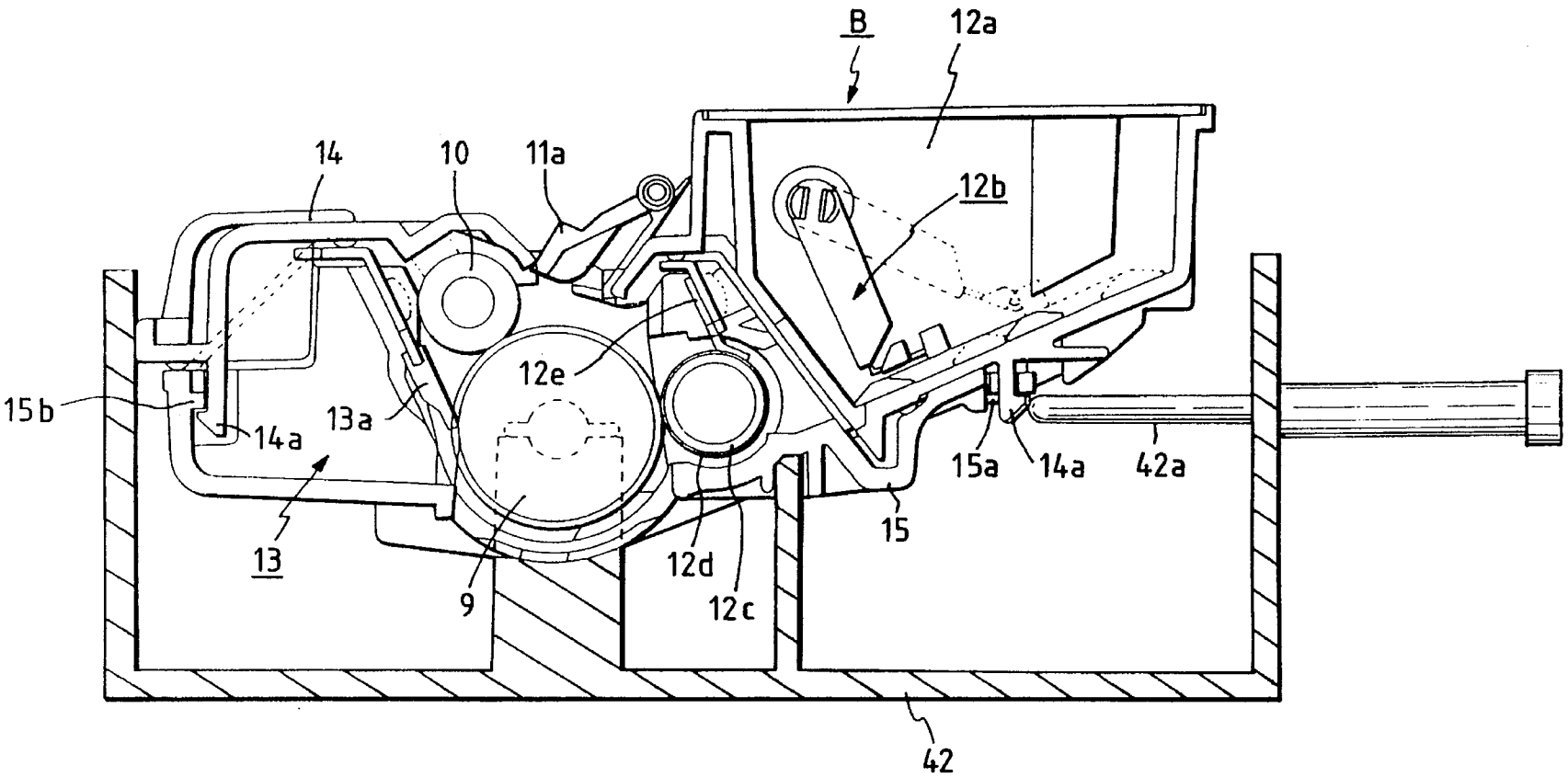
FIG. 59 is an elevational sectional view showing a condition that the upper frame and the lower frame are released.

More particularly, by releasing the connections between the locking pawls 14*a* and the locking openings 15*a*, the locking pawls 14*a* and the locking projection 15*b*, the locking pawl 14*c* and the locking opening 15*d*, and the locking pawl 15*c* and the locking opening 14*b* (FIGS. 13, 17 and 18) which interconnect the upper and lower frames 14, 15, the upper and lower frames 14, 15 can easily be disassembled from each other. Such disassembling operation can easily be performed, for example, by resting the used-up process cartridge B on a disassembling tool 42 and by pushing the locking pawl 14*a* by means of a pusher rod 42*a*, as shown in FIG. 59. Even when the disassembling tool is not used, the process cartridge can be disassembled by pushing the locking pawls 14*a*, 14*c*, 15*c*.

After the upper frame 14 and the lower frame 15 are disconnected from each other as mentioned above (FIGS. 17 and 18), the frames are cleaned by removing the waste toner adhered to or remaining in the cartridge by an air blow technique. In this case, a relatively large amount of waste toner is adhered to the photosensitive drum 9, developing sleeve 12*d* and/or cleaning means 13 since they are directly contacted with the toner. On the other hand, the waste toner is not or almost not adhered to the charger roller 10 since it is not directly contacted with the toner. Accordingly, the charger roller 10 can be cleaned more easily than the photosensitive drum 9, developing sleeve 12*d* and the like. In this regard, according to the illustrated embodiment since the charger roller 10 is mounted on the upper frame 14 rather than the lower frame 15 on which the photosensitive drum 9, developing sleeve 12*d* and cleaning means 13 are mounted, the upper frame 14 separated from the lower frame 15 can easily be cleaned.

Figure 48B:
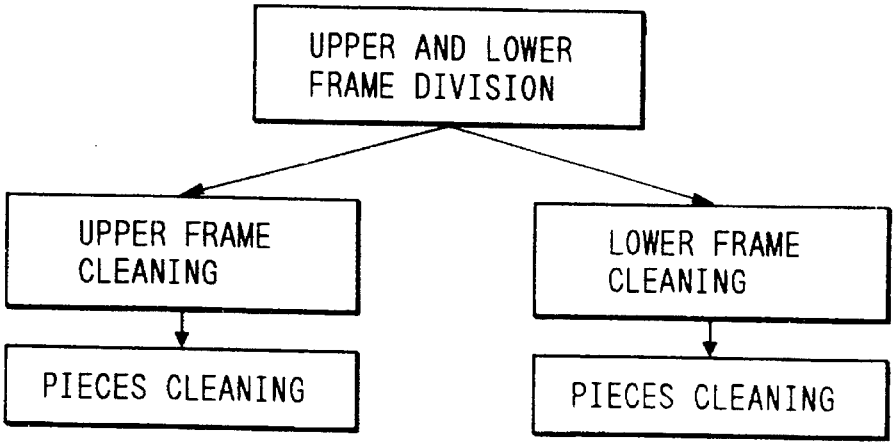
FIG. 48B is a flow chart showing the disassembling and cleaning line for the process cartridge.

In the disassembling and cleaning line as shown in FIG. 48B, first of all, the upper and lower frames 14, 15 are separated from each other as mentioned above. Then, the upper frame 14 and the lower frame 15 are disassembled and cleaned independently. Thereafter, as to the upper frame 14, the charger roller 10 is separated from the upper frame and is cleaned; and as to the lower frame 15, the photosensitive drum 9, developing sleeve 12*d*, developing blade 12*e*, cleaning blade 13*a* and the like are separated from the lower frame and are cleaned. Thus, the disassembling and cleaning sequence is very simple.

After the toner is cleared, as shown in FIG. 18, the opening 12*a*1 is sealed by a new cover film 28 again, and new toner is supplied into the toner reservoir 12*a* through the toner filling opening 12*a*3 formed in the side surface of the toner reservoir 12*a*, and then the filling opening 12*a*3 is closed by the lid 12*a*2. Then, the upper frame 14 and the lower frame 15 are interconnected again by achieving the connections between the locking pawls 14*a* and the locking openings 15*a*, the locking pawls 14*a* and the locking projection 15*b*, the locking pawl 14*c* and the locking opening 15*d*, and the locking pawl 15*c* and the locking opening 14*b*, thus assembling a process cartridge again in a usable condition.

Incidentally, when the upper and lower frames 14, 15 are interconnected, although the locking pawls 14*a* and the locking openings 15*a*, the locking pawls 14*a* and the locking projection 15*b* and the like are interlocked, when the same process cartridge is frequently re-cycled, it is feared that the locking forces between the locking pawls and the locking openings become weaker. To cope with this, in the illustrated embodiment, threaded holes are formed in the frames in the vicinity of four corners thereof. That is to say, through threaded holes are formed in the fitting recesses 14*d* and the fitting projections 14*e* of the upper frame 14 (FIG. 17) and in the fitting projections 15*e* (to be fitted into the recesses 14*d*) and the fitting recesses 15*f* (to be fitted onto the projections 14*e*) of the lower frame 15, respectively. Thus, even when the locking force due to the locking pawls become weaker, after the upper and lower frames 14, 15 are interconnected and the fitting projections and fitting recesses are interfitted, by screwing screws in the mated threaded holes, the upper and lower frames 14, 15 can be firmly interconnected.

Image forming Operation

Next, the image forming operation effected by the image forming system A within which the process cartridge B is mounted will be explained.

First of all, the original 2 is rested on the original glass support la shown in FIG. 10. Then, when the copy start button A3 is depressed, the light source 1*c*1 is turned ON and the original glass support 1*a* is reciprocally shifted on the image forming system in the left and right directions in FIG. 10 to read the information written on the original optically. In registration with the reading of the original, the sheet supply roller 5*a* and the pair of registration rollers 5*c*1, 5*c*2 are rotated to feed the recording medium 4 to the image forming station. The photosensitive drum 9 is rotated in the direction d in FIG. 10 in registration of the feeding timing of the paired registration rollers 5*c*1, 5*c*2, and is uniformly charged by the charger means 10. Then, the light image read by the reading means 1 is illuminated onto the photosensitive drum 9 via the exposure means 11, thereby forming the latent image on the photosensitive drum 9.

At the same time when the latent image is formed, the developing means 12 of the process cartridge B is activated to drive the toner feed mechanism 12*b*, thereby feeding out the toner from the toner reservoir 12*a* toward the developing sleeve 12*d* and forming the toner layer on the rotating developing sleeve 12*d*. Then, by applying to the developing sleeve 12*d* a voltage having the same charging polarity and same potential as that of the photosensitive drum 9, the latent image on the photosensitive drum 9 is visualized as the toner image. In the illustrated embodiment, the voltage of about 1.2 KWpp, 1590 Hz (rectangular wave) is applied to the developing sleeve 12*d*. The recording medium 4 is fed between the photosensitive drum 9 and the transfer roller 6. By applying to the transfer roller 6 a voltage having the polarity opposite to that of the toner, the toner image on the photosensitive drum 9 is transferred onto the recording medium 4. In the illustrated embodiment, the transfer roller 6 is made of foam EPDM having the volume resistance of about $10^9$ Ωcm and has an outer diameter of about 20 mm, and the voltage of −3.5 KV is applied to the transfer roller as the transfer voltage.

After the toner image is transferred to the recording medium, the photosensitive drum 9 continues to rotate in the direction d. Meanwhile, the residual toner remaining on the photosensitive drum 9 is removed by the cleaning blade 13*a*, and the removed toner is collected into the waste toner reservoir 13*c* via the squeegee sheet 13*b*. On the other hand, the recording medium 4 on which the toner image was transferred is sent, by the convey belt 5*d*, to the fixing means 7 where the toner image is permanently fixed to the recording medium 4 with heat and pressure. Then, the recording medium is ejected by the pair of ejector rollers 5*f*1, 5*f*2. In this way, the information on the original is recorded on the recording medium.

Next, other embodiments will be explained.

Figure 62:
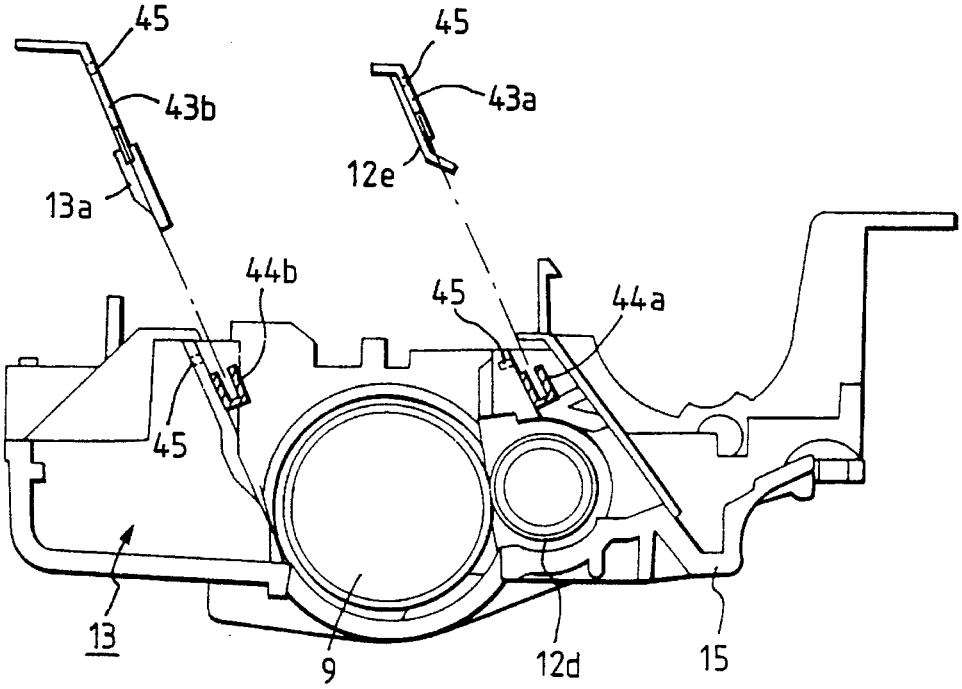
FIG. 62 is an elevational view showing an arrangement wherein the developing blade and the cleaning blade can be attached to the interior of the image forming system by pins.

In the above-mentioned first embodiment, an example whereby the developing blade 12*e* and the cleaning blade 13*a* are attached to the frame by pins 24*a*, 24*b* was explained. Alternatively, as shown in FIG. 62, the developing blade 12*e* and the cleaning blade 13*a* are attached to the lower frame 15 by forcibly inserting fitting projections 43*a*, 43*b* formed on both longitudinal ends of the developing blade 12*e* and the cleaning blade 13*e* into corresponding fitting recesses 44*a*, 44*b* formed in the body 16 of the image forming system. Pin holes 45 for receiving the pins for attaching the blades 12*e*, 13*a* may be formed in the vicinity of the fitting projections 43*a*, 43*b*, and corresponding pin holes 45 may be formed in the body 16 of the image forming system (Incidentally, in place of the fitting projections 43*a*, 43*b*, half punches or circular bosses may be used).

With this arrangement, when the fitting connections between the blades 12*e*, 13*a* and the lower frame are loosened by the repeated recycling of the process cartridge B, the blades 12*e*, 13*a* can be firmly attached to the lower frame by pins.

Figure 63:
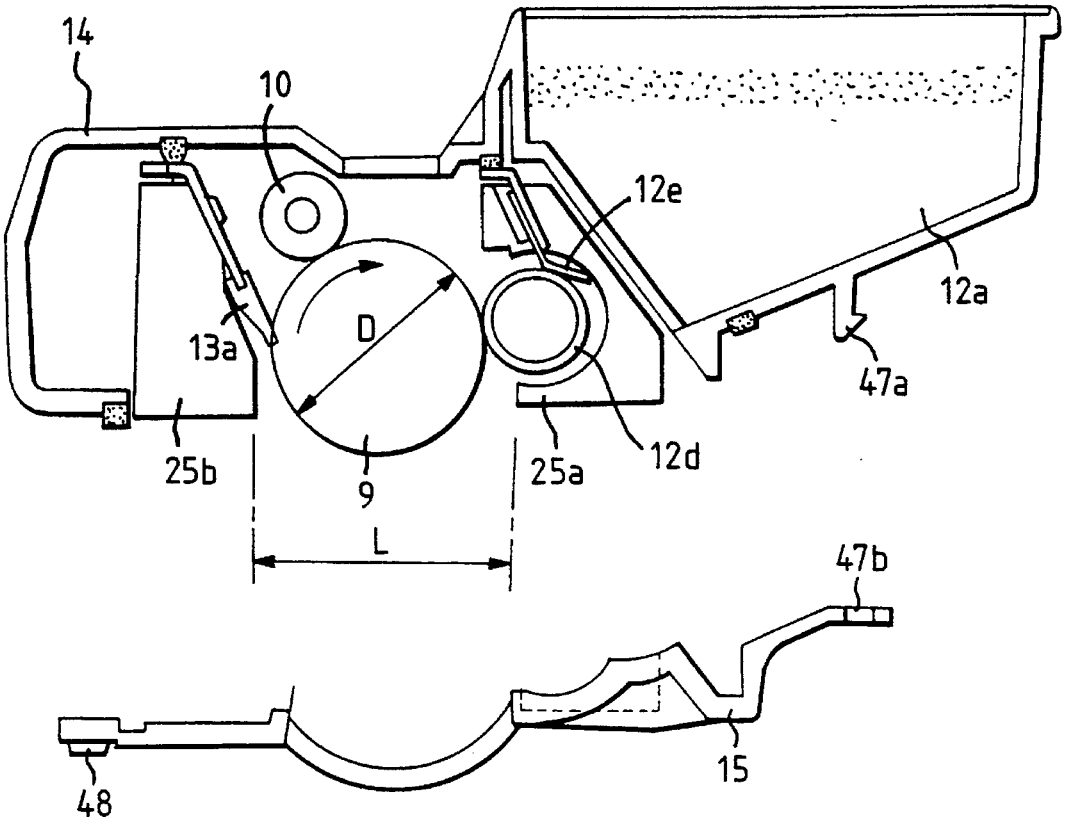
FIG. 63 is an elevational view showing a condition that the photosensitive drum is being finally assembled, according to another embodiment.

Further, in the first embodiment, as shown in FIG. 38, an example that the outer diameter D of the photosensitive drum 9 is smaller than the distance L between the drum guide members 25*a*, 25*b* to permit the final attachment of the photosensitive drum 9 to the lower frame 15 was explained. As shown in FIG. 63, even when the photosensitive drum 9 is incorporated into the upper frame 14, the outer diameter D of the photosensitive drum 9 may be smaller than the distance L between the drum guide members 25*a*, 25*b* so that the photosensitive drum can be lastly incorporated into the upper frame, thereby preventing damage to the surface of the photosensitive drum 9, as in the first embodiment. Incidentally, in FIG. 63, elements or parts having the same function as those in the first embodiment are designated by the same reference numerals. Further, the upper and lower frames 14, 15 are interconnected by interlocking locking projections 47*a* and locking openings 47*b* and by securing them by pins 48.

Figure 64:
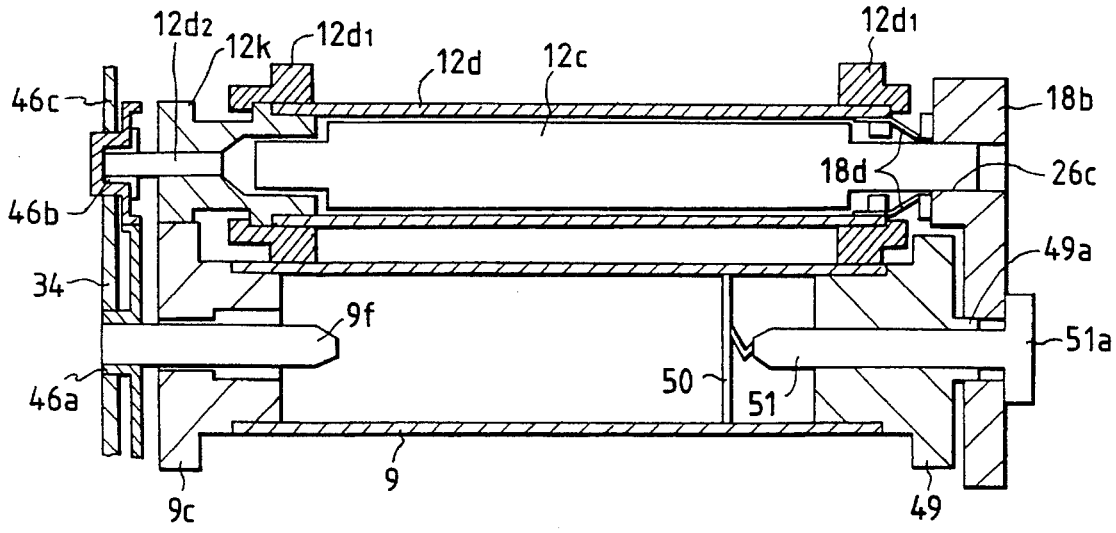
FIG. 64 is an elevational sectional view of bearing members for supporting the photosensitive drum and the developing sleeve, according to another embodiment.

Further, as shown in FIG. 44, in the first embodiment, while the photosensitive drum 9 and the developing sleeve 12*d* were supported by the bearing member 26, when the flange gear 9*c* is provided at one end of the photosensitive drum 9 and the transfer roller gear 49 is provided at the other end of the photosensitive drum, a structure as shown in FIG. 64 may be adopted. Incidentally, also in FIG. 64, elements having the same function as those in the first embodiment are designated by the same reference numerals.

More particularly, in FIG. 64, the flange gear 9*c* and the transfer roller gear 49 are secured to both ends of the photosensitive drum 9 by adhesive, press-fit or the like, respectively, and the positioning of the drum is effected by rotatably supporting a central boss 49*a* of the transfer roller gear 49 by the bearing portion 33*a* of the bearing member 26. In this case, in order to earth the photosensitive drum 9, a drum earthing plate 50 having a central L-shaped contact portion is secured to and contacted with the inner surface of the drum, and a drum earthing shaft 51 passing through a central bore in the transfer roller gear 49 is always contacted with the drum earthing plate 50. The drum earthing shaft 51 is made of conductive metal such as stainless steel, and the drum earthing plate 50 is also made of conductive metal such as bronze phosphate, stainless steel or the like. When the process cartridge B is mounted within the image forming system A, a head 51*a* of the drum earthing shaft 51 is supported by the bearing member 26. In this case, the head 51*a* of the drum earthing shaft 51 is contacted with the drum earthing contact pin of the image forming system, achieving the earthing the photosensitive drum. Also in this case, as in the first embodiment, the positional accuracy between the photosensitive drum 9 and the developing sleeve 12*d* can be improved by using the single bearing member 26.

Further, the process cartridge B according to the present invention can be used to not only form a mono-color image as mentioned above, but also to form a multi-color image (two color image, three color image or full-color image) by providing a plurality of developing means 12. Furthermore, the developing method may be of known two-component magnetic brush developing type, cascade developing type, touch-down developing type or cloud developing type. In addition, in the first embodiment, while the charger means was of the so-called contact-charging type, for example, other conventional charging techniques wherein three walls are formed by tangsten wires and metallic shields made of aluminum are provided on the three walls, and positive or negative ions generated by applying a high voltage to the tangsten wires are shifted onto the surface of the photosensitive drum 9, thereby uniformly charging the surface of the photosensitive drum 9 may be adopted.

Incidentally, the contact-charging may be, for example, of blade (charging blade) type, pad type, block type, rod type or wire type, as well as the aforementioned roller type. Further, the cleaning means for removing the residual toner remaining on the photosensitive drum 9 may be of fur brush type or magnetic brush type, as well as blade type.

Furthermore, the process cartridge B comprises an image bearing member (for example, an electrophotographic photosensitive member) and at least one process means. Therefore, as well as the above-mentioned construction, the process cartridge may incorporate integrally therein the image bearing member and the charger means as a unit which can be removably mounted within the image forming system; or may incorporate integrally therein the image bearing member and the developing means as a unit which can be removably mounted within the image forming system; or may incorporate integrally therein the image bearing member and the cleaning means as a unit which can be removably mounted within the image forming system; or may incorporate integrally therein the image bearing member and two or more process means as a unit which can be removabley mounted within the image forming system. That is to say, the process cartridge incorporates integrally therein the charger means developing means or cleaning means and the electrophotographic photosensitive member as a unit which can be removably mounted within the image forming system; or incorporates integrally therein at least one of the charger means, developing means and cleaning means, and the electrophotographic photosensitive member as a unit which can be removably mounted within the image forming system; or incorporates integrally therein the developing means and the electrophotographic photosensitive member as a unit which can be removably mounted within the image forming system.

Further, in the illustrated embodiment, while the image forming system was the electrophotographic copying machine, the present invention is not limited to the copying machine, but may be adapted to other various image forming system such as a laser beam printer, a facsimile, a word processor and the like.

Figure 65:
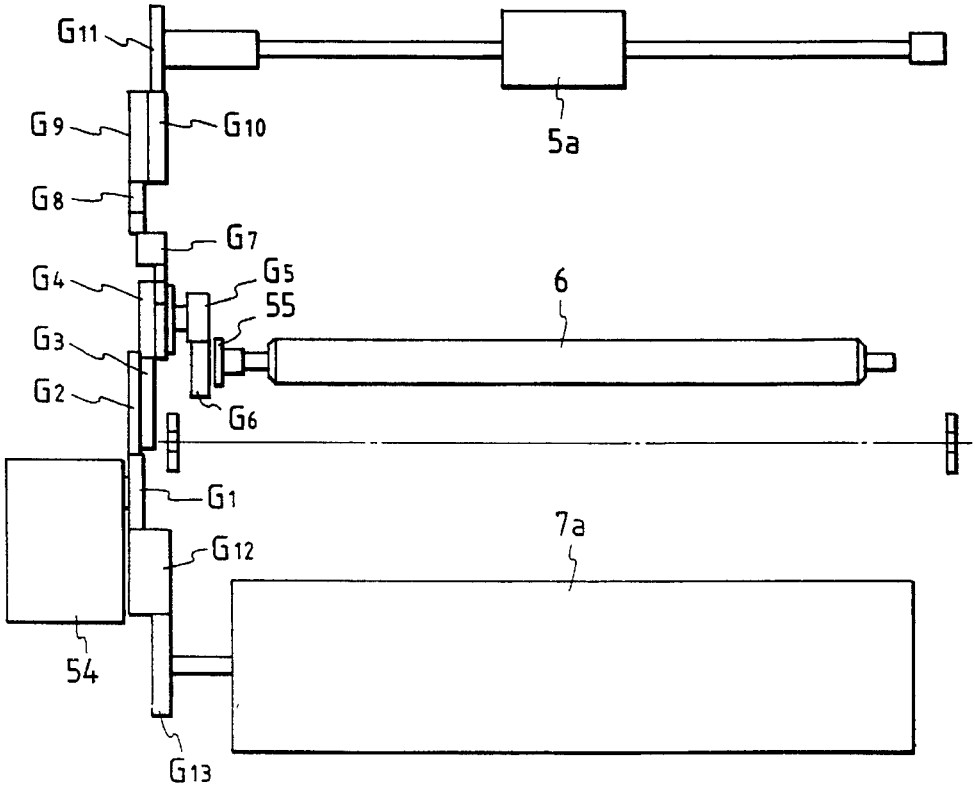
FIG. 65 is a schematic view of a transmission mechanism for transmitting a driving force from a drive motor of the image forming system to various elements.

Now, the above-mentioned driving force transmission to the photosensitive drum 9 will be further explained with more detail. As shown in FIG. 65, the driving force is transmitted from the drive motor 54 attached to the body 16 of the image forming system to a drive gear G6 via a gear train G1–G5, and from the drive gear G6 to the flange gear 9*c* meshed with the drive gear, thereby rotating the photosensitive drum 9. Further, the driving force of the drive motor 54 is transmitted from the gear G4 to a gear train G7–G11, thereby rotating the sheet supply roller 5*a*. Furthermore, the driving force of the drive motor 54 is transmitted from the gear G1 to the driving roller 7*a* of the fixing means 7 via gears G12, G13.

Figure 66:
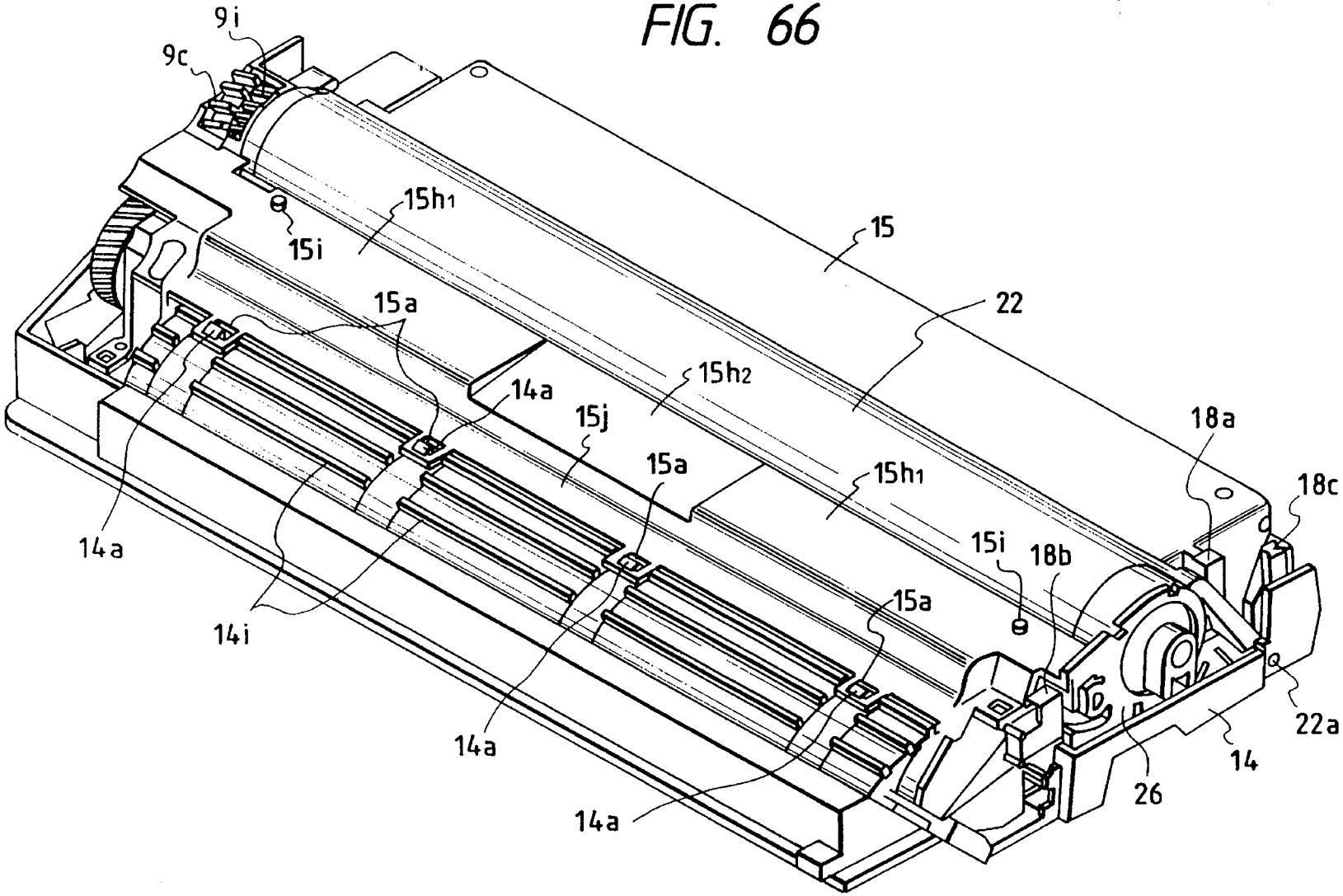
FIGS. 66 and 67 are perspective views showing a condition that the flange gear of the photosensitive drum and a gear integral with the flange gear are protruded from the lower frame.
Figure 67:
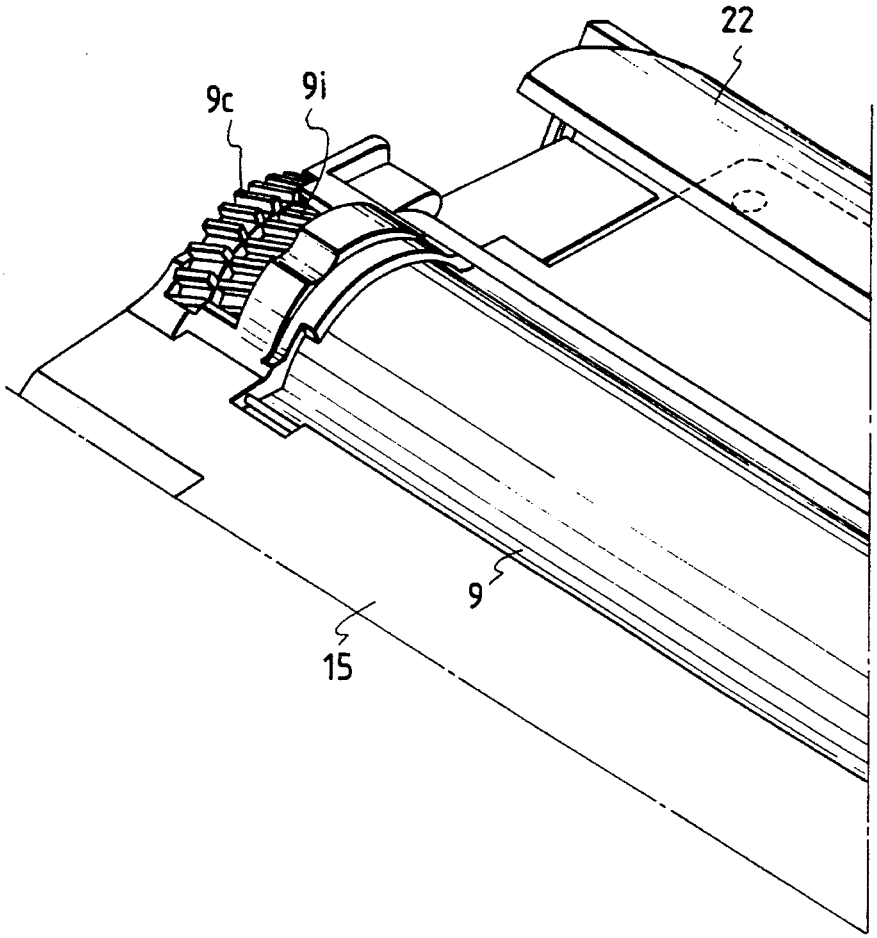

Further, as shown in FIGS. 66 and 67, the flange gear (first gear) 9*c* and the gear (second gear) 9*i* are integrally formed and portions of the gears 9*c*, 9*i* are exposed from an opening 15*g* formed in the lower frame 15. When the process cartridge B is mounted within the image forming system A, as shown in FIG., 8, the drive gear G6 is meshed with the flange gear 9*c* of the photosensitive drum 9 and the gear 9*i* integral with the gear 9*c* is meshed with the gear 55 of the transfer roller 6. Incidentally, in FIG. 68, the parts of the image forming system are shown by the solid line, and the parts of the process cartridge are shown by the phantom line.

Figure 69A:
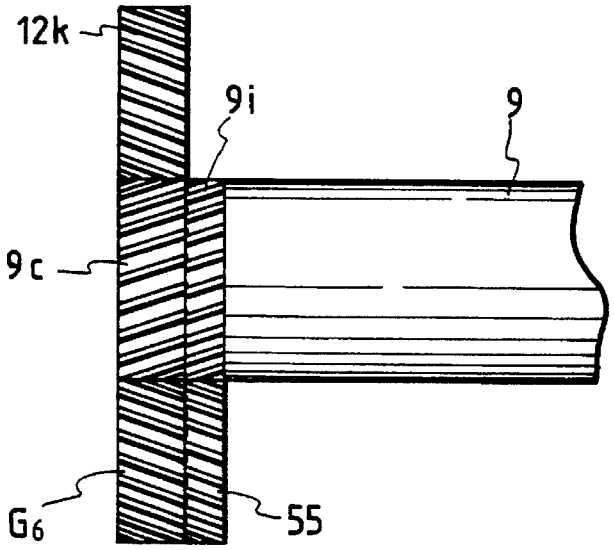
FIGS. 69A and 69B are views showing different drive transmitting mechanisms for transmitting a driving force to developing sleeves, wherein magnetic toner is used and non-magnetic toner is used.
Figure 69B:
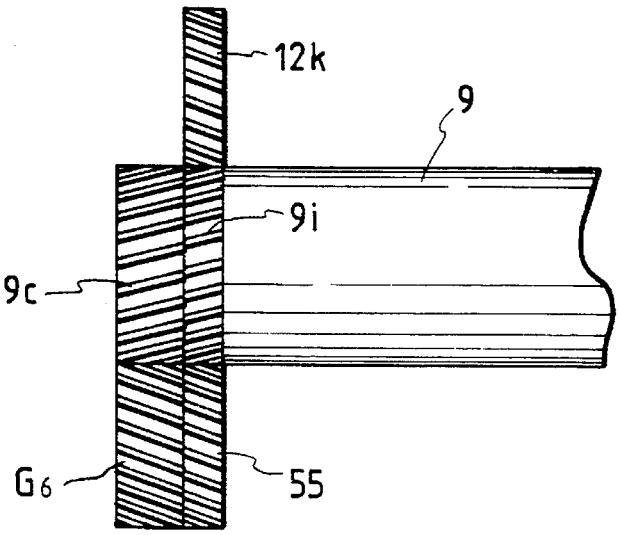

The number of teeth of the gear 9c is different from that of the gear 9i, so that the rotational speed of the developing sleeve 12d when the black image forming cartridge containing the magnetic toner is used is differentiated from the rotational speed of the developing sleeve when the color image forming cartridge containing the non-magnetic toner is used. That is to say, when the black image forming cartridge containing the magnetic toner is mounted within the image forming system, as shown in FIG. 69A, the flange gear 9c is meshed with the sleeve gear 12k of the developing sleeve 12d. On the other hand, when the color image forming cartridge containing the non-magnetic toner is mounted within the image forming system, as shown in FIG. 69B, the gear 9i is meshed with the sleeve gear 12k of the developing sleeve 12d to rotate the developing sleeve.

As mentioned above, since the gear 9c has the greater diameter and wider width than those of the gear 9i and has the number of teeth greater than that of the gear 9i, even when the greater load is applied to the gear 9c, the gear 9c can surely receive the driving force to rotate the photosensitive drum 9 surely and transmits the greater driving force to the developing sleeve 12d for the magnetic toner, thereby surely rotating the developing sleeve 12d.

According to the present invention, it is possible to provide a process cartridge and an image forming system, which can remarkably improve the accuracy of attachment positions of an image bearing member and a magnet, can keep a force of a magnet acting on an image bearing member constant, and can remarkably enhance the image quality.

What is claimed is:

1. A process cartridge detachably mountable onto a main body of an image forming system, said process cartridge comprising:

a frame;

an electrophotographic photosensitive member;

a toner carrying member for directing toner to said electrophotographic photosensitive member for developing a latent image formed on said electrophotographic photosensitive member;

a magnet disposed within said toner carrying member;

a common positioning member, discrete from said frame, contacting each of said electrophotographic photosensitive member and said magnet to mutually position said electrophotographic photosensitive member and said magnet; and an earth contact, attached to said common positioning member, for earthing said electrophotographic photosensitive member to the main body when said process cartridge is mounted onto the main body.

2. A process cartridge according to claim 1, wherein said common positioning member comprises integrally molded resin.

3. A process cartridge according to claim 2, wherein said integrally molded resin comprises one of a polyacetal group and a polyethylene group.

4. A process cartridge according to claim 1, wherein said toner carrying member comprises a sleeve.

5. A process cartridge according to claim 4, further comprising a flange attached to said sleeve, wherein one end of said magnet is positioned by said common positioning member, and another end of said magnet is supported by said flange.

6. A process cartridge according to either claim 1, 2, or 5, wherein a bias contact for applying bias to said toner carrying member is attached to said common positioning member.

7. A process cartridge according to claim 1, wherein said earth contact contacts said electrophotographic photosensitive member with a contact pressure in a range from about 10 grams to about 200 grams.

8. A process cartridge according to either claim 1, 2, or 5, wherein said common positioning member comprises a supported portion to position said process cartridge within said image forming system when said process cartridge is mounted within said image forming system.

9. A process cartridge according to claim 1, further comprising cleaning means for removing toner from said electrophotographic photosensitive member.

10. A process cartridge according to either claim 1 or 9, further comprising charger means for charging said electrophotographic photosensitive member.

11. A process cartridge according to claim 1, further comprising toner containing means for containing toner to be supplied to said toner carrying member.

12. A process cartridge according to claim 1, wherein said electrophotographic photosensitive member comprises a drum, and wherein said common positioning member positions and supports one end of said photosensitive drum while contacting an inner surface of the one end of said photosensitive drum, and positions and supports one end of said magnet, another end of said photosensitive drum being supported by a shaft, and another end of said magnet being supported by a flange provided on a sleeve.

13. An image forming system for forming an image on a recording medium and having a main body adapted to removably mount a process cartridge, said image forming system comprising:

mounting means for removably mounting a process cartridge including a frame, an electrophotographic photosensitive member, a toner carrying member for directing toner to said electrophotographic photosensitive member, a magnet disposed within said toner carrying member, a common positioning member discrete from said frame, said common positioning member contacting each of said electrophotographic photosensitive member and said magnet to mutually position said electrophotographic photosensitive member and said magnet, and an earth contact, attached to said common positioning member, for earthing said electrophotographic photosensitive member to the main body when said process cartridge is mounted onto the main body; and feeding means for feeding a recording medium.

14. An image forming system according to claim 13, wherein said image forming system comprises an electrophotographic copying machine.

15. An image forming system according to claim 13, wherein said image forming system comprises a laser beam printer.

16. An image forming system according to claim 13, wherein said image forming system comprises a facsimile apparatus.

17. A process cartridge detachably mountable to a main body of an image forming system, said process cartridge comprising:

a frame;

an electrophotographic photosensitive member;

a toner bearing member for transporting toner to said electrophotographic photosensitive member;

a magnet disposed within said toner bearing member;

an attachment member, contacting each of said electrophotographic photosensitive member and said magnet to commonly support said electrophotographic photosensitive member and said magnet, for attaching said electrophotographic photosensitive member and said magnet to said frame, said attachment member being separably attached to said frame; and an earth contact, attached to said attachment member, for earthing said electrophotographic photosensitive member to the main body when said process cartridge is mounted onto the main body.

18. A process cartridge according to claim 17, wherein said attachment member comprises integrally molded plastic.

19. A process cartridge according to claim 18, wherein said plastic comprises at least one of polyacetal and polyethylene.

20. A process cartridge according to claim 17, wherein said attachment member comprises a base member, a circular member protrusively provided on said base member for supporting said electrophotographic photosensitive member, a concave portion formed on said base member for supporting said magnet.

21. A process cartridge according to claim 17, wherein said toner bearing member comprises a roller within which said magnet is provided.

22. A process cartridge according to claim 21, wherein one end of said magnet is supported by said attachment member, and another end of said magnet is supported by a flange provided on said roller, the one end of said electrophotographic photosensitive member being supported by said attachment member and another end of said electrophotographic photosensitive member being supported by a shaft.

23. A process cartridge according to either claim 17 or 20, further comprising a bias contact for providing a developing bias to said toner bearing member, said bias contact being attached to said attachment member.

24. A process cartridge according to claim 17, wherein said earth contact contacts said electrophotographic photosensitive member with a contact pressure in a range from about 10 grams to about 200 grams.

25. A process cartridge according to claim 17, wherein said attachment member comprises a supported portion for positioning said process cartridge relative to the main body of the image forming system upon mounting said process cartridge to the main body of the image forming system.

26. A process cartridge according to claim 17, further comprising cleaning means for removing toner from said electrophotographic photosensitive member.

27. A process cartridge according to claim 17, further comprising charger means for charging said electrophotographic photosensitive member.

28. A process cartridge according to claim 17, further comprising toner containing means for containing the toner to be supplied to said toner bearing member.

29. A process cartridge according to claim 1, wherein one end of said electrophotographic photosensitive member is supported by said common positioning member and another end of said electrophotographic positioning member is supported by a shaft which is supported by said frame.

30. A process cartridge according to claim 17, wherein one end of said electrophotographic photosensitive member is supported by said common positioning member and another end of said electrophotographic photosensitive member is supported by a shaft which is supported by said frame.

31. A process cartridge removably mounted onto a main body of an image forming system, comprising:

a frame;

a photosensitive drum;

a developing sleeve and a magnet supplying a toner to said photosensitive drum for developing a latent image formed on said photosensitive drum, said magnet being disposed in said developing sleeve;

one end of said photosensitive drum being supported by a shaft, and one end of said magnet being supported by a flange provided on an end of said developing sleeve;

an attachment member being separably attached to said frame and contacting the one end of said photosensitive drum and the one end of said magnet to commonly support said photosensitive drum and said magnet, for attaching the one end of said photosensitive drum and the one end of said magnet to said frame; and said attachment member including an earth contact attached to said attachment member for earthing said photosensitive drum to the main body when said process cartridge is mounted onto the main body, and a developing bias contact attached to said attachment member for providing a developing bias from the main body to said developing sleeve when said process cartridge is mounted onto the main body.

32. A process cartridge according to claim 31, wherein said attachment member comprises a base member, a circular member protrusively provided on said base member for supporting one end of said photosensitive drum, and a concave portion formed on said base member for supporting the one end of said magnet.

33. A process cartridge according to claim 32, wherein the circular member engages an inner surface of said photosensitive drum, and a D-shaped end of said magnet engages the concave portion.

34. A process cartridge according to either claim 31 or 32, wherein said attachment member comprises a supported portion for positioning said process cartridge relative to the main body upon mounting of said process cartridge onto the main body.

35. A process cartridge according to either claim 31 or 32, wherein said attachment member comprises an integrally molded plastic member.

36. A process cartridge according to claim 35, wherein said plastic comprises at least one of polyacetal and polyethylene.

37. A process cartridge according to claim 31, further comprising means for removing toner from said photosensitive drum.

38. A process cartridge according to claim 31 or 37, further comprising a charging member for charging said photosensitive drum.

39. A process cartridge according to claim 31, wherein both ends of said developing sleeve in a longitudinal direction thereof are supported by sleeve bearings.

40. A process cartridge according to claim 39, wherein said sleeve bearings are urged by springs so that said developing sleeve is urged toward said photosensitive drum said springs.

41. An attachment member for use with a process cartridge removably mounted onto a main body of an image forming apparatus, said process cartridge including a frame, a photosensitive drum, a developing sleeve, and a magnet for supplying a toner to the photosensitive drum for developing a latent image formed thereon, the magnet being disposed in the developing sleeve, said attachment member comprising:

a base member;

a first abutment portion, provided on said base member to be abutted against the photosensitive drum for supporting the photosensitive member;

a second abutment portion provided on said base member to be abutted against the magnet for supporting the magnet;

an earth contact attached to said attachment member for earthing the photosensitive drum to the main body; and a developing bias contact attached to said attachment member for providing a developing bias from the main body to the developing sleeve when the process cartridge is mounted onto the main body, wherein said attachment member contacts each of the photosensitive drum and the magnet to commonly support the photosensitive drum and the magnet for attaching the photosensitive drum and the magnet to the frame, said attachment member being separably attached to the frame.

42. An attachment member according to claim 41, wherein said first abutment portion comprises a circular member protrusively provided on said base member and engaging one end of the photosensitive drum, said second abutment member comprises a concave portion formed on said base member which engages one end of the magnet.

43. An attachment member according to claim 42, wherein said circular member engages with an inner surface of the photosensitive drum, and a D-shaped end of the magnet engages the concave portion.

44. An attachment member according to either claim 41 or 42, wherein said attachment member comprises a supported portion for positioning the process cartridge relative to the main body of the image forming apparatus upon mounting of the process cartridge onto the main body.

45. An attachment member according to either claim 41, 42, or 43, wherein said attachment member comprises an integrally molded plastic member.

46. An attachment member according to claim 45, wherein said plastic comprises an anti-wear material including at least one of polyacetal and polyethylene.

* * * * *

UNITED STATES PATENT AND TRADEMARK OFFICE

CERTIFICATE OF CORRECTION

PATENT NO. : 5,510,878 Page 1 of 5

DATED : April 23, 1996

INVENTOR(S) : SHINYA NODA, ET AL.

It is certified that error appears in the above-indentified patent and that said Letters Patent is hereby corrected as shown below:

ON THE COVER PAGE, item

[56] References Cited

FOREIGN PATENT DOCUMENTS

"3257449 11/1991 Japan" should read --3-257449 11/1991 Japan--.

COLUMN 1

Line 27, "sheets." should read --sheet.--;
Line 33, "inconvenient." should read --inconvenienced.--; and
Line 42, "system" should read --system,--.

COLUMN 3

Line 5, "lower" should read --a lower--;
Line 18, "filler a graph showing" should read --filler;-- and
Lines 19 and 20 should be deleted in their entirety.

COLUMN 4

Line 57, "easy" should read --easily--.

COLUMN 5

Line 54, "now U.S. Pat. No. 5,151,734," should read --(now U.S. Pat. No. 5,151,734),--.

UNITED STATES PATENT AND TRADEMARK OFFICE

CERTIFICATE OF CORRECTION

PATENT NO. : 5,510,878

DATED : April 23, 1996

INVENTOR(S) : SHINYA NODA, ET AL.

It is certified that error appears in the above-indentified patent and that said Letters Patent is hereby corrected as shown below:

COLUMN 6

Line 2, "toward pressed" should read --pressed toward--;
Line 15, "01" should read --O1--;
Line 16, "02" should read --O2--;
Line 18, "01 and 02" should read --O1 and O2--; and
Line 63, "to" (second occurrence) should read --t.--.

COLUMN 9

Line 10, "member" should read --member,--.

COLUMN 10

Line 46, "is" should read --in--.

COLUMN 11

Line 14, "216 mm" should read --216 mm,--;
Line 18, delete "and";
Line 24, "7a," should read --7a.--; and
Line 25, "when" should read --When--.

COLUMN 13

Line 7, delete "as" (first occurrence); and
Line 20, "effect of weight" should read --weight,--.

COLUMN 15

Line "tile" should read --the--.

UNITED STATES PATENT AND TRADEMARK OFFICE

CERTIFICATE OF CORRECTION

PATENT NO. : 5,510,878

DATED : April 23, 1996

INVENTOR(S) : SHINYA NODA, ET AL.

It is certified that error appears in the above-indentified patent and that said Letters Patent is hereby corrected as shown below:

COLUMN 16

Line 4, "voltage" should read --voltage,--.

COLUMN 17

Line 56, "polymetylmethacrylate" should read --polymethylmethacrylate--; and
Line 57, "buthymethacrylate" should read --butylmethacrylate--.

COLUMN 23

Line 48, "13*b*be" should read --13*b* be--.

COLUMN 25

Line 46, "card" should read --card,--.

COLUMN 26

Line 14, "(=1-2 ram)" should read --(=1-2 mm)--.

COLUMN 33

Line 6, "18.9 Em;" should read --18.9 mm;--;
Line 8, "13.5 m;" should read --13.5 mm;--; and
Line 37, "With" should read --with--.

UNITED STATES PATENT AND TRADEMARK OFFICE

CERTIFICATE OF CORRECTION

PATENT NO. : 5,510,878

DATED : April 23, 1996

INVENTOR(S) : SHINYA NODA, ET AL.

It is certified that error appears in the above-indentified patent and that said Letters Patent is hereby corrected as shown below:

COLUMN 35

Line 50, delete "will";
Line 51, "be mounted is" should read --is mounted will be--; and
Line 53, "aboutment" should read --abutment--.

COLUMN 36

Line 7, "52" should read --52,--.

COLUMN 39

Line 51, "earthing" should read --earthing of--; and
Line 66, "tangsten" should read --tungsten--.

COLUMN 40

Figure 68:
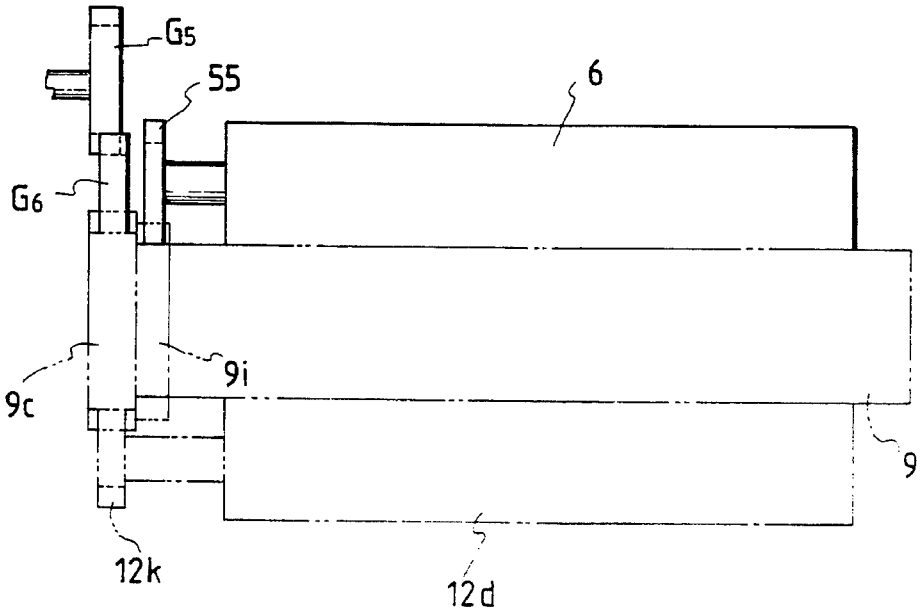
FIG. 68 is a view showing a gear train for transmitting a driving force from the drive gear of the image forming system to the photosensitive drum and the transfer roller.

Line 25, "removabley" should read --removably--; and
Line 62, "FIG.,8," should read --FIG. 68,--.

UNITED STATES PATENT AND TRADEMARK OFFICE

CERTIFICATE OF CORRECTION

PATENT NO. : 5,510,878 Page 5 of 5

DATED : April 23, 1996

INVENTOR(S) : SHINYA NODA, ET AL.

It is certified that error appears in the above-indentified patent and that said Letters Patent is hereby corrected as shown below:

COLUMN 44

Line 58, "said" should read --by said--.

Signed and Sealed this

Seventeenth Day of December, 1996

*Attest:*

*Attesting Officer*

BRUCE LEHMAN

*Commissioner of Patents and Trademarks*